US005960227A

United States Patent [19]

Kurokawa et al.

[11] Patent Number: 5,960,227

[45] Date of Patent: Sep. 28, 1999

[54] PHOTOSENSITIVE MATERIAL PROCESSING APPARATUS

[75] Inventors: Toshio Kurokawa; Noboru Sasaki, both of Kanagawa, Japan

[73] Assignee: Fuji Photo Film Co., Ltd., Kanagawa, Japan

[21] Appl. No.: 08/847,986

[22] Filed: Apr. 24, 1997

[30] Foreign Application Priority Data

| | | | |
|---|---|---|---|
| Apr. 26, 1996 | [JP] | Japan | 8-108159 |
| Apr. 26, 1996 | [JP] | Japan | 8-108272 |
| Apr. 26, 1996 | [JP] | Japan | 8-108273 |
| Apr. 26, 1996 | [JP] | Japan | 8-108274 |

[51] Int. Cl.[6] ..... G03D 3/08

[52] U.S. Cl. ..... 396/617; 396/625; 396/615; 396/620

[58] Field of Search ..... 396/612, 594, 396/595, 618, 620, 622, 626, 627, 624, 617, 625, 615; 430/30, 398–400, 403, 500, 501; 355/27–29

[56] References Cited

U.S. PATENT DOCUMENTS

| | | | |
|---|---|---|---|
| 4,775,873 | 10/1988 | Blackman et al. | 396/618 |
| 5,323,202 | 6/1994 | Glover | 396/620 |
| 5,736,305 | 4/1998 | Nomura | 430/403 |

FOREIGN PATENT DOCUMENTS

| | | | |
|---|---|---|---|
| 0 469 594 | 2/1992 | European Pat. Off. | G03D 13/00 |
| 0 709 733 | 5/1996 | European Pat. Off. | G03D 13/00 |
| 407243 | 12/1924 | Germany . | |
| 40 38 661 | 6/1991 | Germany | G03C 11/00 |
| 4-230745 | 8/1992 | Japan | G03C 5/31 |
| 4-294347 | 10/1992 | Japan | G03C 5/26 |
| 5-188562 | 7/1993 | Japan | G03D 3/06 |
| 5-273719 | 10/1993 | Japan | G03D 3/00 |
| 6-110175 | 4/1994 | Japan | G03D 3/06 |

*Primary Examiner*—D. Rutledge

*Attorney, Agent, or Firm*—Sughrue, Mion, Zinn, Macpeak & Seas, PLLC

[57] ABSTRACT

A photosensitive material processing apparatus feeds an elongated film, which is wound on a spool shaft, out from an entrance/exit opening of a film accommodating container, and carries out developing processing of the film. The photosensitive material processing apparatus includes a loading section in which the film accommodating container which accommodates the film is loaded; a feeder which feeds the film out from the film accommodating container loaded in the loading section, in a state in which one longitudinal direction end of the film is anchored to the spool shaft of the film accommodating container; and a processing tank which is sheath-shaped and whose length is longer than a length of a portion of the film which portion is to be processed and which portion has been fed out to an exterior of the film accommodating container, the processing tank having at only one longitudinal direction end portion a film entrance/exit opening through which the film enters and exits. Accordingly, there is no need for devices to separate the film from the spool shaft of the film accommodating container and to join the film and the spool shaft.

29 Claims, 54 Drawing Sheets

14
18A
50
40B
48
38A
36
38B
38
40A
26
20
32
34
30
28
22
40D
62
40C
18B
C
78
44
72
42
80
16
24
B

PHOTOSENSITIVE MATERIAL PROCESSING APPARATUS

BACKGROUND OF THE INVENTION

1. Field of the Invention

The present invention relates to a photosensitive material processing apparatus which carries out developing processing of a film accommodated in a film accommodating container.

2. Description of the Related Art

Conventionally, generally-used 135-size negative films are removed from a spool shaft (or are cut in a vicinity of a spool shaft) and are subjected to developing processing while being conveyed by conveying rollers or the like through a plurality of processing tanks.

A developed negative film is cut per a predetermined number of frames so as to form piece negatives which are returned to the customer.

Recently, a new system has been proposed in which the developed negative film is returned to the customer in the state of being accommodated in the cartridge without the negative film being cut as described above.

In this new system, a negative film is withdrawn from a cartridge which is brought in by a customer, and the negative film is subjected to developing processing. The negative film which has undergone developing processing is accommodated in the original cartridge and returned to the customer.

The processing tanks of a conventional automatic developer require a large internal volume in order for the negative film to be conveyed through the processing tanks while being bent. Further, in order to convey the negative film, it is necessary to provide a plurality of conveying rollers in the tanks, and these conveying rollers also require space.

In light of the fact that an automatic developer requires a plurality of processing tanks in order to carry out plural processings such as color developing, fixing/bleaching, rinsing, and the like, the automatic developer becomes large and occupies a large space. As a result, the automatic developer cannot be placed in a small space, and a drawback arises in that places at which the automatic developer can be placed are limited.

Further, when the above-described new system is used in an automatic developer, a device for separating the negative film from the spool shaft of the cartridge and a device for anchoring the developed negative film to the spool shaft again are needed. A drawback arises in that the automatic developer thereby becomes even more complex and even larger.

Moreover, when a small amount of negative films is to be subjected to developing processing, conventionally, the following method is used. The film case is disassembled, and the negative film therein is cut in a vicinity of the spool shaft so as to be separated from the spool shaft. A weight is attached to the cut negative film, and the negative film is immersed in the processing solution stored in the processing tank. (This method is known as "hanging developing".)

Here, when the conventional hanging developing method is used in the new system, a device, which separates the negative film accommodated in the cartridge from the spool shaft without requiring the disassembly of the cartridge, and a device, which engages the developed negative film with the spool shaft of the cartridge, are needed. A drawback arises in that the developing processing system becomes complex.

In order to solve the above-described drawbacks, a method has been proposed in which the negative film fed out to the exterior of the cartridge is immersed in the processing solutions in the processing tanks with an end portion of the negative film still anchored to the spool shaft. However, in this case as well, a device for pulling the film out from the other end thereof is needed.

In large apparatuses such as automatic developers and the like, there is a drawback in that the processing tanks become large because the negative film is conveyed by rollers.

In the hanging developing method, there is no need for conveying rollers or the like. However, because the film sways, the opening surface area of the processing tank is relatively large.

In the hanging developing method, space is required for the film to be able to sway while hanging in the processing tank, and accordingly, the processing tanks must be made sufficiently large. Therefore, as before, there is a drawback in that the processing tanks take up much space.

In order to overcome the aforementioned drawbacks, a method of automatically replacing the processing solutions in a single processing tank has been proposed.

However, in a processing tank in which the opening surface area has been made relatively small, when the processing solution is stirred or replaced by a pump or the like, the liquid surface fluctuates greatly, and the processing solution may overflow out of the tank.

In the hanging developing method, in order to prevent developing irregularities, the negative film is swung up and down or the like such that processing is carried out while the processing solution is being stirred. Therefore, a drawback arises in that much work is required. Further, in the hanging developing method as well, a processing tank must be provided for each processing solution, and as before, a drawback arises in that the processing tanks require much space.

The above-described drawbacks are also present in a printer processor which combines an automatic developer and a printer.

SUMMARY OF THE INVENTION

In view of the aforementioned, an object of the present invention is to provide a photosensitive material processing apparatus which can be placed even in a small space.

Another object of the present invention is to provide a photosensitive material processing apparatus in which a film of the new system can be subjected to proper developing processing while overflowing, leaking and the like of the processing solutions are prevented.

Yet another object of the present invention is to provide a photosensitive material processing apparatus in which even a film of the new system can be subjected to proper developing processing without much work being required.

A further object of the present invention is to provide a photosensitive material processing apparatus having a structure which corresponds to the new system and which is not complex.

A first aspect of the present invention is a photosensitive material processing apparatus comprising: a loading section in which is loaded a film accommodating container which accommodates an elongated film in a state in which one longitudinal direction end of the film is anchored to a spool shaft and the film is wound on the spool shaft from the one longitudinal direction end of the film; feeding means for feeding the film out of the film accommodating container loaded in the loading section from another longitudinal direction end of the film, and for maintaining a state in which the one longitudinal direction end of the film is anchored to the spool shaft; and a processing tank which accommodates a portion of the film, which portion has been fed out from the film accommodating container, in a state in which the one longitudinal direction end of the film is anchored to the film accommodating container, and in which the portion of the film is processed in a processing solution.

In the photosensitive material processing apparatus of the first aspect, when the film accommodating container, in which an undeveloped film is accommodated, is loaded in the loading section, the feeding means feeds the film out from the film accommodating container loaded in the loading section, and the film remains in a state in which one longitudinal direction end thereof is anchored to the spool shaft. The portion of the film which portion has been fed out from the film accommodating container is processed in the processing solution in the processing tank. In the photosensitive material processing apparatus of the present first aspect, the film can be subjected to developing processing without being separated from the film accommodating container. Therefore, there is no need for devices for separating the film from the spool shaft of the film accommodating container and joining the film to the spool shaft. Moreover, there is no need for conveying rollers to convey the film or for a device to pull out the film or the like. Therefore, the processing tank can be made compact, and the entire photosensitive material processing apparatus can be made compact.

In a second aspect of the present invention, in the apparatus of the first aspect of the present invention, the processing tank is a sheath-shaped processing tank whose longitudinal direction length is longer than a length of the portion of the film to be processed in the processing solution, and which has at only one longitudinal direction end portion of the processing tank a film entrance/exit opening through which the film enters and exits.

In the second aspect, because the processing tank is sheath-shaped, it suffices to use a small amount of processing solution, and the processing tank can be made more compact so that the entire apparatus can be made smaller.

In a third aspect of the present invention, in the photosensitive material processing apparatus of the second aspect, a dimension, in a direction along a thickness direction of the film, of a cross-sectional configuration of an interior of the processing tank in a direction orthogonal to a longitudinal direction of the processing tank is smaller than a dimension, in a direction along a transverse direction of the film, of the cross-sectional configuration of the interior of the processing tank in the direction orthogonal to the longitudinal direction of the processing tank.

In the photosensitive material processing apparatus of the third aspect, the cross-sectional configuration of the interior of the processing tank in a direction orthogonal to the longitudinal direction is formed such that the dimension thereof in a direction along the thickness direction of the film is smaller than the dimension thereof in a direction along the transverse direction of the film. Therefore, the volume of the processing tank can be kept small, and it is possible to store only the minimum amount of processing solution necessary for processing one film in the processing tank.

It is preferable that the dimension of the interior of the processing tank in a direction along the direction of thickness of the film (i.e., the thickness of the interior of the processing tank) is 20 to 200 times the thickness of the film. When the thickness of the interior of the processing tank is less than 20 times the thickness of the film, the amount of processing solution may be insufficient. If the thickness of the interior of the processing tank is greater than 200 times the thickness of the film, an amount of processing solution greater than that which is needed is stored, and the processing tank becomes large.

In the fourth aspect of the present invention, in the photosensitive material processing apparatus of the third aspect, for a dimension of an interior of the processing tank in a direction along a thickness direction of the film, a portion of the dimension corresponding to a transverse direction central portion of the film is greater than portions of the dimension corresponding to transverse direction end portions of the film.

In the photosensitive material processing apparatus of the fourth aspect, the dimension of the interior of the processing tank in a direction along the direction of thickness of the film is greater at the portion corresponding to the transverse direction central portion of the film than at the portions corresponding to the transverse direction end portions of the film. Therefore, when the transverse direction end portions of the film are inserted, they can be guided by the narrow portions within the tank. Further, because the inner walls of the tank are distanced from the image regions formed on the transverse direction central portion of the film, the image regions are not damaged.

It is preferable that the thickness dimension of the portions of the interior of the processing tank, which portions correspond to the transverse direction end portions of the film, are 2 to 10 times the thickness of the film in order to guide the film. Further, the thickness of the interior space of the tank gradually decreases from the transverse direction central portion toward the transverse direction end portions.

In a fifth aspect of the present invention, the photosensitive material processing apparatus of any of the second through fourth aspects further comprises pull-in means for pulling the film into the processing tank while holding the other longitudinal direction end of the film which has been fed out from the film accommodating container.

In the photosensitive material processing apparatus of the fifth aspect, the leading end of the film fed out from the film accommodating container is held by the pulling-in means and can be pulled into the processing tank. Therefore, even in cases in which the film is particularly long, the film can easily and reliably be inserted into the processing tank.

In a sixth aspect of the present invention, the photosensitive material processing apparatus of any of the second through fifth aspects further comprises processing solution supplying means for circulating processing solution in the processing tank, replacing processing solution in the processing tank, and discharging processing solution from the processing tank.

In the photosensitive material processing apparatus of the sixth aspect, the processing solution supplying/discharging means carries out circulation, replacement (e.g., replacing color developing solution with fixing/bleaching solution or replacing bleaching/fixing solution with rinse solution) and discharging of the processing solution (e.g., color developing solution, fixing/bleaching solution, rinse solution) in the processing tank.

In a seventh aspect of the present invention, in the photosensitive material processing apparatus of the sixth aspect, the processing solution supplying means disposes of processing solution, which contains at least a color developing chemical agent, after the processing solution has been used.

Because the processing conditions for color developing processing are particularly stringent, the processing solution which includes color developing chemical agents is disposed of after being used once. The other processing solutions may be reused, and may be disposed of in accordance with their level of deterioration. In this way, the film can be processed under optimal processing solution conditions. Further, because the amount of processing solution used in processing is the minimum amount necessary, the amount of processing solution which is used and then disposed of can be kept down.

In an eighth aspect of the present invention, the photosensitive material processing apparatus of any of the second through seventh aspects further comprises closing means which is movable and closes the film entrance/exit opening in a state in which the portion of the film which has been fed out is accommodated in the processing tank.

In the photosensitive material processing apparatus of the eighth aspect, the movable-type closing means closes the film entrance/exit opening in a state in which the portion of the film which has been fed out is accommodated in the processing tank. Therefore, during circulation, replacement and the like of the processing solutions, the processing solutions do not overflow out of the film entrance/exit opening.

In the ninth aspect of the present invention, the photosensitive material processing apparatus of any of the second through eighth aspects further comprises an elastic wall member which is elastically deformable and is provided at a wall portion which opposes at least one surface of the portion of the film which portion is accommodated in the processing tank; and a presser member which is movable along a longitudinal direction of the processing tank and which presses the elastic wall member toward a wall surface of the processing tank which wall surface opposes the elastic wall member.

In the photosensitive material processing apparatus of the ninth aspect, when the elastic wall member is pressed by the presser member such as a presser roller in a state in which the fed-out portion of the film is accommodated in the processing tank, the film is nipped between the inner wall surface of the elastic wall member and the inner wall surface which opposes the inner wall surface of the elastic wall member, such that the interior of the processing tank is divided into two sections in the longitudinal direction. When the presser roller is moved along the longitudinal direction of the processing tank while pressing the elastic wall member, the volume within the processing tank at the side in the direction in which the presser roller is moving decreases, whereas the volume of the interior of the processing tank at the side in the direction opposite the moving direction increases. Therefore, when the presser roller is moved from one longitudinal direction end of the processing tank toward the other longitudinal direction end, the processing solution within the section of the processing tank at the divisional other longitudinal direction end side is pressed out, and simultaneously, another processing solution flows into the section of the processing tank at the opposite side. Because a vacuum is created at the section of the interior of the tank whose volume is expanding, the processing solution naturally flows into this section. In this way, in the present ninth aspect, due to the pressing and moving of the presser roller, a processing solution can easily be replaced by another processing solution without the respective processing solutions mixing together.

In a tenth aspect of the present invention, the photosensitive material processing apparatus of any of the second through the ninth aspects further comprises moving means for moving the film accommodating container in a direction of moving apart from the processing tank; and drying means for forcibly blowing drying air to a portion of the film pulled out of the processing tank by movement of the film accommodating container.

In the photosensitive material processing apparatus of the tenth aspect, due to the moving means moving in a direction in which the film accommodating container moves apart from the processing tank, the film for which processing has been completed can be pulled out of the processing tank. Due to the movement of the moving means, the developed film which has been pulled out of the processing tank can be pulled into a linear shape. The drying means forcibly blows drying air to the film which has been pulled into a linear shape, so as to rapidly dry the film. Because the film is not dried in a slack, stationary state, there are no traces left on the film due to water drops remaining in places on the film because of deficient squeezing or the like. Further, because the film can be dried while being conveyed, the dried portions can be sent to the next process more quickly than in a case in which the film is conveyed to the subsequent process after the entire film has been dried.

In an eleventh aspect of the present invention, the photosensitive material processing apparatus of the tenth aspect further comprises image information recording means for recording an image formed on the film onto a recording medium.

In the photosensitive material processing apparatus of the eleventh aspect, the images of the film which has been subjected to developing and drying processing can be recorded onto a recording medium by a recording means. The recording means is formed of, for example, a light source, a CC filter, a negative carrier, a lens system, a system for conveying the photosensitive material (recording medium) such as a photographic printing paper, a system for developing processing the photosensitive material, and the like. Further, the recording means may be a print means which prints onto surface-exposed prints, or may be a means which prints by some other method. Or, the densities of the image pixels may be recorded by a CCD scanner onto a digital recording medium such as a floppy, an IC card or the like.

In a twelfth aspect of the present invention, in the first aspect of the present invention, the processing tank has a film insertion opening into which the film, which is fed out from the film accommodating container by the feeding means, is inserted from the other longitudinal direction end of the film, and the photosensitive material processing apparatus further comprises closing means for closing the film insertion opening.

In the photosensitive material processing apparatus of the twelfth aspect, the conveying means feeds the film out from the film accommodating container in a state in which one longitudinal direction end of the film is anchored to the spool shaft. The film which has been fed out from the film accommodating container is inserted into the processing tank from the film insertion opening, and is subjected to processing in the processing solution in the processing tank. In the photosensitive material processing apparatus of the present twelfth aspect, during developing processing, the film insertion opening can be closed tightly with the film inserted in the processing tank, and leaking of processing solution from the film insertion opening at the time of stirring or circulating the processing solution or the like can be prevented. Because the film insertion opening can be tightly closed by the tightly-closing means, oxidization and evaporation of the processing solution within the processing tank can be suppressed. Further, because developing processing can be carried out without separating the film from the film accommodating container, there is no need for devices for separating the film from the spool shaft of the film accommodating container and joining the film to the spool shaft. Moreover, because there is no need for conveying rollers or the like to convey the film, the processing tank can be made compact, and the photosensitive material processing apparatus can be made more compact.

In a thirteenth aspect of the present invention, the photosensitive material processing apparatus of the twelfth aspect further comprises processing solution supplying means for circulating processing solution in the processing tank, replacing processing solution in the processing tank, and discharging processing solution from the processing tank.

In the photosensitive material processing apparatus of the thirteenth aspect, it suffices to use a single processing tank. The processing solution supplying/discharging means carries out circulation, replacement (e.g., replacing color developing solution with fixing/bleaching solution or replacing bleaching/fixing solution with rinse solution) and discharging of the processing solution (e.g., color developing solution, fixing/bleaching solution, rinse solution) in the processing tank.

In a fourteenth aspect of the present invention, in the photosensitive material processing apparatus of the twelfth or thirteenth aspect, the processing tank has an inner space having a circular cross-section.

In the photosensitive material processing apparatus of the fourteenth aspect, the film can be processed in a coiled configuration in the inner space having a circular cross-section.

In a fifteenth aspect, in the photosensitive material processing apparatus of the fourteenth aspect, the film insertion opening is formed at the outer peripheral surface.

In the photosensitive material processing apparatus of the fifteenth aspect, because the film insertion opening is formed at the outer peripheral surface, when the film which has been unwound from the spool shaft of the film accommodating container is inserted into the processing tank from the film insertion opening, due to the tendency of the film to curl, the film is accommodated in a coiled shape in the inner space of the processing tank which inner space has a circular cross-section.

In another example, the film may be made to assume a coiled shape along a guide and accommodated in this state. In this case, mechanisms such as, for example, a Nycore, a basket for drum developing and the like may be used. (A Nycore is a device in which a film is wound on a reel, the reel on which the film is wound is placed in a tank, processing solution is poured in the tank to 80% of the capacity of the tank, and the processing solution is agitated by the tank being shaken manually.) Further, when the film is wound together with an emboss film, any of the methods disclosed in Japanese Patent Application Laid-Open (JP-A) No. 4-230745, JP-A No. 5-273719, JP-A No. 6-110175 or the like may be used.

In a sixteenth aspect, in the photosensitive material processing apparatus of the fifteenth aspect, an entrance/exit opening for the processing solution is provided at each axial direction side of the processing tank.

In the photosensitive material processing apparatus of the sixteenth aspect, the processing solution can be supplied from one of the entrance/exit openings which are provided at the axial direction sides of the processing tank, and can be discharged from the other entrance/exit opening. In this way, the processing solution flows along the transverse direction of the accommodated film, and a predetermined processing is carried out. Because the processing solution flows along the transverse direction of the film, the processing solution can be replaced by another processing solution quickly.

In a seventeenth aspect, the photosensitive material processing apparatus of the second aspect further comprises closing means for closing the film entrance/exit opening; a processing solution entrance/exit opening which is provided at each longitudinal direction end portion of the processing tank, and through which processing solution enters and exits; processing solution supplying/discharging means, connected to the processing solution entrance/exit opening, for circulating processing solution in the processing tank, replacing processing solution in the processing tank, and discharging processing solution from the processing tank; and stirring means for stirring the processing solution in the processing tank.

In the photosensitive material processing apparatus of the seventeenth aspect, the elongated film is inserted into the sheath-shaped processing tank from the film insertion opening, and the film insertion opening is closed tightly by the tightly-closing means. In a case in which a film of the new system is being subjected to processing, the film is fed out from the cartridge, and the fed-out film can be inserted into the processing tank without being separated from the cartridge.

Thereafter, the processing solution is supplied into the processing tank from one of the processing solution entrance/exit openings, and the processing solution which is discharged from the other processing solution entrance/exit opening is returned to the one processing solution entrance/exit opening and is circulated along the longitudinal direction of the processing tank. At this time, by stirring the processing solution in the processing tank by a stirring means, turbulent flow is caused, and developing irregularities can thereby be prevented.

In the photosensitive material processing apparatus of the present seventeenth aspect, there is no need for devices for separating the film from the spool shaft of the cartridge or joining the film to the spool shaft. Further, there is no need for conveying rollers or the like for conveying the film. Therefore, the processing tank can be made compact, and the photosensitive material processing apparatus can also be made compact.

In a case in which the film is a color negative film, for example, color developing processing in a color developing solution is first carried out. Then, the color developing solution is replaced with bleaching solution, and bleaching processing is carried out. The bleaching solution is then replaced with fixing solution, and fixing processing is carried out. Thereafter, the fixing solution is replaced by rinse solution, and rinsing processing is carried out. The rinse solution is discharged, and developing processing of the film is completed.

It is preferable that the dimension of the interior of the processing tank in a direction along the direction of thickness of the film (i.e., the thickness of the interior of the processing tank) is 20 to 200 times the thickness of the film. If the thickness of the interior of the processing tank is less than 20 times the thickness of the film, the amount of processing solution may be insufficient. If the thickness of the interior of the processing tank is greater than 200 times the thickness of the film, an amount of processing solution greater than that needed is stored, and the processing tank becomes larger.

The dimension of the interior of the processing tank along the direction of thickness of the film is greater at the portion corresponding to the transverse direction central portion of the film than at the portions corresponding to the transverse direction end portions of the film. In this way, the image regions formed at the transverse direction central portion of the film are separated from the inner wall of the processing tank, and damage to the image regions can be prevented. In this case, it is preferable that the dimension of the interior of the processing tank along the direction of thickness of the film (i.e., the thickness of the interior of the processing tank) is, at the transverse direction central portion of the film, 20 to 200 times the thickness of the film, and is, at the portions corresponding to the transverse direction end portions of the film, 2 to 10 times the thickness of the film.

In an eighteenth aspect of the present invention, in the photosensitive material processing apparatus of the seventeenth aspect, the stirring means has a cross-sectional configuration deforming means for deforming a cross-sectional configuration of an interior of the processing tank.

In the photosensitive material processing apparatus of the eighteenth aspect, the cross-sectional configuration changing means changes the cross-sectional configuration of the interior of the processing tank. Flow in the processing tank can be caused by, for example, making the cross-sectional configuration of one portion small and the cross-sectional configuration of another portion large. By making the cross-sectional configuration of one portion and the cross-sectional configuration of another portion large and small alternately, the processing solution in the processing tank can be stirred.

In a nineteenth aspect, in the photosensitive material processing apparatus of the eighteenth aspect, the cross-sectional configuration deforming means has a flexible wall, which is formed by a flexible member at a portion of an inner wall surface of the processing tank, and a flexible wall deforming means for deforming the flexible wall.

In the photosensitive material processing apparatus of the nineteenth aspect, the cross-sectional configuration of the interior of the tank can be changed by deforming the flexible wall by the flexible wall deforming means. In this way, the processing solution within the processing tank can be stirred.

In a twentieth aspect, in the photosensitive material processing apparatus of the nineteenth aspect, the flexible wall is provided at both transverse direction sides of the processing tank.

In the photosensitive material processing apparatus of the twentieth aspect, the flexible wall can be deformed by the flexible wall deforming means such that the surface area of the cross-section of one transverse direction side of the interior of the processing tank becomes small, whereas the surface area of the cross-section of the other transverse direction side of the interior of the processing tank becomes large. In this way, the processing solution within the processing tank can be made to flow along the transverse direction of the processing tank and is thereby stirred.

In a twenty-first aspect, the photosensitive material processing apparatus of the first aspect further comprises moving means for moving the loading section between a first position, at which the loading section is adjacent to the processing tank, and a second position, at which the loading section is apart from the processing tank.

In the photosensitive material processing apparatus of the twenty-first aspect, first, a film accommodating container which accommodates an undeveloped film is loaded into the loading section positioned at a first position adjacent to the processing tank.

Next, the feeding means is operated so as to feed the film out from the film accommodating cartridge toward the processing tank and so as to maintain the state in which one longitudinal direction end of the film is anchored to the spool shaft.

When processing of the fed-out portion of the film in the processing solution in the processing tank has been completed, the moving means moves the loading section to a second position which is away from the processing tank. In this way, the processed film is pulled out of the processing tank while still being connected to the film accommodating container, and processing of the film is completed.

Because no film conveying device formed from a plurality of rollers is needed in the processing tank, the processing tank can be made compact, and the structure of the processing tank can be simplified.

Further, because developing processing can be carried out without separating the film from the film accommodating container, there is no need for devices for separating the film from the spool shaft of the film accommodating container and for joining the film to the spool shaft. In this way, a simple, compact photosensitive material processing apparatus corresponding to the new system can be achieved.

In a twenty-second aspect, in the photosensitive material processing apparatus of the twenty-first aspect, the moving means is provided at the loading section.

In the photosensitive material processing apparatus of the twenty-second aspect, in the twenty-first aspect, the moving means is provided at the loading section. Therefore, the loading section itself can move in a desired direction.

In a twenty-third aspect, in the photosensitive material processing apparatus of either the twenty-first or twenty-second aspect, a drying means, which forcibly blows drying air to the film which has been processed in the processing tank, is provided at a third position which is a position between the first position and the second position.

In the photosensitive material processing apparatus of the twenty-third aspect, when the loading section moves away from the processing tank, i.e., when the loading section moves from the first position to the second position, the developed film which is pulled out from the processing tank can be pulled into a linear shape. The drying means forcibly blows drying air to the film which has been pulled into a linear shape, so as to dry the film quickly. Because the film is not dried in a slack, stationary state, there are no traces left on the film due to water drops remaining in places on the film because of deficient squeezing or the like. Further, because the film can be dried while being conveyed, the dried portions can be sent to the next process more quickly than in a case in which the film is conveyed to the subsequent process after the entire film has been dried.

In a twenty-fourth aspect, in the photosensitive material processing apparatus of the twenty-third aspect, the recording means, which records images of the film onto a recording medium, is provided at a position between the second position and the position at which the drying means is provided.

In the photosensitive material processing apparatus of the twenty-fourth aspect, the loading section is moved by the moving means in a direction of moving away from the processing tank, and the film dried by the drying means is conveyed to the recording means. At the recording means, the images of the film which has been conveyed in are recorded onto a recording medium such as a photographic printing paper or the like, and so-called prints are formed. In the present twenty-fourth aspect, processes from developing processing to the printing operation can be carried out without separating the film from the film accommodating container. Further, because the images of the dried portions of the film are passed on to the next process successively from the drying section, prints can be obtained more quickly than in a case in which the entire film is passed on to the exposure device after being dried.

In a twenty-fifth aspect, the photosensitive material processing apparatus of the twenty-fourth aspect further comprises accommodating means for accommodating the recording medium onto which the image has been recorded; and film accommodating container moving means for removing the film accommodating container loaded in the loading section, and accommodating the film accommodating container in the accommodating means.

In the photosensitive material processing apparatus of the twenty-fifth aspect, the image recording media (prints) on which images are recorded are accommodated in the accommodating means. The film for which printing has been completed is rewound into the film accommodating container by the feeding means being driven reversely. The film accommodating container which accommodates the film is removed from the loading section by the film accommodating container moving means, and is accommodated in the accommodating means in which the prints are accommodated. In this way, the film accommodating container and the recording media (prints) can be collected together.

DESCRIPTION OF THE PREFERRED EMBODIMENTS

First Embodiment

A first embodiment of the present invention will be described hereinafter with reference to FIGS. 1 through 14. (Cartridge and Film)

First, a cartridge 14 and a film F used in the present embodiment will be summarily described hereinafter with reference to FIGS. 1 through 4.

Figures 1A, 1B, 1C:
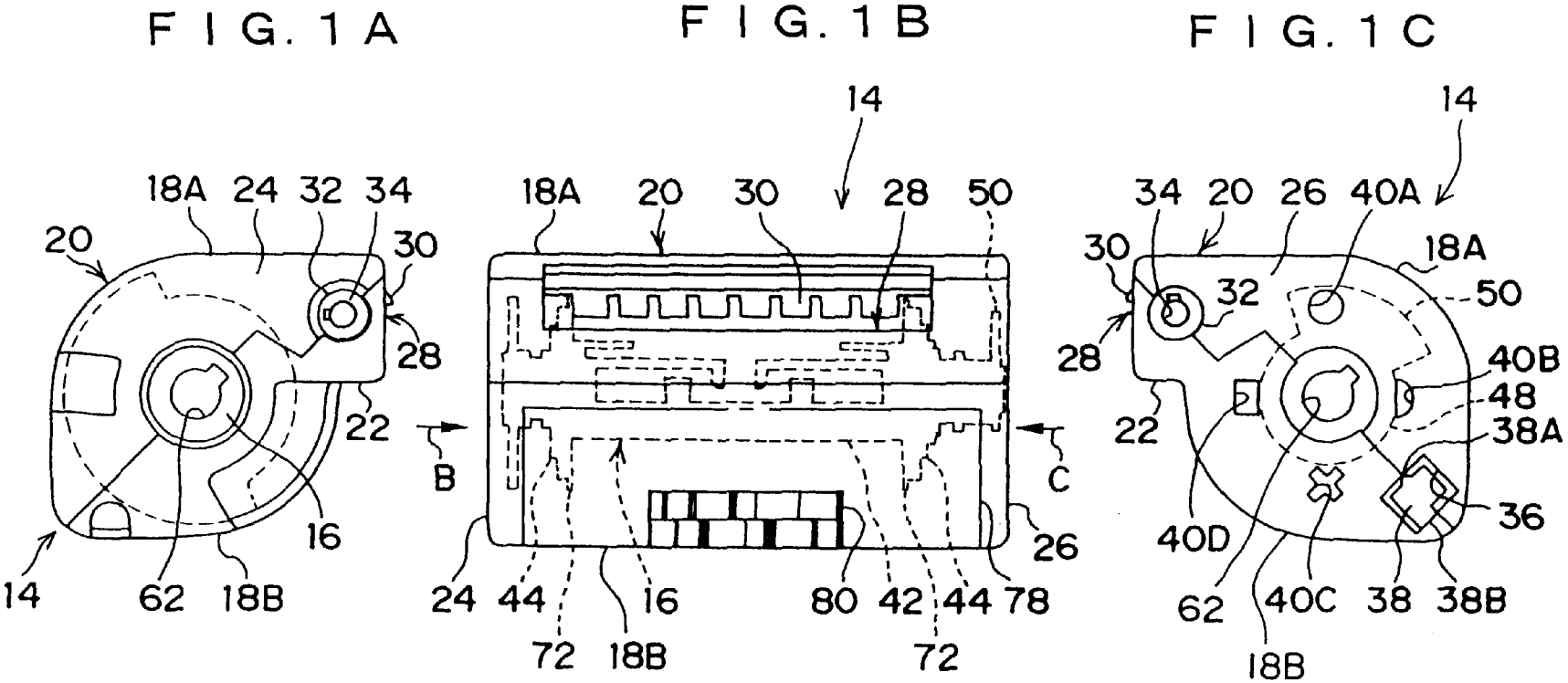
FIG. 1A is a left side view of a cartridge.
FIG. 1B is a front view of the cartridge.
FIG. 1C is a right side view of the cartridge.
Figure 2:
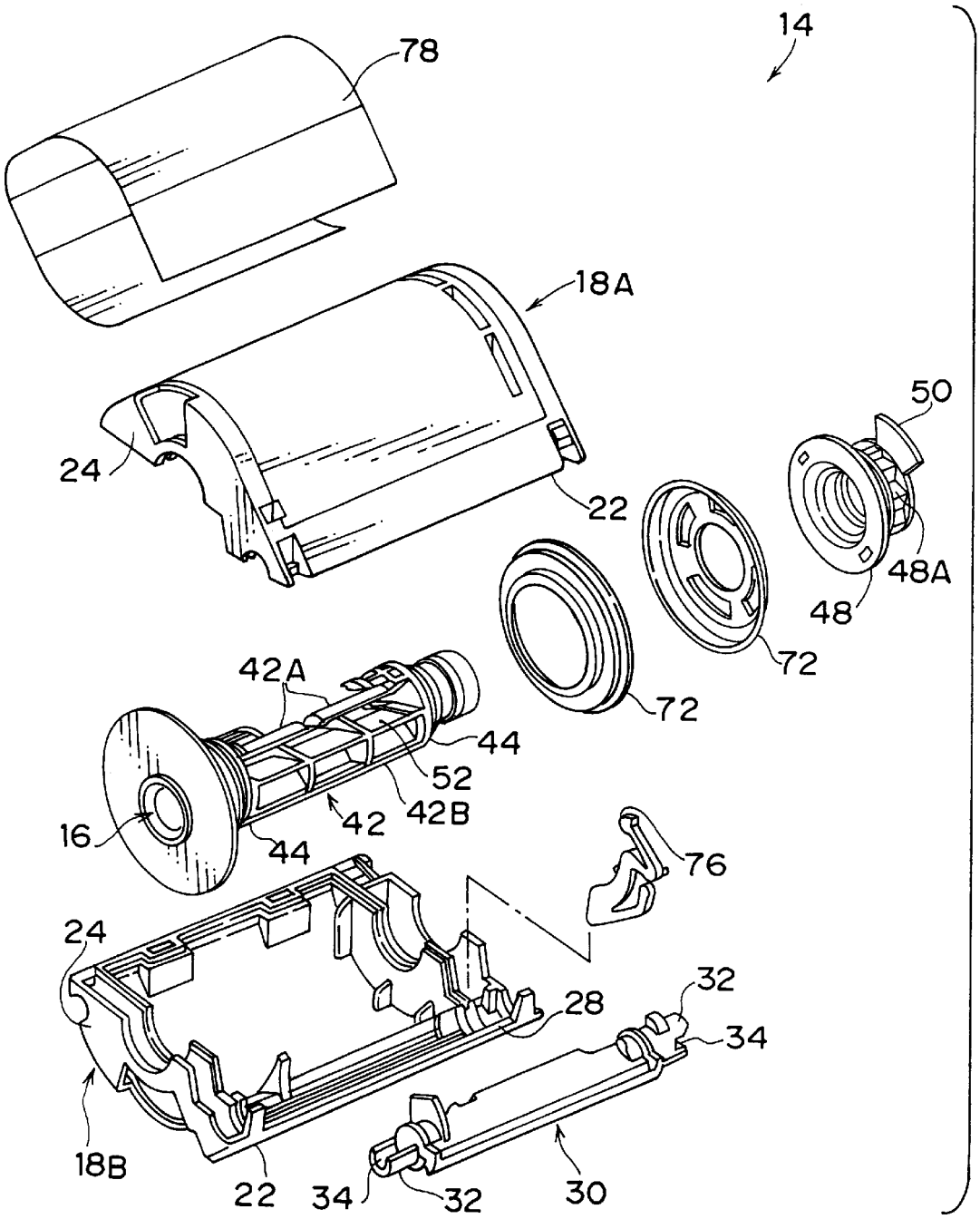
FIG. 2 is an exploded perspective view of the cartridge.

As illustrated in FIGS. 1A through 1C and in FIG. 2, a cartridge 14 is provided with a casing 20 formed in a substantially cylindrical configuration by covers 18A, 18B being superposed together. The casing 20 is provided with a projecting portion 22 which projects in a tangential direction. A slit-shaped insertion opening 28, which runs along the axial direction of the casing 20, is formed in the distal end of the projecting portion 22. The insertion opening 28 is usually closed by a door 30 so that the interior of the casing 20 is shaded from light. A spool shaft 16 within the casing 20 is rotatably supported by side walls 24, 26 which close the axial direction ends of the casing 20.

As shown in FIGS. 1B, 1C and 2, a door shaft 32 is suspended the side walls 24, 26 so as to be rotatably supported at the projecting portion 22. The door shaft 32 rotates integrally with the door 30. The insertion opening 28 is opened and closed by the door 30 rotating together with the door shaft 32. Key holes 34 for engaging with a means for rotating the door shaft 32 (a door driver 158 which will be described later) are formed in the distal ends of the door shaft 32 which are exposed at the side walls 24, 26.

The casing 20 is divided into the covers 18A, 18B along a line which connects the positions at which the door shaft 32 and the spool shaft 16 are supported at the side walls 24, 26 and the end portion at the opposite side of the projecting portion 22.

As shown in FIG. 1C, a notch hole 36 is formed, by cut-outs formed in the covers 18A, 18B, in the side wall 26 of the casing 20 at the end portion opposite the projecting portion 22. A display plate 38 which covers the notch hole 36 extends from the cover 18B. The side of the display plate 38 at the casing 20 axis side is joined by a thin connecting portion 38A, whereas the outer peripheral portion side of the display plate 38 is joined by a thick connecting portion 38B.

When a film F for which developing processing has been completed is accommodated in the cartridge 14, the connecting portion 38A side of the display plate 38 is cut away, and the display plate 38 is pushed in toward the interior of the notch hole 36 and folded over. In this way, it can be determined from the exterior of the casing 20 whether the film F within the cartridge 14 is a film for which developing has been completed or is a film which has not yet undergone developing processing.

Display holes 40A, 40B, 40C, 40D are formed at equal intervals in the side wall 26 at the periphery of the spool shaft 16. (Hereinafter, when the display holes 40A, 40B, 40C, 40D are referred to collectively, they will be referred to merely as "the display holes 40".) The display holes 40 are used to display the state of the film F accommodated in the cartridge 14. For example, the circular display hole 40A shows that the film F is unexposed, the semi-circular display hole 40B shows that the film F is partially exposed, the X-shaped display hole 40C shows that the film F has been exposed but not developed, and the rectangular display hole 40D shows that the film F has been developed. In this way, the exposed state and the processed state of film F accommodated in the cartridge 14 can be determined.

Figure 3A:
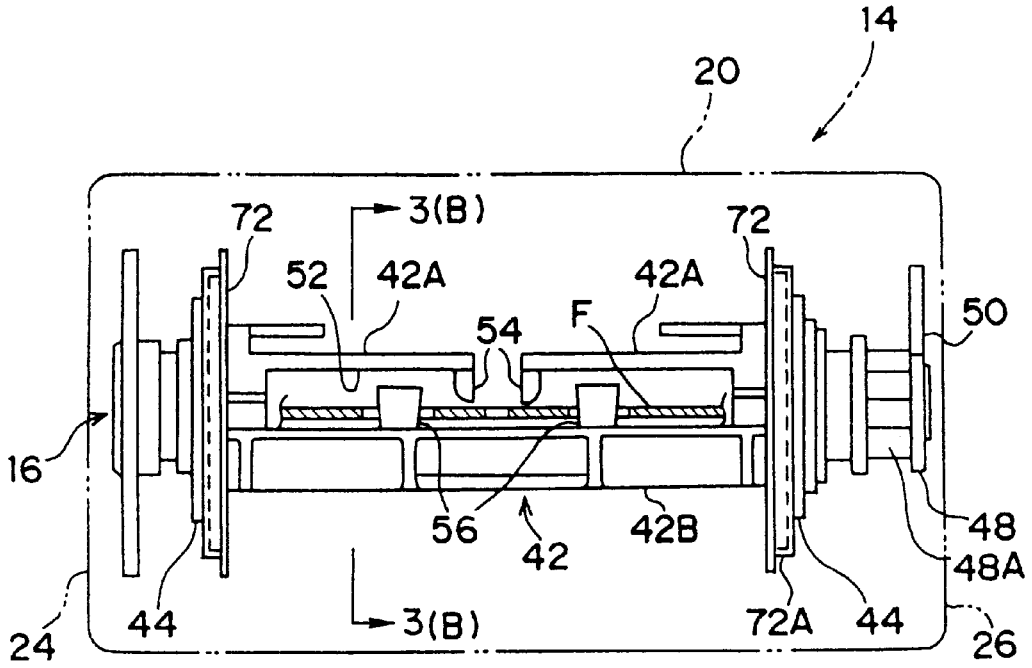
FIG. 3A is a front view of a spool shaft.
Figure 3B:
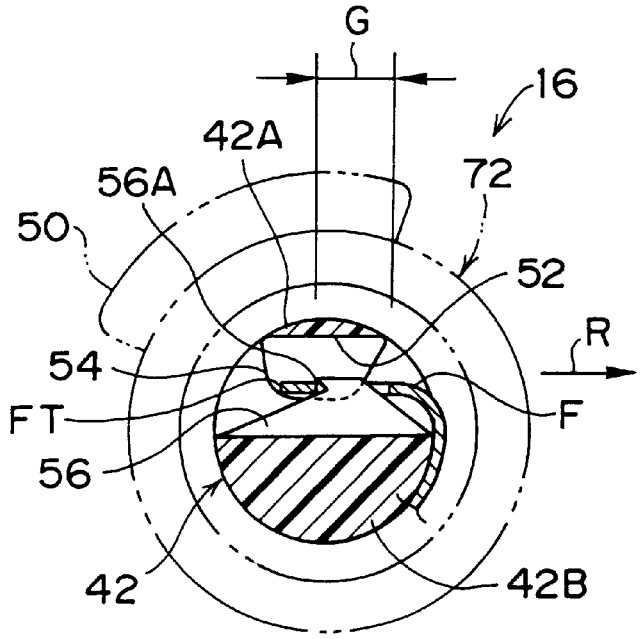
FIG. 3B is a cross-section of the spool shaft illustrated in FIG. 3A taken along line 3(B)—3(B) of FIG. 3A.

The spool shaft 16 disposed within the casing 20 is illustrated in FIGS. 3A and 3B. The axial direction intermediate portion of the spool shaft 16 is a winding portion 42 for winding the film F. (The axial direction is the direction to the left and right in FIG. 3A.) A flange portion 44 is formed at each side of the winding portion 42.

As illustrated in FIG. 3A, a flexible flange 72 formed of a thin, elastically deformable resin is mounted to the flange portion 44.

A small diameter ring 48 is mounted to the end portion of the spool shaft 16 which end portion is at the side near the side wall 26 of the casing 20. As shown in FIGS. 1C and 3B, a white plate 50, which projects a predetermined width toward the outer side in the radial direction, is provided integrally with the ring 48. As shown in FIG. 1C, the white plate 50 is superposed with one of the display holes 40 in accordance with the rotational position of the white plate 50 around the spool shaft 16, such that a white portion is exposed in the display hole 40 with which the white plate 50 is superposed. The processed state of the film F within the cartridge 14 is known by the position at which the white plate 50 is exposed to the exterior.

As shown in FIG. 2, a gear portion 48A is formed at the ring 48. When the door 30 is closed, a spool lock 76 which is mounted to the cover 18B meshes with the gear portion 48A, and the spool shaft 16 does not rotate at torque of a predetermined amount or less. On the other hand, when the door 30 is opened, the spool lock 76 is separated from the gear portion 48A, and the spool shaft 16 can rotate smoothly.

As illustrated in FIGS. 3A and 3B, a cut-out portion 52 running along the axial direction is formed in the winding portion 42 of the spool shaft 16. The winding portion 42 is divided by the cut-out portion 52 into a broad winding portion main body 42B and a narrow engaging portion 42A. Presser portions 54 are formed at the engaging portion 42A. The respective distal ends of the presser portions 54, which are separated at the longitudinal direction intermediate portion of the engaging portion 42A, project toward the winding portion main body 42B in directions of narrowing the open width of the cut-out portion 52.

A pair of projecting portions 56 are formed at the winding portion main body 42B. The projecting portions 56 project in directions of narrowing the open width of the cut-out portion 52 at axial direction outer sides of the presser portions 54. When viewed along the axial direction of the spool shaft 16, the projecting portions 56 are superposed with the presser portions 54.

Figure 4:
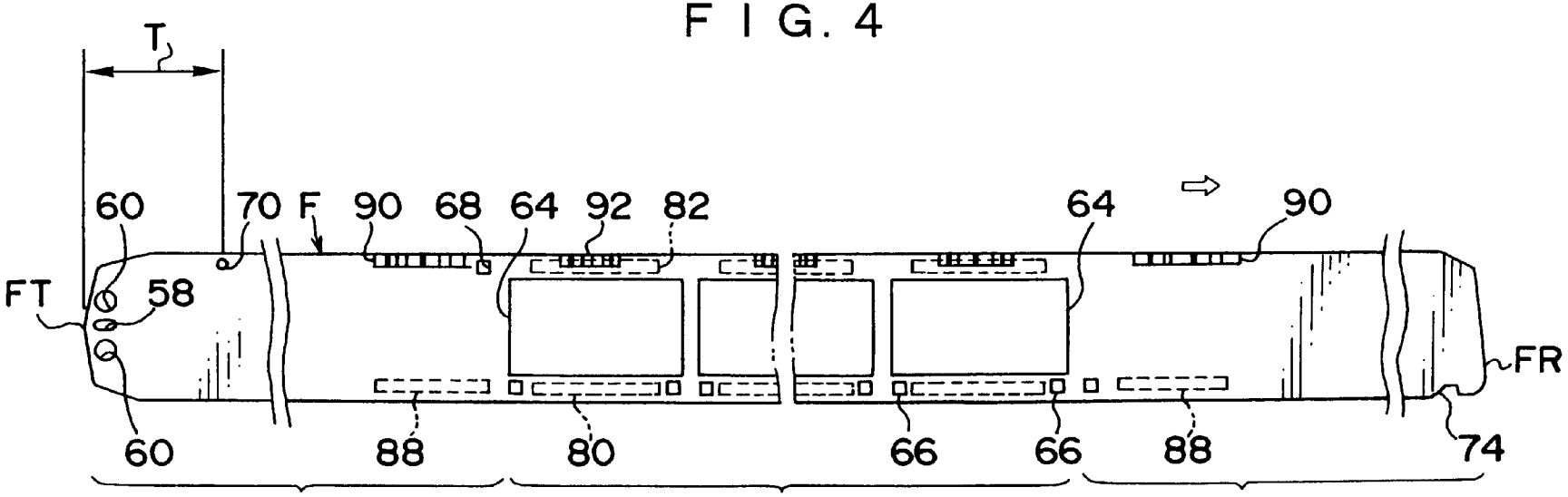
FIG. 4 is a plan view of a film.

As shown in FIG. 1B and FIG. 2, a label 78 is adhered to the outer peripheral surface of the casing 20. As shown in FIG. 1B, a bar code 80, which contains various types of information such as a cartridge identification number for identifying the cartridge 14, the film type, the number of exposures (the number of frames), and the like, is printed in two stages on the label 78 at the cover 18B side. (Note that, herein, "ID" is used as an abbreviation for "identification".) As shown in FIG. 4, an elongated hole 58 is formed in the transverse direction central portion of the trailer side end portion FT of the film F. The elongated hole 58 is used for the hooking of a claw portion (not shown) of an attach plate which is used when the film F is to be anchored to the spool shaft 16.

An engaging hole 60 is formed at each transverse direction side of the elongated hole 58. When the trailer side end portion FT of the film F is inserted into the cut-out portion 52 of the spool shaft 16, as illustrated in FIGS. 3A and 3B, the projecting portions 56 enter into the engaging holes 60. At this time, the portion of the film F between the engaging holes 60 abuts the presser portions 54 so as to keep the projecting portions 56 from coming out of the engaging holes 60 and engage the trailer side end portion FT of the film F to the spool shaft 16.

As illustrated in FIG. 3B, a distal end 56A of the projecting portion 56 is shaped so as to project in the direction opposite to the pulling out direction of the film F (the direction of arrow R is the pulling out direction of the film F), so as to prevent the film F from coming out.

With the trailer side end portion FT of the film F engaged with the spool shaft 16 as described above, the film F is wound up onto the spool shaft 16 and accommodated within the cartridge 14.

As illustrated in FIGS. 1A and 1C, at the cartridge 14, key holes 62 are formed in the end surfaces of the spool shaft 16 which are exposed at the side walls 24, 26. When the key holes 62 are engaged, rotational force can be transmitted to the spool shaft 16.

As illustrated in FIG. 4, perforations 66 which show the positions of image frames 64 are formed at predetermined intervals in one transverse direction end portion of the film F. The perforations 66 are used to position the image frames 64 when image exposure or a printing operation is to be carried out.

An around perforation 68 is formed at the end portion FT side of the final image frame 64 in the transverse direction end portion of the film F opposite the end portion in which the perforations 66 are formed. The around perforation 68 shows that images are not recorded or are not to be recorded at positions further toward the trailer side end portion than the position at which the around perforation 68 is formed.

A detach perforation 70 is formed in a position of the film F which is separated from the trailer side end portion FT by a predetermined interval T. When the detach perforation 70 is detected, the position of the trailer side end portion FT of the film F can be accurately determined. Both transverse direction edges of the trailer side end portion FT of the film F are slanted in order to facilitate insertion into the cut-out portion 52 of the spool shaft 16.

A transparent magnetic recording layer is provided on the film F. Regions at both transverse direction end portions of the film F and at the outer sides of the image frames 64 are used as magnetic tracks.

Magnetic tracks 80 for the facility which carries out developing processing of the film are provided at the transverse direction end portion of the film F in which the perforations 66 are formed. Magnetic tracks 82 for the camera are provided at the transverse direction end portion of the film F opposite the end portion in which the perforations 66 are formed.

A magnetic track 88, on which a film identification mark for identifying the film F is recorded, is provided at the end portion FT side of the perforation 66 of the image frame 64 at the end portion FT side, and at the end portion FR side of the perforation 66 of the image frame 64 at the end portion FR side. A bar code 90 is provided at the side of the film F opposite the magnetic track 88. The bar code 90 includes a film identification mark for identifying the film F. The bar code 90 is formed as a latent image in advance during production of the film F, and is developed by developing processing. The bar codes 90 of the film F correspond to the bar code 80 of the cartridge 14.

Bar codes 92 are recorded on the film F at the same positions as the magnetic tracks 82. The bar code 92 expresses the frame number of the image frame 64, the manufacturer of the film, the type of film, and the like. The bar code 92 is formed as a latent image in advance during production of the film F, and is developed by developing processing.

(Printer Processor)

Figure 5:
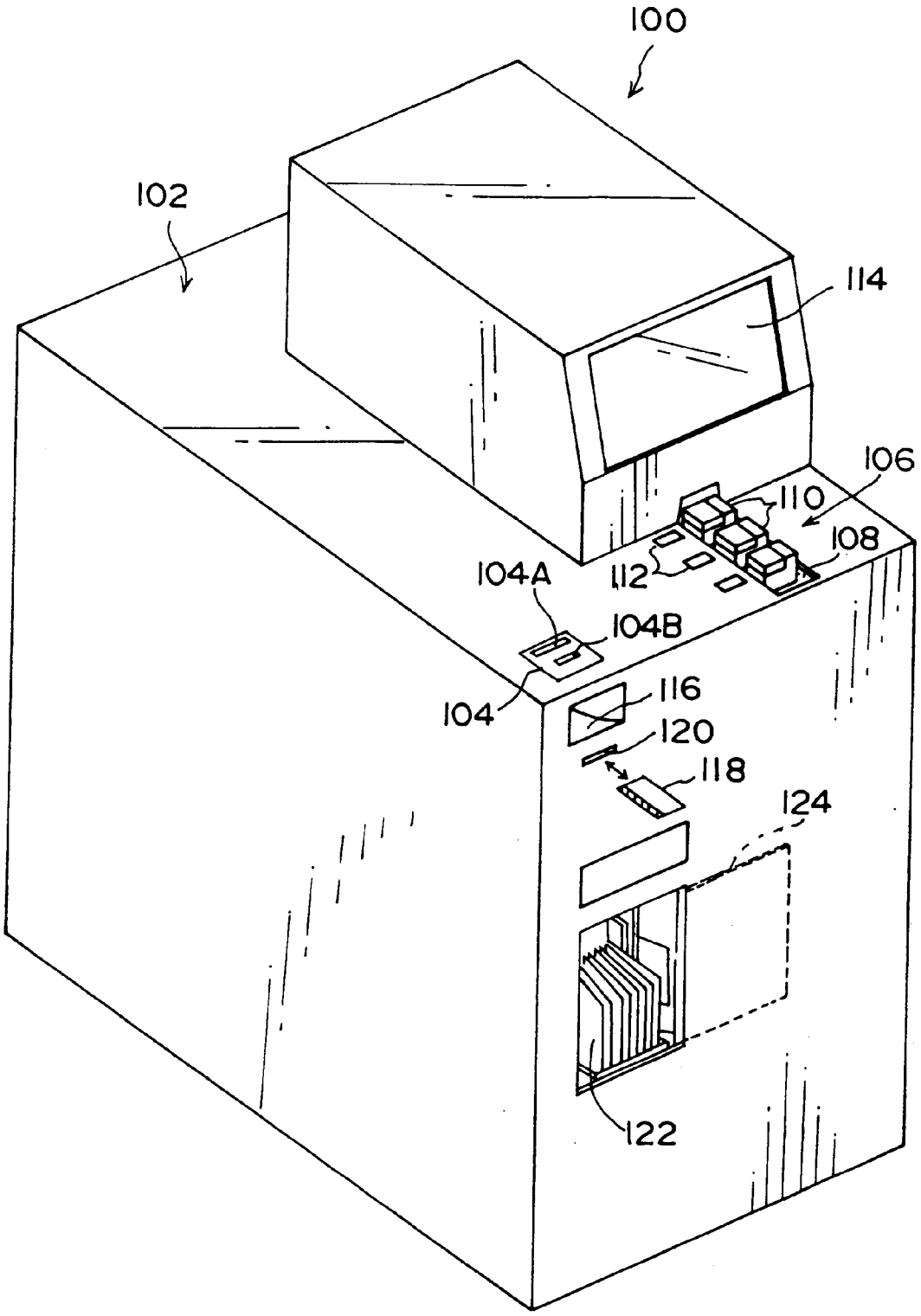
FIG. 5 is an overall perspective view of a printer processor.

As illustrated in FIG. 5, a printer processor 100, which carries out developing processing of the film F and printing, is provided with a box-shaped casing 102 for shading the interior of the printer processor 100.

A payment insertion portion 104, into which payment for developing and prints is inserted, is provided at the front left portion of the upper surface of the casing 102 in FIG. 5. The payment insertion portion 104 includes a slit-shaped bill insertion opening 104A for the insertion of bills and a slit-shaped change insertion opening 104B for the insertion of change.

A station standby section 106 is provided to the right of the payment insertion portion 104.

At the station standby section 106, a plurality of stations 110, which will be described later and in which cartridges 14 are loaded, are provided at an opening portion 108 of the casing 102, and standby.

Figure 7:
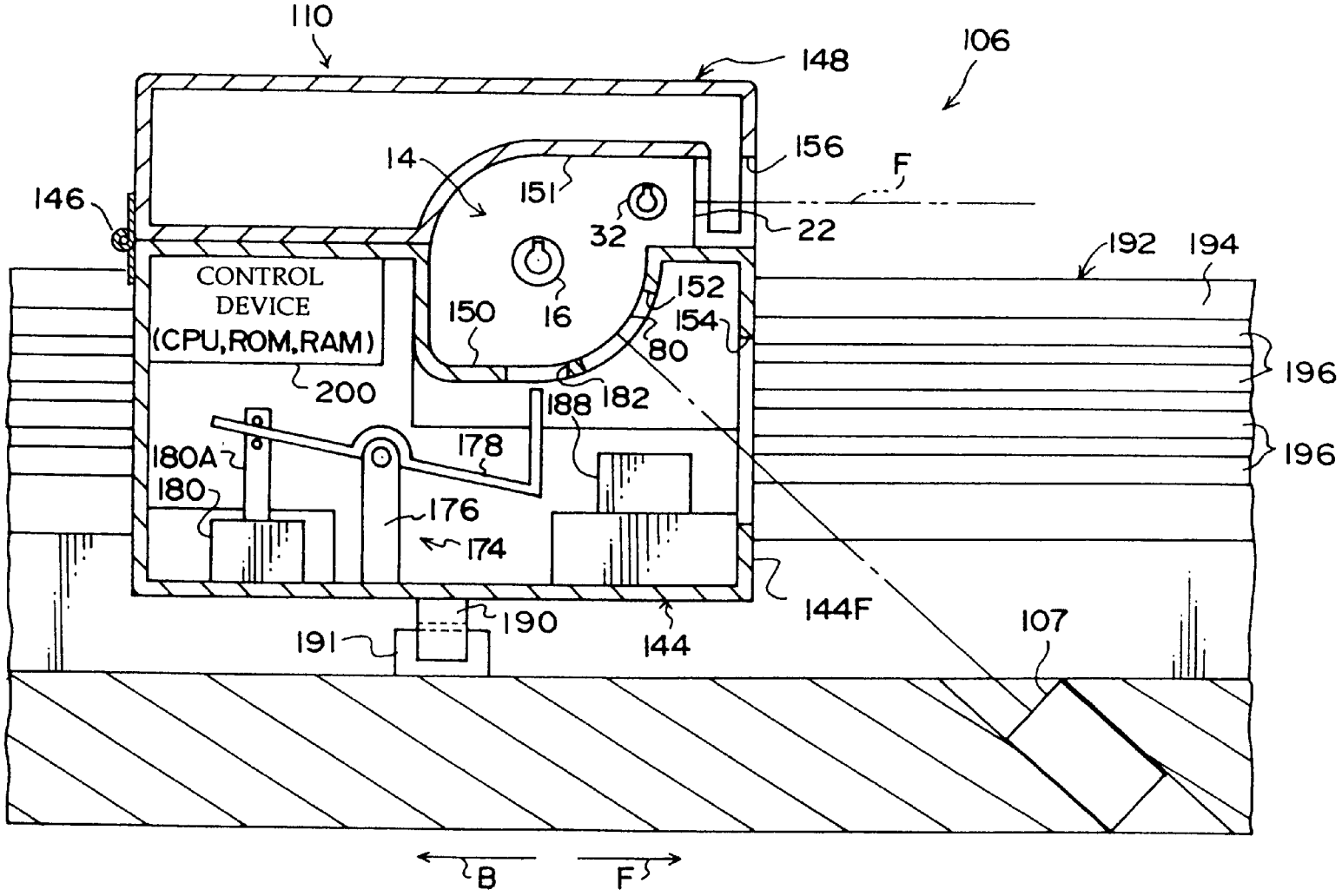
FIG. 7 is a cross-sectional view of a side surface side of a station.

As illustrated in FIG. 7, a plurality of bar code scanners 107 (only one is illustrated in FIG. 7) are provided at the station standby section 106 in correspondence with the stations 110 which are standing by. The bar code scanner 107 reads the bar code 80 of the cartridge 14. The information of the bar code 80 read by the bar code scanner 107 is sent to a main control device 202 which will be described later.

As shown in FIG. 5, a plurality of display devices 112 which display messages are provided at the top surface of the casing 102 next to the opening portion 108 in correspondence with the stations 110 which are standing by. A display device 114 which displays messages is provided above the opening portion 108.

A receiving plate 116, into which change and receipts are discharged, is provided at the lower side of the payment insertion portion 104 at the front surface of the casing 102.

A slit-shaped ID card entrance/exit opening 120, which an ID card 118 which will be described later is inserted into and discharged from, is provided at the lower side of the receiving plate 116.

An automatic door 124 for removing finished prints 122 and cartridges 14 from the interior, is provided at the lower side of the ID card entrance/exit opening 120.

Figure 6:
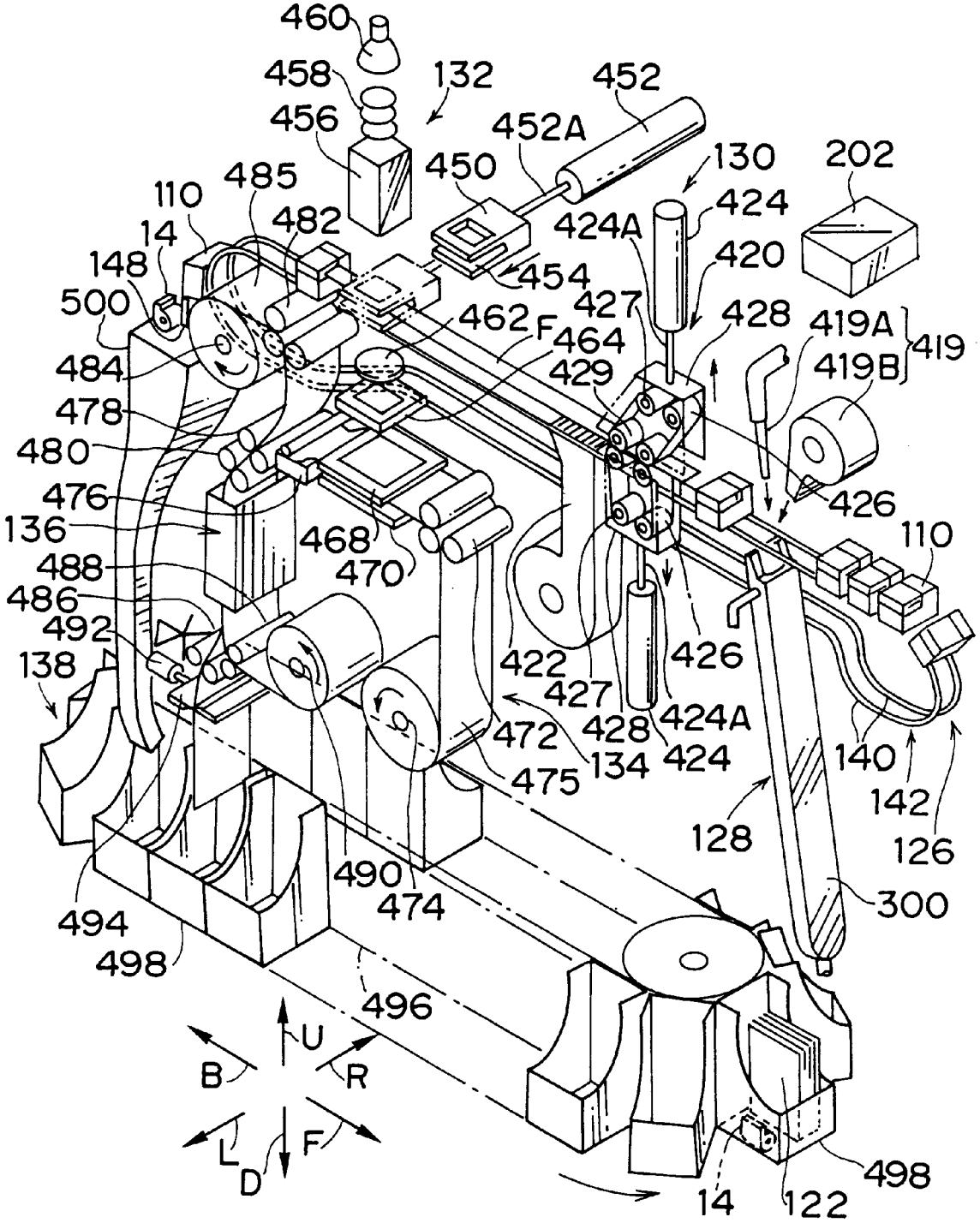
FIG. 6 is a perspective view illustrating a portion of the structure of the interior of the printer processor.

As shown in FIG. 6, a cartridge conveying device 126, a developing processing section 128, a drying section 130, an exposure section 132, a paper conveying device 134, a heat developing transfer section 136, and a print conveying device 138 are provided within the casing 102 (which is not illustrated in FIG. 6).

(Cartridge Conveying Device)

As illustrated in FIG. 6, the cartridge conveying device 126 includes an endless locus 142 which is formed by a pair of guide rails 140 which extend toward the rear of the printer processor 100 (i.e., in the direction of arrow B). The upper portion and the lower portion of the endless locus 142 extend linearly and horizontally, and the lower portion is offset by a predetermined dimension in the direction of arrow D with respect to the upper portion.

A plurality of stations 110 travel on the endless locus 142.

As shown in FIG. 7, the station 110 is box-shaped. A cover 148 is attached to a main body 144 of the station 110 via a hinge 146 so as to be able to be opened and closed.

A concave portion 150 into which the cartridge 14 is loaded is provided in the main body 144 in a vicinity of the center of the upper portion thereof. The concave portion 150 is shaped such that the lower portion of the cartridge 14, i.e., the portion downward of the bottom end of the projecting portion 22, is inserted into the concave portion 150.

A concave portion 151 is formed at the inner side of the cover 148 so as to correspond to the concave portion 150 of the main body 144. The concave portion 151 is shaped such that the upper portion of the cartridge 14, i.e., the portion upward of the bottom end of the projecting portion 22, is inserted into the concave portion 151. Therefore, the cover 148 is closed only when the cartridge 14 is inserted in a manner in which it is oriented properly. If the cartridge 14 is inserted in the wrong way, the cover 148 cannot be closed.

At the main body 144, an opening 152 is formed at the concave portion 150 and an opening 154 is formed at a side plate 144F of the main body 144 at the side in the direction of arrow F. In this way, the bar code 80 (see FIG. 1) of the accommodated cartridge 14 can be seen from the exterior.

A cut-out 156, which permits the insertion and removal of the film F from the accommodated cartridge 14, is provided in the arrow F direction side of the cover 148.

Figure 8:
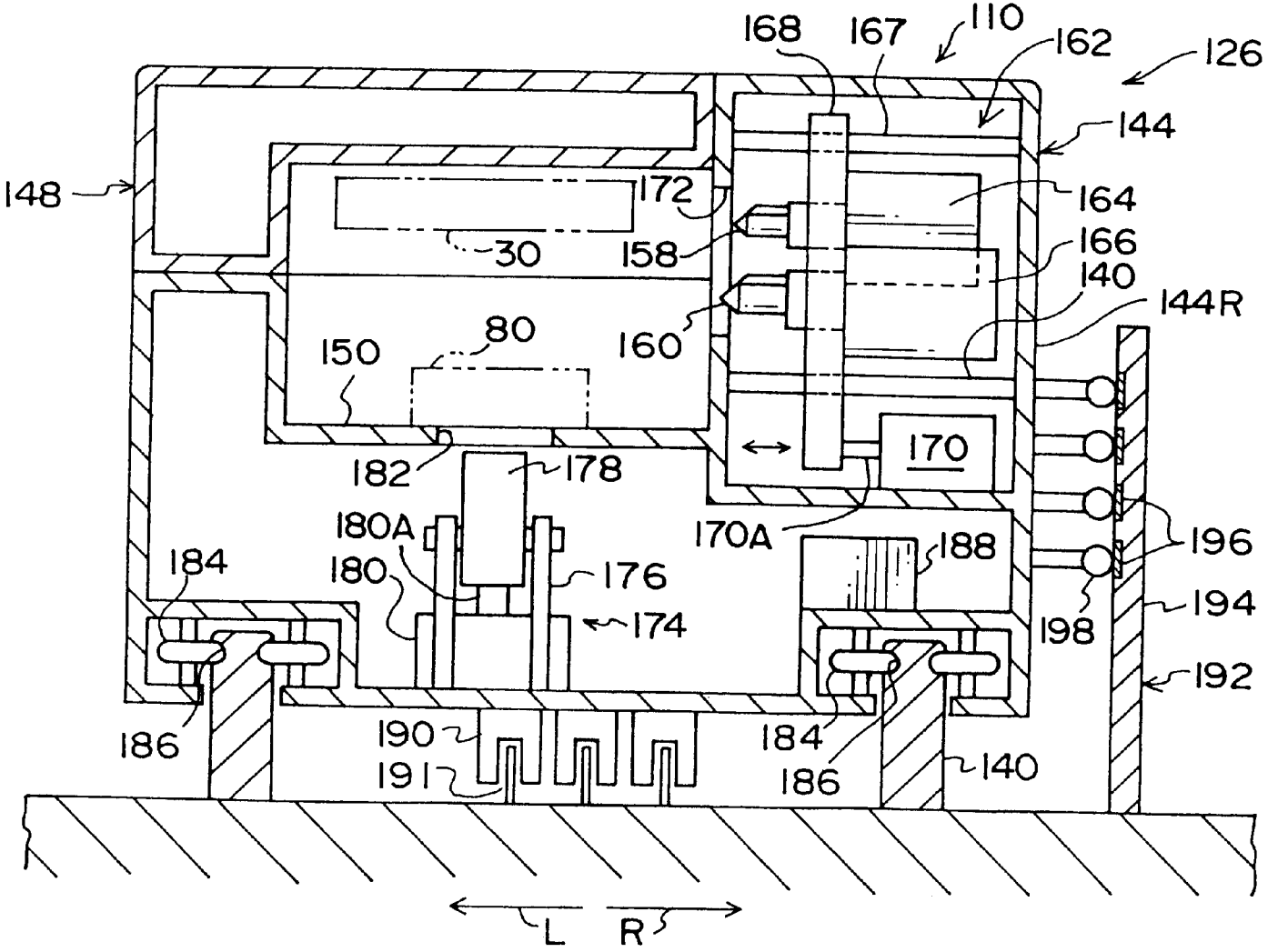
FIG. 8 is a cross-sectional view of a front surface side of the station.

As illustrated in FIG. 8, a catching device 162 is provided at the main body 144 at the arrow R direction side of the cover 148. The catching device 162 includes a door driver 158, which opens and closes the door 30 of the cartridge 14, and a spool driver 160, which rotates the spool shaft 16.

The door driver 158 and the spool driver 160 are rotated by a motor 164 and a motor 166, respectively. A key (projection) which engages with the key hole is formed in the axial side surface of the door driver 158 and the spool driver 160. The motor 164 and the motor 166 are attached to a slide block 168 which is supported so as to be movable along a pair of guide rails 167 mounted to the main body 144. The slide block 168 slides along the axial direction of the spool shaft 16.

A movable core 170A of a solenoid 170 mounted to the main body 144 is connected to the slide block 168. Usually, the door driver 158 and the spool driver 160 are withdrawn to positions at which they are separated from the cartridge 14 by predetermined dimensions as illustrated in FIG. 8.

When the solenoid 170 is energized, the movable core 170A moves a predetermined dimension toward the cartridge 14. The respective distal ends of the door driver 158 and the spool driver 160 project from an opening 172 of the main body 144. The door driver 158 engages with the key hole 34 of the door shaft 32, and the spool driver 160 engages with the key hole 62 of the spool shaft 16.

A push-out device 174, which pushes the cartridge 14 out from the concave portion 150, is provided at the inner side of the bottom portion of the main body 144.

As shown in FIGS. 7 and 8, the push-out device 174 has a lever 178 which is supported so as to be freely swingable by pillars 176 which are provided upright at the bottom surface. A movable core 180A of a solenoid 180 is connected to one end of the lever 178. When the movable core 180 moves downward, the other end of the lever 178 projects from a hole 182 formed in the bottom of the concave portion 150, and pushes the cartridge 14.

As shown in FIG. 8, the main body 144 includes a plurality of freely rotatable guide rollers 184. The guide rollers 184 engage with grooves 186 formed in the side surfaces of the guide rails 140 so as to nip the guide rails 140. One of the plurality of guide rollers 184 is driven by a motor 188. By rotating the motor 188, the station 110 can travel along the endless locus 142.

Three photointerrupters 190 are mounted to the outer side of the bottom portion of the main body 144.

A power source line 192, which sends control signals and power for driving to the stations 110, is disposed along the endless locus 142 at the cartridge conveying device 126. At the power source line 192, four conductors 196 are embedded at predetermined intervals in a plate-shaped member 194 formed from an insulator, such that two conductors 196 are used for signals and the other two conductors 196 are used for power.

Contacts 198 which always contact the conductors 196 are provided at the main body 144 of the station 110 at a side plate 144R opposing the conductors 196.

The contacts 198 are connected to an auxiliary control device 200 (see FIG. 7) provided within the main body 144. Via the conductors 196 and the contacts 198, the auxiliary control device 200 receives control signals from the main control device 202 (not shown in FIGS. 6 and 7) provided within the casing 102 of the printer processor 100. The identification number of the station 110 is stored in the memory of the auxiliary control device 200. The solenoid 170, the solenoid 180, the motor 164, the motor 166, and the motor 188 of the station 110 are controlled by the auxiliary control device 200.

The photointerrupters 190 are connected to the auxiliary control device 200, and are used to stop the station 110.

There are a plurality of places on the endless locus 142 where the stations 110 are stopped temporarily. A predetermined number of shutter plates 191, which cut off the light beams of the photointerrupters 190, are mounted at each of the stopping positions. The auxiliary control device 200 can distinguish between the plurality of stop positions of the stations 110 by detecting which photointerrupter's 190 light beams are cut off by the shutter plates 191.

(Developing Processing Section)

Figure 9:
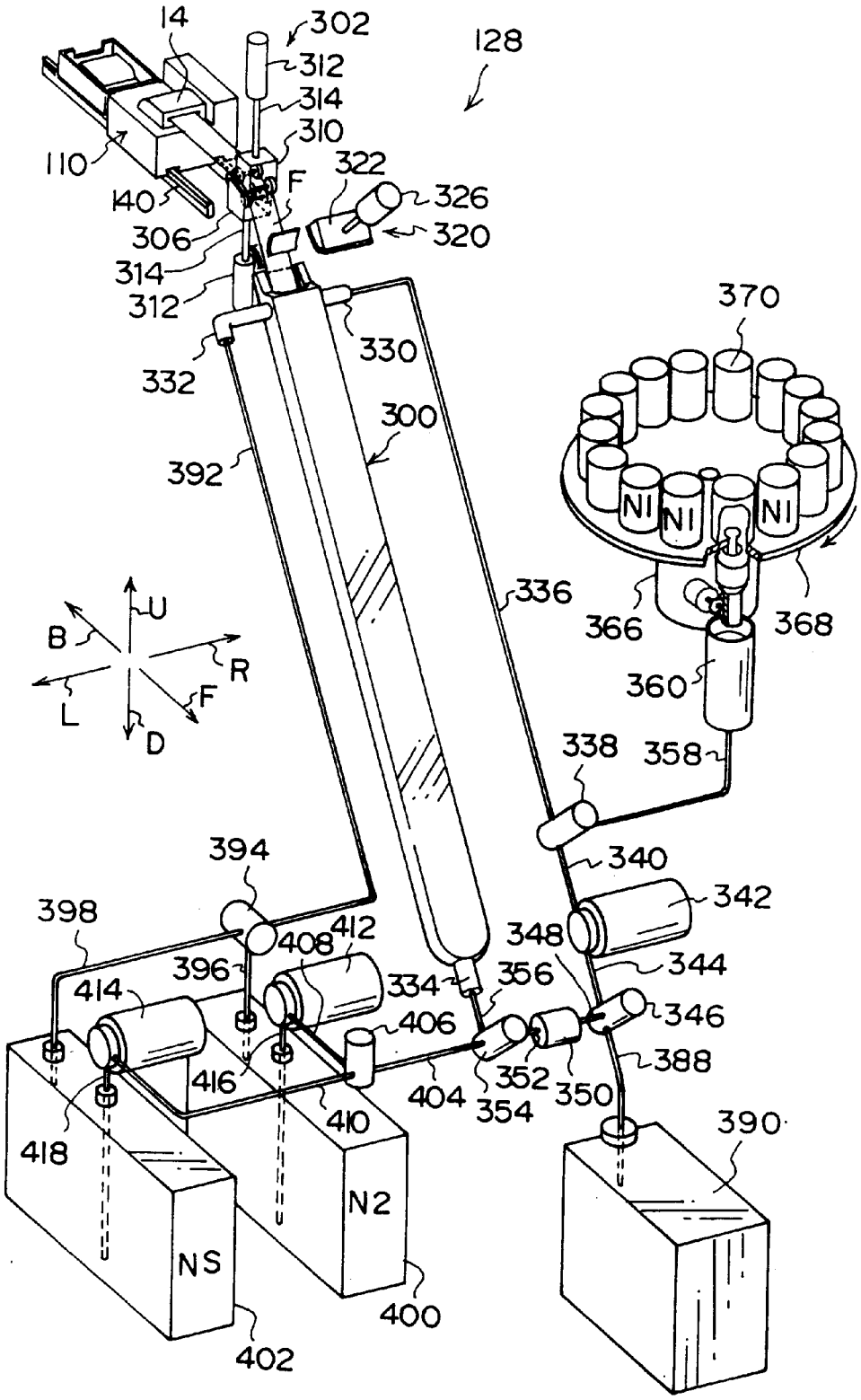
FIG. 9 is a perspective view of a developing processing section.

As illustrated in FIG. 9, the developing processing section 128 has a processing tank 300 which is formed of metal, a synthetic resin or the like and is shaped like the sheath of a sword.

The processing tank 300 is slightly tilted with respect to vertical directions (the direction of arrow U and the direction of arrow D), and the upper end thereof is open.

A movable film guide 302 is disposed at the arrow B direction side of the processing tank 300.

Figure 10:
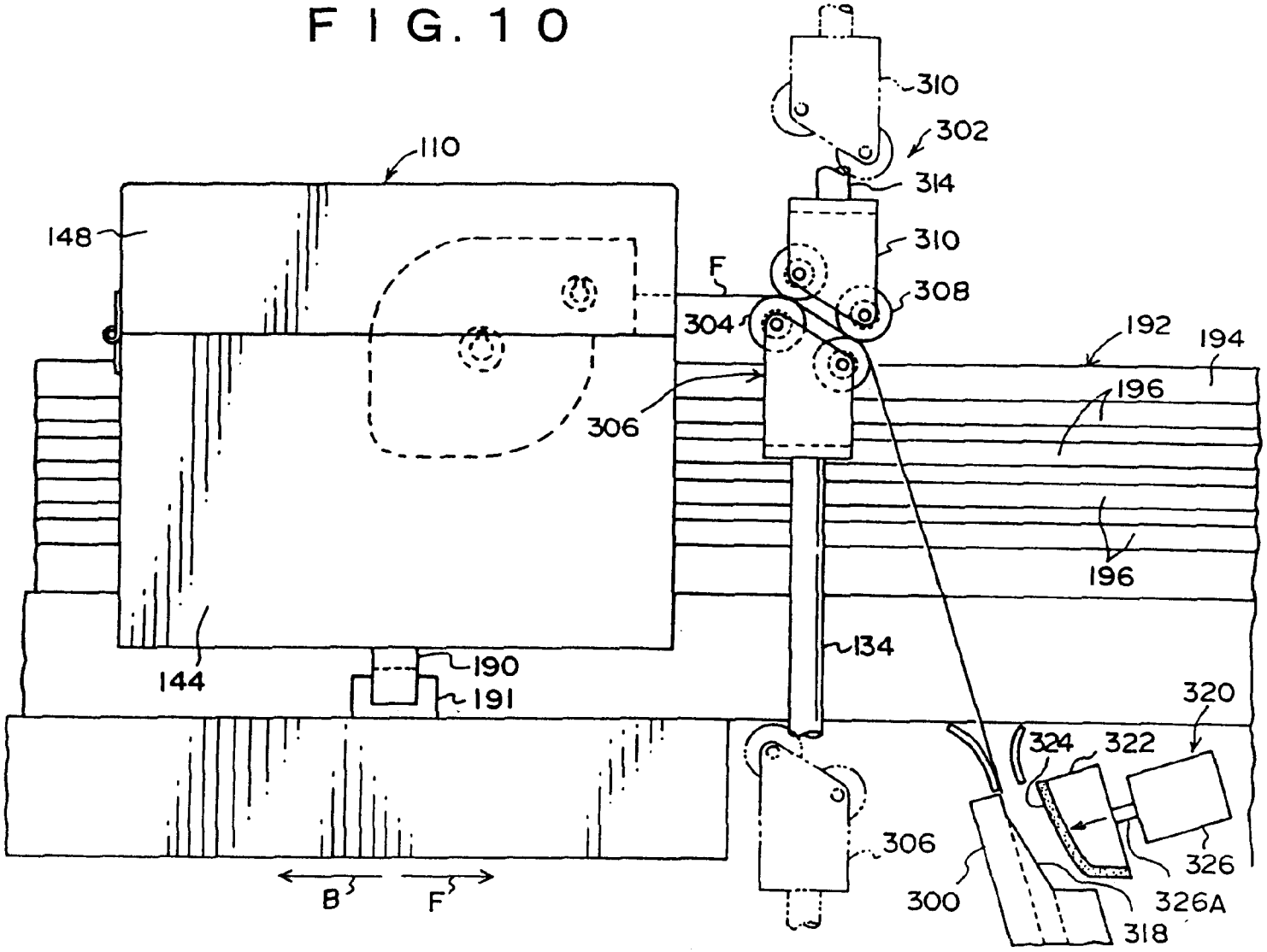
FIG. 10 is a side view of the station and a vicinity of a movable film guide.

As illustrated in FIGS. 9 and 10, the movable film guide 302 includes a lower guide 306 and an upper guide 310. The lower guide 306 includes a pair of rollers 304 which guide the bottom surface of the film F, and the upper guide 310 includes a pair of rollers 308 which guide the top surface of the film F. The lower guide 306 and the upper guide 310 are mounted to cylinder rods 314 of cylinders 312 disposed along the vertical direction.

As illustrated in FIG. 10, the rollers 304 and the rollers 308 nip the film F, which is fed out from the cartridge 14 in the horizontal direction, and guide the film F toward the opening portion of the processing tank 300.

When the stations 110 are to be moved, the cylinders 312 are operated, and the lower guide 306 and the upper guide 310 are withdrawn as illustrated by the imaginary lines in FIG. 10.

Figure 11:
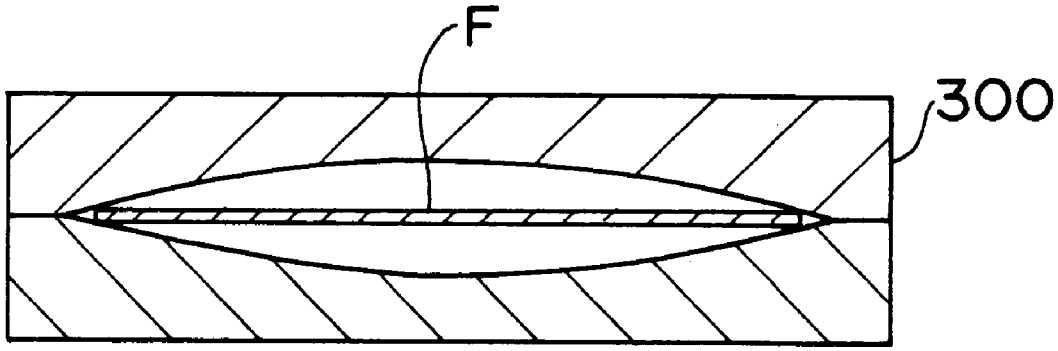
FIG. 11 is a sectional view orthogonal to a longitudinal direction of a processing tank.

The cross-sectional configuration of the inner portion (the interior) of the processing tank 300 in a direction orthogonal to the longitudinal direction thereof is illustrated in FIG. 11. The inner wall surfaces which oppose each other are curved such that the interval between the inner wall surfaces at the transverse direction sides (i.e., the portions opposing the transverse direction end portions of the film F) is narrow, and the interval between the inner wall surfaces at the transverse direction central portion (i.e., the portion opposing the image frames 64 of the film F) is wide.

Figure 12:
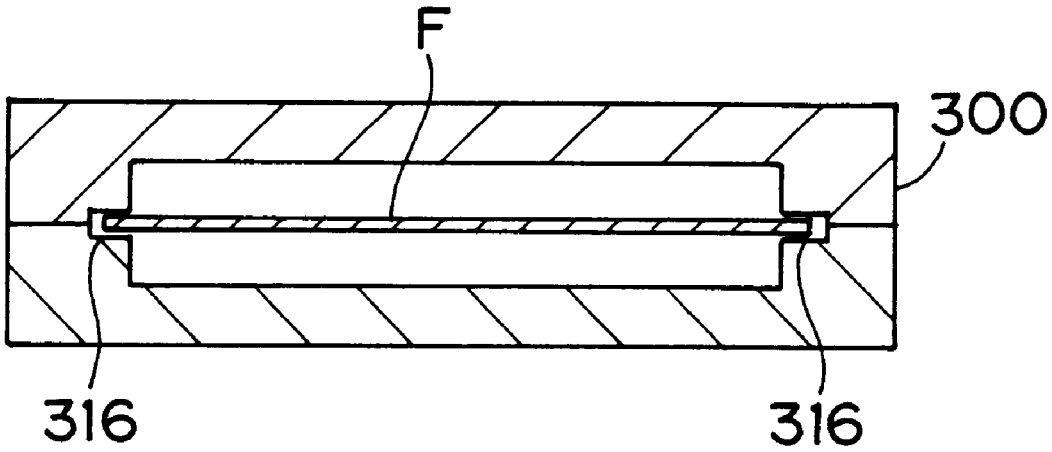
FIG. 12 is a sectional view orthogonal to a longitudinal direction of another embodiment of the processing tank.

As a result, when the film F is inserted from the opening, the transverse direction end portions of the film F are guided at the transverse direction side portions of the interior of the processing tank 300, whereas the transverse direction central portion of the film F, i.e., the image frames 64, is prevented from contacting the inner wall surfaces of the processing tank 300. As illustrated in FIG. 12, grooves 316 may be provided in the transverse direction side portions such that the film F is guided by the grooves 316. The inner wall surfaces may be parallel as long as they do not contact the image frame 64 portions.

(Tightly-Closing Device)

As illustrated in FIG. 10, a portion of the upper end of the processing tank 300 is cut out, and a tightly-closing device 320 is provided at a position opposing this cut-out portion 318.

The tightly-closing device 320 includes a block 322 which fits tightly to the cut-out portion 318. Thick packing 324, which is formed by an elastic body made of rubber or the like, is adhered to the portion of the block 322 which fits tightly to the cut-out portion 318.

Figure 13:
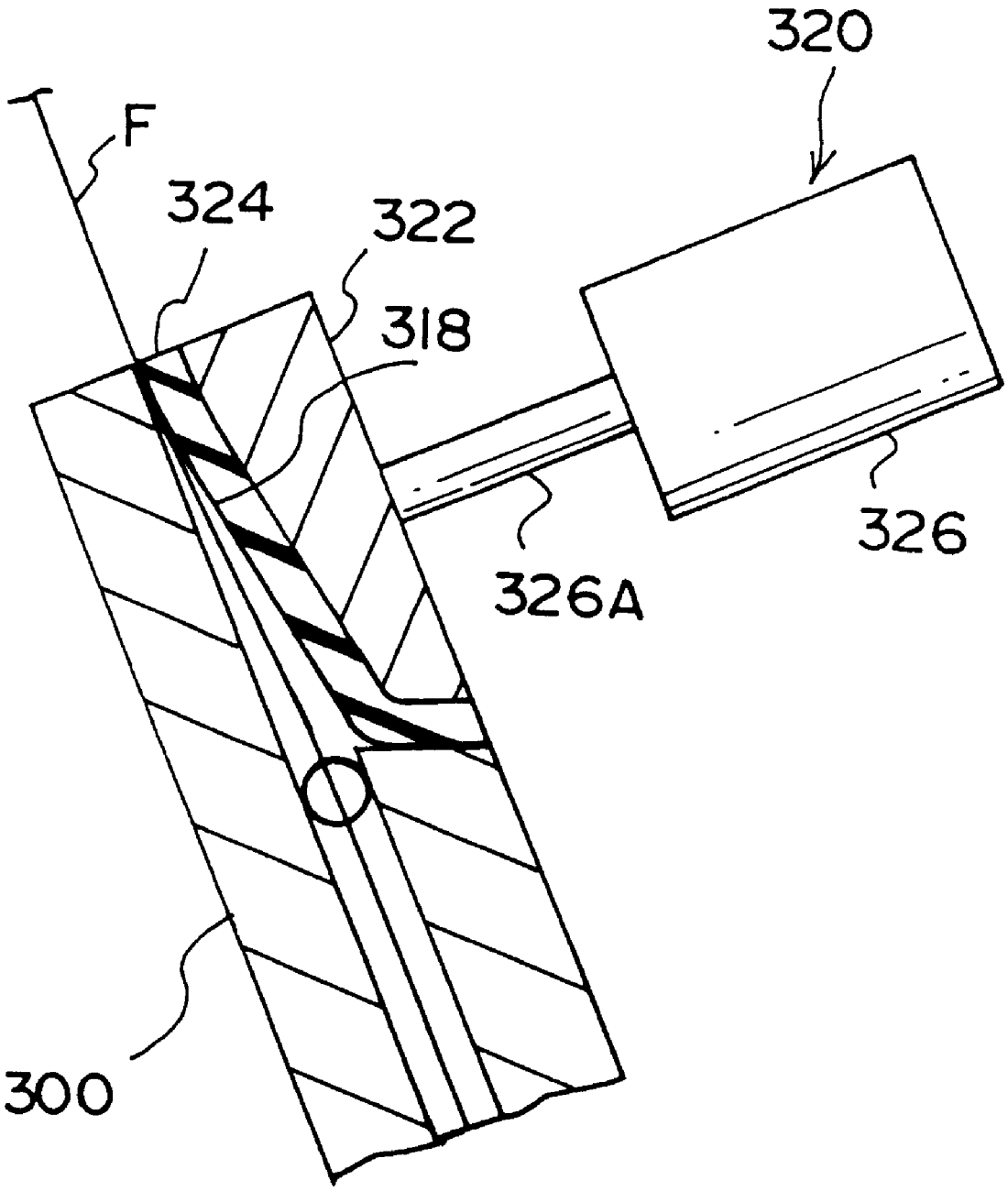
FIG. 13 is a cross-sectional view as seen from a side surface side of a processing tank which is tightly closed by a tightly-closing device.

The block 322 is connected to a movable core 326A of a solenoid 326. When the solenoid 326 is energized, as illustrated in FIG. 13, the movable core 326A pushes the block 322 against the cut-out portion 318 such that the interior of the processing tank 300 is tightly closed.

(Circulation Path of Processing Solution)

As illustrated in FIG. 9, a pipe-shaped connecting portion 330, which communicates with the interior of the tank at one transverse direction side thereof, is provided in a vicinity of the upper portion of the processing tank 300. In the same way, a pipe-shaped connecting portion 332, which communicates with the interior of the tank at the other transverse direction side thereof, is provided in a vicinity of the upper portion of the processing tank 300. Further, a pipe-shaped connecting portion 334, which communicates with the interior of the tank, is provided at the bottom end of the processing tank 30.

The connecting portion 330 is connected to the connecting portion 334 via a piping 336 which extends downwardly along the processing tank 300, an electromagnetic valve 338 (three-port, two-position switching valve), a piping 340, a pump 342, a piping 344, an electromagnetic valve 346 (three-port, two-position switching valve), a piping 348, an in-line ceramic heater 350, a piping 352, an electromagnetic valve 354 (three-port, two-position switching valve), and a piping 356.

One end of the piping 358 is connected to the electromagnetic valve 338, whereas the other end of the piping 358 is connected to a reducer 360.

Figure 14:
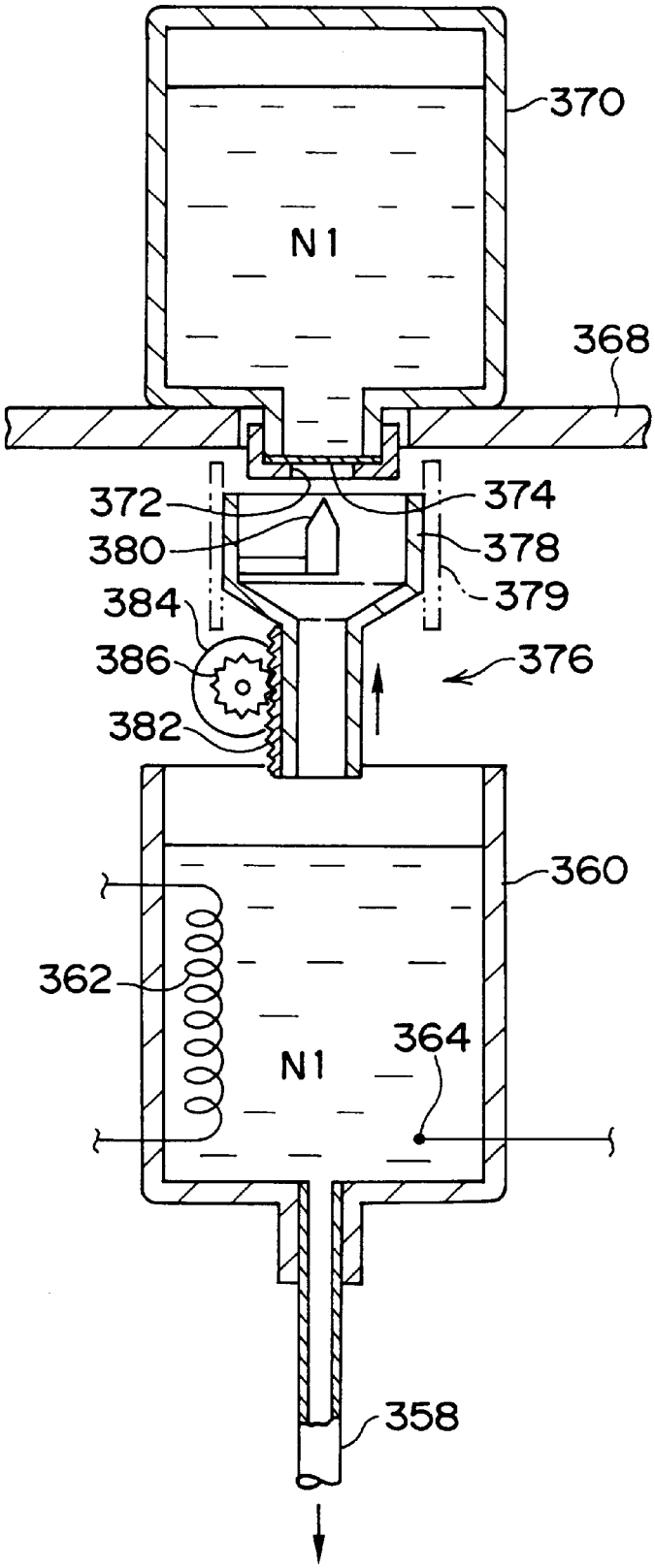
FIG. 14 is a cross-sectional view of a hole-forming device.

As illustrated in FIG. 14, the reducer 360 is a cup-shaped tank of a predetermined volume. (In the present first embodiment, the volume of the reducer 360 is a volume which allows temporary storage of color developing solution sufficient for developing processing of one film F. The reducer 360 includes a heater 362, which heats the color developing solution stored in the reducer 360 to a predetermined temperature, and a temperature sensor 364. The heater 362 and the temperature sensor 364 are connected to the main control device 202 (not shown in FIG. 14).

As shown in FIG. 9, a turntable 368, which is disc-shaped and is rotated by a motor 366, is disposed above the reducer 360. A plurality of inverted bottles 370 are loaded at the turntable 368 along the peripheral direction thereof.

As illustrated in FIG. 14, the bottle 370 contains an amount of color developing solution sufficient for the developing processing of one film F. An opening 372 of the bottle 370 is sealed by a thin film 374. The color developing solution can be removed by breaking the film 374.

A hole forming device 376 is disposed between the reducer 360 and the turntable 368. The hole forming device 376 includes a funnel 378. A projection 380, which forms a hole in the film 374 of the bottle 370, is attached to the central portion of the funnel 378.

The funnel 378 is supported so as to be slidable upward and downward by a guide member 379 which is fixed to an unillustrated frame. A rack 382 is formed at the side surface of the funnel 378. A gear 386 rotated by a motor 384 meshes with the rack 382.

Here, when the gear 386 is rotated and the funnel 378 is moved upward by a predetermined dimension, the projection 380 forms a hole in the film 374, and the color developing solution stored in the bottle 370 is discharged to the reducer 360 via the funnel 378. The motor 366 and the motor 384 are controlled by the main control device 202 (not illustrated in FIG. 14).

As shown in FIG. 9, one end of the piping 388 is connected to the electromagnetic valve 346, whereas the other end of the piping 388 is inserted into a waste liquid tank 390 which stores color developing solution which has been used.

One end of a piping 392, which extends downward along the processing tank 300, is connected to the connecting portion 332, whereas the other end of the piping 392 is connected to an electromagnetic valve 394 (three-port, two position switching valve).

One end of a piping 396 and one end of a piping 398 are connected to the electromagnetic valve 394. The other end of the piping 396 is inserted into a bleaching/fixing solution tank 400 which stores bleaching/fixing solution. The other end of the piping 398 is inserted into a rinse solution tank 402 which stores rinse solution.

One end of a piping 404 is connected to the electromagnetic valve 354, whereas the other end of the piping 404 is connected to an electromagnetic valve 406 (three-port, two-position switching valve).

One end of a piping 408 and one end of a piping 410 are connected to the electromagnetic valve 406. The other end of the piping 408 is connected to one connection opening of a pump 412, and the other end of the piping 410 is connected to one connection opening of a pump 414.

A piping 416, which sucks bleaching/fixing solution of the bleaching/fixing solution tank 400, is connected to the other connection opening of the pump 412. A piping 418, which sucks rinse solution of the rinse solution tank 402, is connected to the other connection opening of the pump 414.

As illustrated in FIG. 6, a processing tank drying device 419, which is formed from a nozzle 419A and a blower 419B, is disposed above the processing tank 300. The nozzle 419A jets out compressed air toward the interior of the processing tank 300. The blower 419B similarly blows warm air toward the interior of the processing tank 300.

(Drying Section)

As illustrated in FIG. 6, the drying section 130, which dries films F which have been subjected to developing processing, is provided at the arrow B direction side of the processing tank 300. The drying section 130 is formed from a water absorbing device 420 and a drying fan 422.

The water absorbing device 420 includes cylinders 424 which are disposed above and beneath the conveying route of the film F, such that the conveying route of the film F is interposed between the cylinders 424. A holder 428, which supports a water absorbing paper 426 in roll-form, is mounted to a cylinder rod 424A of the cylinder 424. A pair of rollers 429, around which the water absorbing paper 426 is entrained, is provided at the film F conveying route side of the holder 428. When a station 110 in which a cartridge 14 is loaded moves in the direction of arrow B, the water absorbing paper 426 absorbs the moisture which has adhered to the withdrawn film F while the water absorbing paper 426 is wound onto a winding shaft 427 which is rotated by an unillustrated motor.

The drying fan 422 is disposed at the arrow B direction side of the water absorbing device 420. The drying fan 422 blows drying air (warm air) toward the film F so as to dry the film F.

(Exposure Section)

An exposure section 132 is disposed at the arrow B direction side of the drying section 130.

The exposure section 132 includes a negative carrier 450 which holds the film F in a planar state. The negative carrier 450 is mounted to a cylinder rod 452A of a cylinder 452 disposed horizontally, and is thereby moved along the transverse direction of the film F. A slit 454 into which the film F enters is provided in a side surface of the negative carrier 450.

A mirror box 456, a CC filter 458 and a light source 460 are disposed in that order above the negative carrier 450. A lens 462, a black shutter 464, a paper mask 468 and a paper supporting stand 470 are disposed in that order under the negative carrier 450.

Nipping rollers 472 of the paper conveying device 134 are disposed at the arrow F direction side of the paper supporting stand 470. A supporting shaft 474 is disposed beneath the nipping rollers 472. A photosensitive material 475 is wound in roll form on the supporting shaft 474.

The nipping rollers 472 are rotated by an unillustrated motor so as to convey the photosensitive material 475 to the paper supporting stand 470.

A water applying section 476 which applies water to the photosensitive material 475, nipping rollers 478, nipping rollers 480, and the heat developing transfer section 136 are disposed at the photosensitive material 475 conveying direction downstream side of the paper supporting stand 470.

Nipping rollers 482 are disposed above the water applying section 476. A supporting shaft 484 is disposed at the arrow B direction side of the nipping rollers 482. An image-receiving material 485 is wound in roll form on the supporting shaft 484. The nipping rollers 482 are rotated by an unillustrated motor so as to convey the image-receiving material 485 toward the nipping rollers 478.

A dye fixing material having mordant has been applied to the image forming surface of the image-receiving material 485. The image-receiving material 485 conveyed toward the nipping rollers 478 is conveyed toward the photosensitive material 475 and to the heat developing transfer section 136 by the nipping rollers 478 and the nipping rollers 480.

(Heat Developing Transfer Section)

In the heat developing transfer section 136, the photosensitive material 475 and the image-receiving material 485 are conveyed while being nipped between a superposing roller and a heat roller (both unillustrated), and are heated to a predetermined temperature.

Nipping rollers 486, which convey the image-receiving material 485 downward (in the direction of arrow D), and nipping rollers 488, which convey the photosensitive material 475 in the direction of arrow F, are disposed beneath the heat developing transfer section 136. The nipping rollers 486, 488 are rotated by unillustrated motors.

The photosensitive material 475 which is conveyed in the direction of arrow F by the nipping rollers 488 is wound on a winding shaft 490 which is rotated by an unillustrated motor.

A cutter 494 which is driven by a cylinder 492 is disposed beneath the nipping rollers 486.

The print conveying device 138 which is driven by an unillustrated motor is disposed beneath the cutter 494.

A plurality of baskets 498 are attached to an endless belt 496 of the print conveying device 138. The arrow F direction side end portion of the print conveying device 138 is positioned at the inner side of the automatic door 124 (see FIG. 5).

Beneath the arrow B direction side end portion of the endless locus 142, the upper portion of a funnel-shaped duct 500 is open. Cartridges 14 falling down from the stations 110 which have been turned upside-down fall into a predetermined basket 498 via the duct 500.

(Operation)

Operation of the present first embodiment will now be described.

First, a customer loads a cartridge 14, in which an undeveloped film F is accommodated, into the concave portion 150 of an empty station 110, and closes the cover 148.

When the cartridge 14 is loaded, the bar code 80 of the cartridge 14 is read by the bar code scanner 107. The main control device 202 determines how many frames have been photographed, calculates the developing fee and the print fee, and displays the total fee on the display device 114.

The time required until the prints are finished (the wait time) or the time at which the prints will be finished is displayed on the display device 112 disposed at the side of the station 110 in which the cartridge 14 is loaded.

When the customer inserts into the payment insertion portion 104 the fee displayed on the display device 114, an ID card 118 is issued from the ID card entrance/exit opening 120. (Further, the customer's change comes out into the receiving plate 116.)

The order number, the time the order was placed, the time the prints will be finished, the identification number of the station 110 in which the cartridge 14 is loaded, the ID number of the cartridge 14, the number of frames which were photographed, and the like are recorded (by printing, magnetic recording or the like) on the ID card 118.

The station 110 in which the cartridge 14 is loaded moves from the opening portion 108 into the interior of the casing 102, and stops at a predetermined position of the developing processing section 128. When the station 110 is moved, the upper guide 310 and the lower guide 306 of the movable film guide 302 are withdrawn so as to be separated from each other so as to not abut the station 110.

When the station 110 stops, the catching device 162 is operated. The door driver 158 engages with the key hole 34 of the door shaft 32, and the spool driver 160 engages with the key hole 62 of the spool shaft 16.

The cylinders 312 are driven, and the lower guide 306 and the upper guide 310 approach each other such that the film F can be guided to the processing tank 300 by the rollers 304 and the rollers 308.

Next, at the station 110, after the motor 164 is driven and the door 30 is opened, the spool driver 160 is rotated, and the film F is fed out from the insertion opening 28 of the cartridge 14.

The film F which has been fed out from the cartridge 14 passes between the rollers 304 and the rollers 308 of the lower guide 306 and the upper guide 310, and is inserted into the processing tank 300 from the opening portion thereof. When the film F is inserted into the processing tank 300, the block 322 of the tightly-closing device 320 is separated from the cut-out portion 318 by a predetermined dimension. When insertion of the film F into the processing tank 300 has been completed, the block 322 pushes the cut-out portion 318 so that the interior of the processing tank 300 is sealed.

Next, developing processing of the film F will be described.

One bottle of color developing solution is placed in advance in the reducer 360, and is heated to a predetermined temperature (45° C. in the present first embodiment) by the heater 362.

When the interior of the processing tank 300 is tightly closed, the pump 342 is driven, and the color developing solution stored in the reducer 360 is supplied to the processing tank 300 via the piping 358, the electromagnetic valve 338, the piping 340, the pump 342, the piping 344, the electromagnetic valve 346, the piping 348, the in-line ceramic heater 350, the piping 352, the electromagnetic valve 354, and the piping 356.

When all of the color developing solution in the reducer 360 has been discharged, the electromagnetic valve 338 is switched over, and the color developing solution in the processing tank 300 is circulated via the piping 336, the electromagnetic valve 338, the piping 340, the pump 342, the piping 344, the electromagnetic valve 346, the piping 348, the in-line ceramic heater 350, the piping 352, the electromagnetic valve 354 and the piping 356. At this time, an electromagnetic valve 399 for discharge is opened and closed as needed in order to remove foam. In this way, color developing processing of the film F is carried out. The temperature of the color developing solution is maintained constant by the in-line ceramic heater 350 so that the temperature of the color developing solution does not drop while it is being circulated. Further, when the color developing solution is being circulated in the processing tank 300, the turntable 368 is rotated by a predetermined angle so that a new bottle 370 is positioned above the hole forming device 376. The hole forming device 376 is operated, and the color developing solution in the bottle 370 disposed above flows into the reducer 360. This color developing solution is used for the processing of the subsequent film F.

When a predetermined period of time has elapsed and developing processing of the film F is completed, the pump 342 is stopped, the electromagnetic valve 346 is switched-over, and the color developing solution in the tank and the pipings is discharged to the waste liquid tank 390 via the piping 388. At this time, the electromagnetic valve 399 for discharge is opened and closed as needed so that no solution remains.

When a predetermined period of time has elapsed and all of the color developing solution has been discharged, the electromagnetic valve 354 is switched over and the pump 412 is driven. The bleaching/fixing solution of the bleaching/fixing solution tank 400 is supplied to the processing tank 300 via the piping 416, the pump 412, the piping 408, the electromagnetic valve 406, the piping 404, the electromagnetic valve 354, and the piping 356. Further, the bleaching/fixing solution within the processing tank 300 is circulated and returned to the bleaching/fixing solution tank 400 via the piping 392, the electromagnetic valve 394, and the piping 396.

When a predetermined period of time has elapsed and bleaching/fixing processing of the film F has been completed, the pump 412 is driven reversely, and the bleaching/fixing solution within the tank and the pipings is returned to the bleaching/fixing solution tank 400. The solution within the piping 392, the electromagnetic valve 394, and the piping 396 may naturally flow downward.

When a predetermined period of time has elapsed and the bleaching/fixing solution is returned to the bleaching/fixing solution tank 400, the pump 412 is stopped, the electromagnetic valves 406, 394 are switched over, and the pump 414 is driven. The rinse solution of the rinse solution tank 402 is supplied to the processing tank 300 via the piping 418, the pump 414, the piping 410, the electromagnetic valve 406, the piping 404, the electromagnetic valve 354, and the piping 356. Further, the rinse solution within the tank is circulated and returned to the rinse solution tank 402 via the piping 392, the electromagnetic valve 394, and the piping 398. In this way, rinsing processing of the film F is carried out.

When a predetermined period of time has elapsed and rinsing processing of the film F is completed, the pump 414 is driven reversely, and the rinse solution within the tank and the pipings is returned to the rinse solution tank 402. The solution within the piping 392, the electromagnetic valve 394, and the piping 398 may flow down naturally.

When a predetermined period of time has elapsed and all of the rinse solution within the tank has been discharged, the pump 414 is stopped, the block 322 of the tightly-closing device 320 is moved apart from the cut-out portion 318, and the station 110 holding the cartridge 14 is moved at a predetermined speed in the direction of arrow B and stops at a predetermined position directly before the arrow B direction side end portion of the endless locus 142.

When the station 110 moves, the processed film F is successively withdrawn from the interior of the tank. When the film F passes through the drying section 130, the water absorbing paper 426 of the water absorbing device 420 absorbs the moisture on the surface of the film F, and the drying fan 422 blows out warm air so as to dry the film F.

When the station 110 stops, the film F is wound. When the cartridge 14 side first image frame 64 is positioned at the opening of the negative carrier 450, the conveying of the film F is stopped temporarily. The black shutter 464 is operated for a predetermined period of time such that exposure is carried out and the image of the image frame 64 is printed onto the photosensitive material 475. The image frames 64 can be stopped at the opening of the negative carrier 450 by a sensor detecting the perforations 66 of the film F.

At the water applying section 476, water is applied to the photosensitive material 475 on which images have been printed. Thereafter, the photosensitive material 475 is conveyed to the heat developing transfer section 136 in a state in which the photosensitive material 475 and the image-receiving material 485 are superposed together. The photosensitive material 475 and the image-receiving material 485 are conveyed while being nipped by the superposing roller and the heating roller, and are heated to a predetermined temperature. In this way, mobile dyes in the photosensitive material 475 are released, and the released dyes are transferred to the dye fixing layer of the image-receiving material 485 so that images are formed on the image-receiving material 485.

Thereafter, the photosensitive material 475 and the image-receiving material 485 are separated, and the used photosensitive material 475 is wound on the winding shaft 490.

The image-receiving material 485 on which images have been formed is cut to predetermined dimensions by the cutter 494 so as to form so-called prints 122 which fall down into the basket 498 therebelow.

When printing of all of the images has been completed in this manner, the spool driver 160 is rotated, the film F is completely wound onto the spool shaft 16 of the cartridge 14, and the door 30 is closed. When the door 30 is closed, energization of the solenoid 170 is stopped, and the distal ends of the door driver 158 and the spool driver 160 move apart from the cartridge 14.

Thereafter, the station 110 is moved in the direction of arrow B. When the station 110 is inverted at the arrow B direction side end portion of the endless locus 142, the push-out device 174 is operated, the cover 148 is opened, and the cartridge 14 falls down into the opening of the duct 500. The cartridge 14 passes through the duct 500, and falls into the basket 498 into which the prints 122 have been placed.

When the prints 122 are finished, the display device 114 displays a message such as "Prints for Order No. XXXX Finished".

When the customer inserts the corresponding ID card 118 into the ID card insertion opening 120, the ID card 118 is verified, and the basket 498 containing the cartridge 14 and the prints 122 is moved to the inner side of the automatic door 124. The automatic door 124 is opened, and the customer can take his/her prints 122 and cartridge 14 out from the basket 498.

In the present first embodiment, the prints 122 are obtained by using the image-receiving material 485 and the photosensitive material 475. However, the prints 122 may be obtained by subjecting an ordinary photographic printing paper to developing processing by using a processing solution. Further, the prints 122 may be obtained by a color printer by using a heat-sensitizing method or an injecting method in which the film images are read by a CCD camera or the like. However, the method for obtaining the prints 122 is not limited to the above-described methods.

When the prints 122 are to be obtained from a developed film F, a switch for indicating that a developed film F is set may be provided separately, and when the switch is on, developing processing is not carried out. In this way, repeat developing processing can be avoided, and it is possible for only the printing time to be the processing time.

Further, a keyboard for inputting the frame numbers and the print numbers may be provided separately so that the number of prints can be set freely.

The printer processor 100 of the present first embodiment is structured such that developing processing is carried out in a single processing tank 300 which has the minimum necessary volume. Therefore, the space taken up by the processing tank can be kept to a minimum. Further, because there is no need to provide devices which separate the film F from and join the film F to the cartridge 14, the printer processor 100 corresponding to the new system can be made compact and can be placed in a small space.

Further, because the color developing solution is used and then disposed of, processing of the film F can be carried out under optimal processing conditions.

Second Embodiment

A second embodiment of the present invention will be described with reference to FIG. 15. Structures which are the same as those of the first embodiment are denoted by the same reference numerals, and description thereof is omitted.

Figure 15:
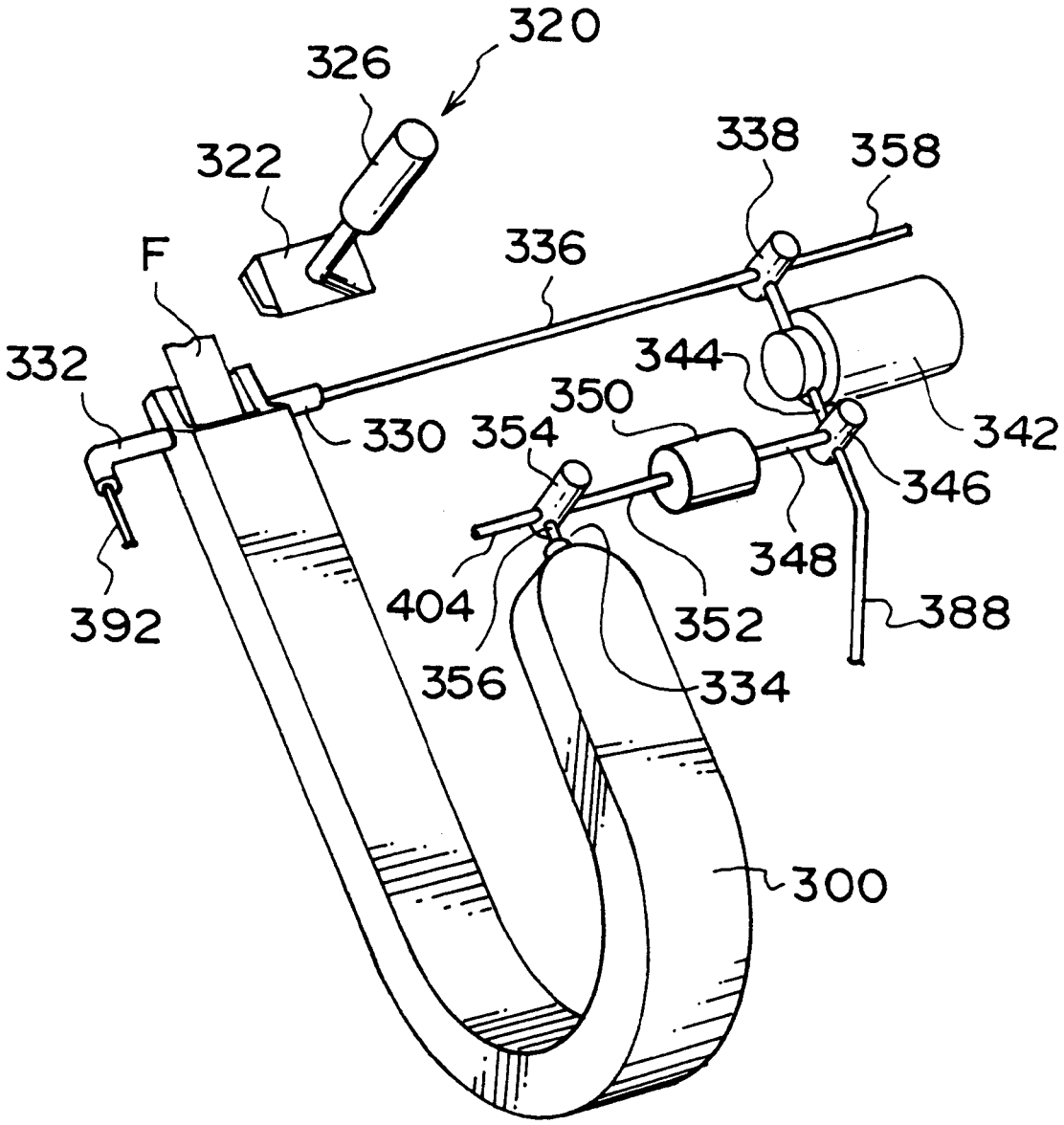
FIG. 15 is a perspective view of a developing processing section relating to a second embodiment.

As illustrated in FIG. 15, the processing tank 300 of the present second embodiment is substantially U-shaped. As a result, the piping length between the connecting portion 330 and the connecting portion 334 can be made shorter. The amount of processing solution required to fill the pipings can be reduced, and the amount of processing solution needed for the apparatus can be decreased. In particular, the costs of operating the apparatus can be reduced because the volume of the color developing solution, which is used and then disposed of, is decreased.

Third Embodiment

A third embodiment of the present invention will be described hereinafter with reference to FIGS. 16 through 21. Structures which are the same as those of the previously-described embodiments are denoted by the same reference numerals, and description thereof is omitted.

Figure 16:
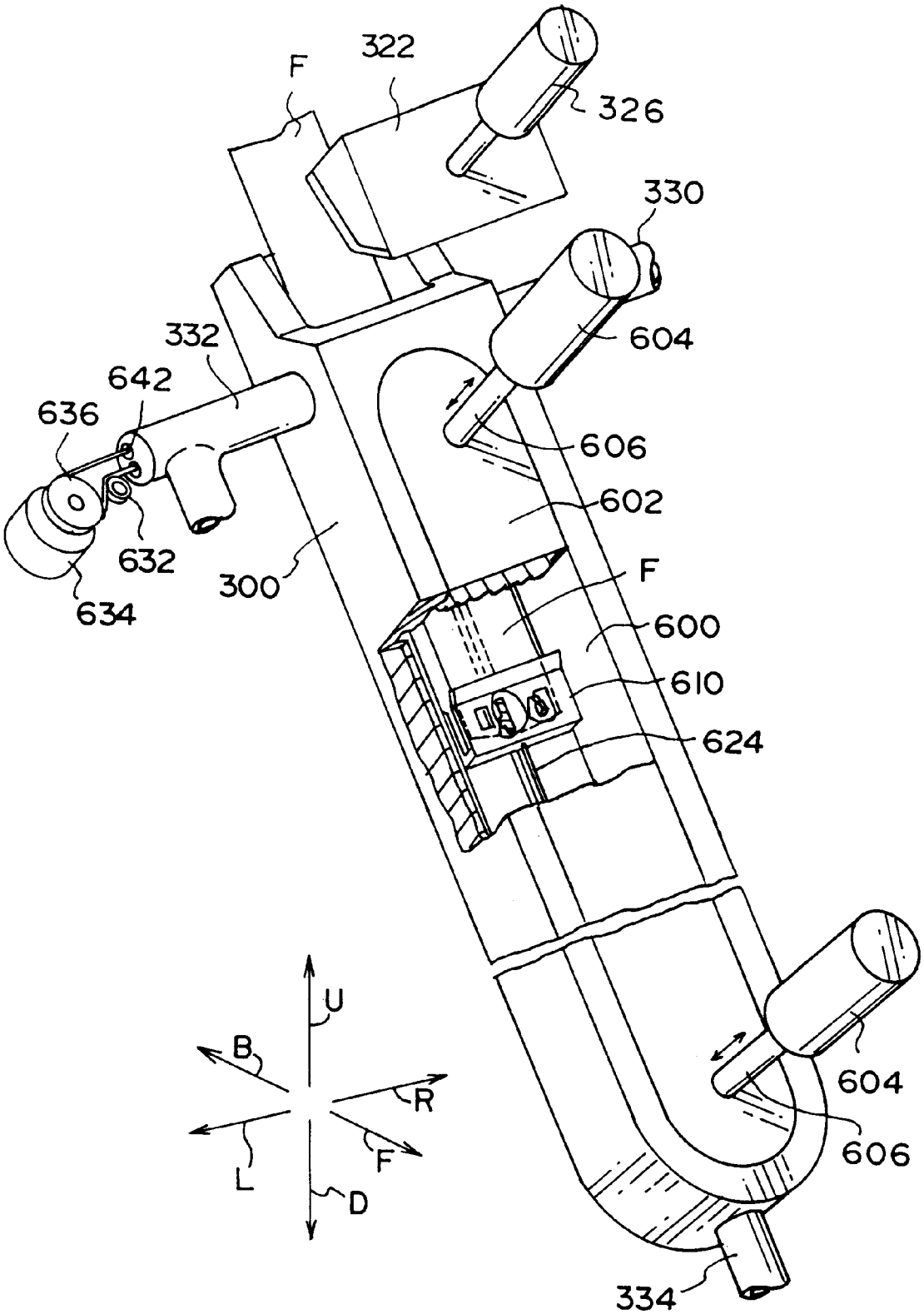
FIG. 16 is a perspective view of a processing tank relating to a third embodiment.

As illustrated in FIG. 16, an elongated cylinder hole 600 is formed in the arrow F direction side surface of the processing tank 300. An elongated piston 602 is inserted in the cylinder hole 600. Cylinder rods 606 of cylinders 604 are connected to the piston 602.

Figure 17:
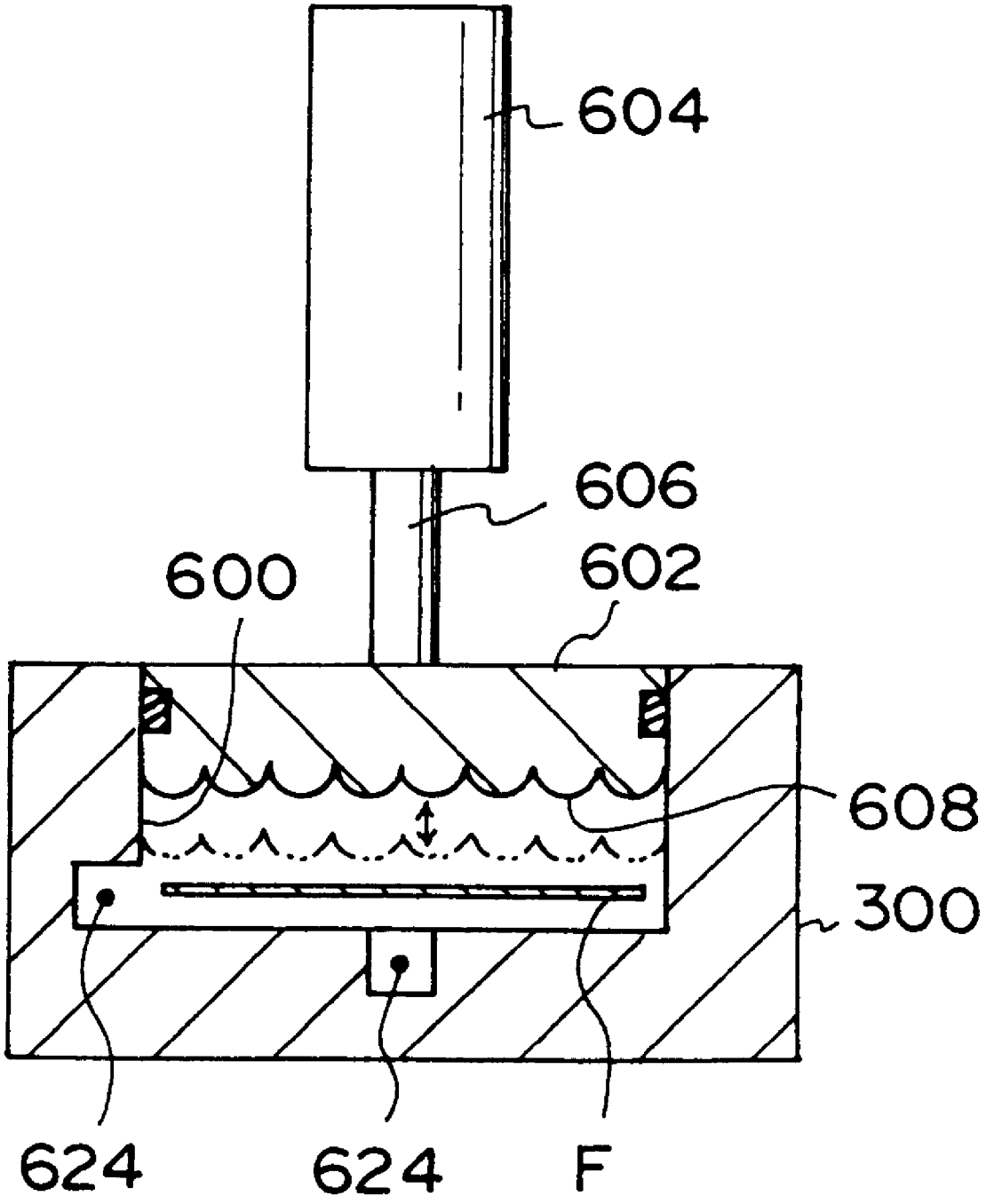
FIG. 17 is a sectional view orthogonal to a longitudinal direction of the processing tank relating to the third embodiment.

As illustrated in FIG. 17, a plurality of ribs 608, which are convex in substantially semicircular configurations, are formed at the inner wall surface of the piston 602 such that the plural ribs 608 are adjacent to one another along the transverse direction.

As shown in FIG. 16, a clip 610 for holding an end portion of the film F is disposed within the processing tank 300.

Figure 18:
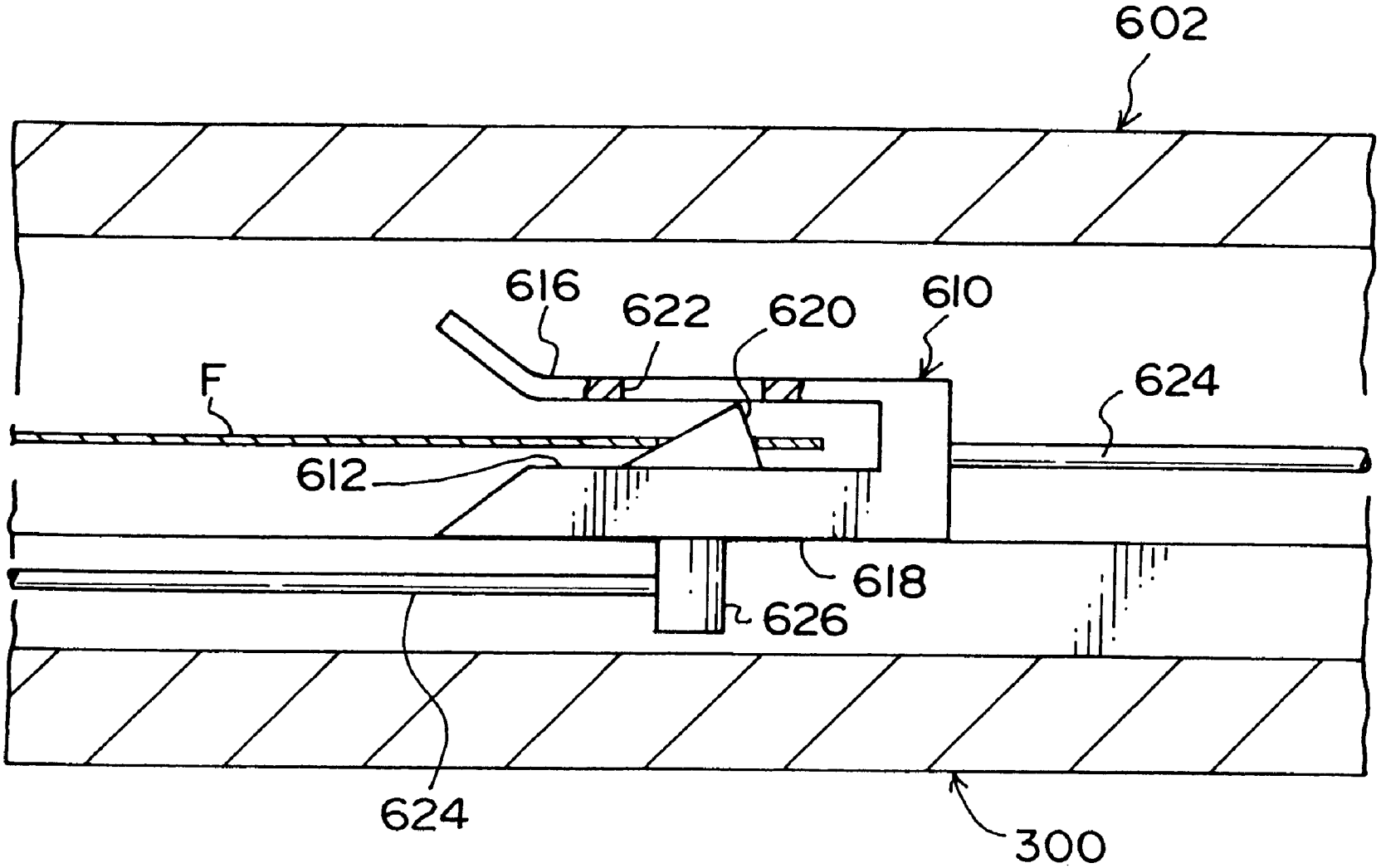
FIG. 18 is a side view of a clip.
Figure 19:
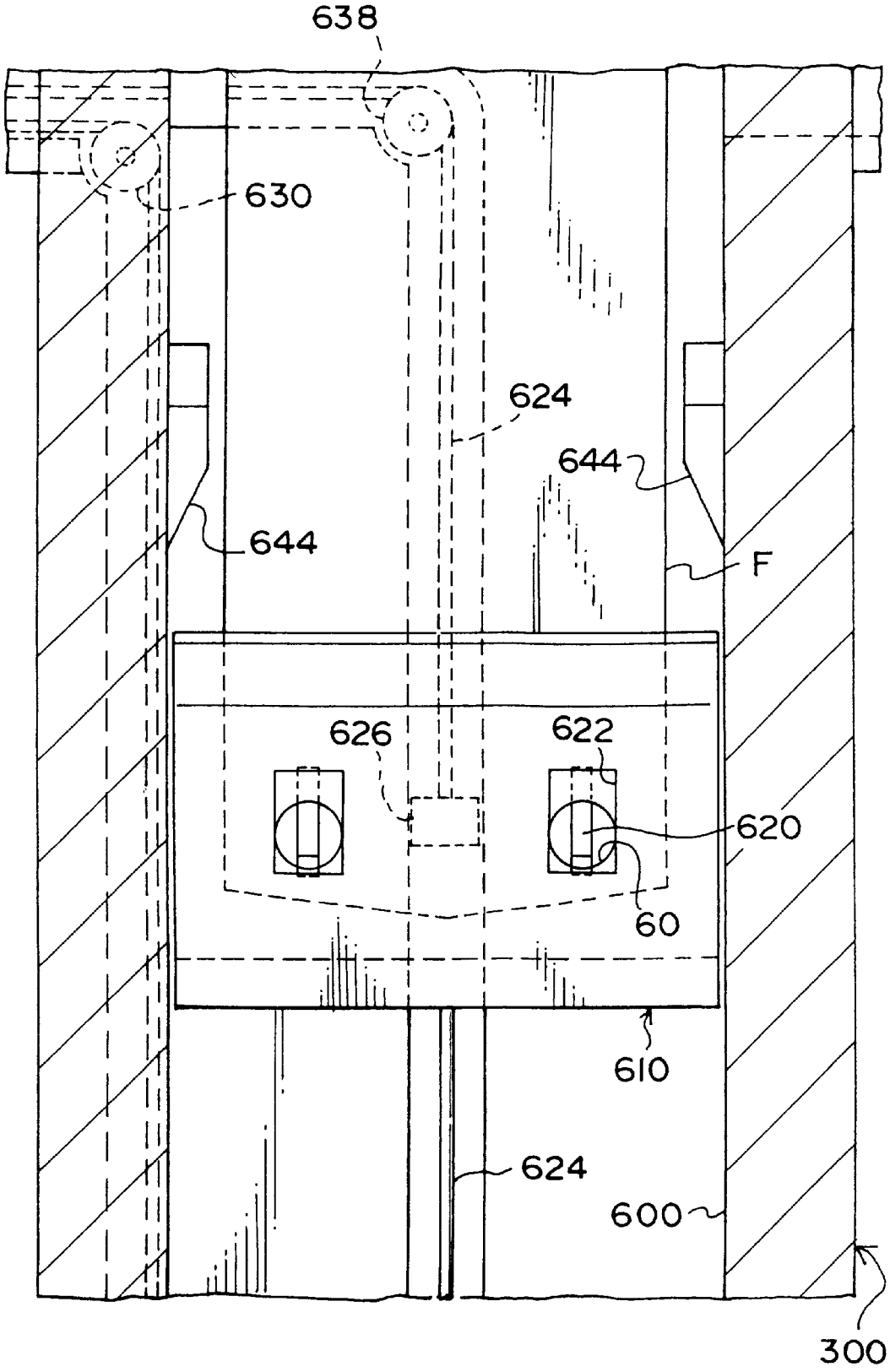
FIG. 19 is a plan view of the clip.

As illustrated in FIGS. 18 and 19, a slit 612, in which the film F is inserted, is formed in the clip 610. A thin wall portion 616 at the piston 602 side of the slit 612 is elastically deformable.

Triangular projections 620 which engage with the engaging holes 60 of the film F are formed at a thick wall portion 618 which is disposed at the side of the slit 612 opposite the side at which the thin wall portion 616 is formed. Rectangular holes 622 are formed in the thin wall portion 616 at positions opposing the projections 620.

When the film F is inserted into the slit 612 of the clip 610, the leading end of the film F rises up the incline of the triangular projections 620. When the leading end of the film F reaches the summit portions of the projections 620, the thin wall portion 616 is elastically deformed in a direction of opening the slit 612. When the leading end of the film F passes over the projections 620, the engaging holes 60 and the projections 620 engage.

Figure 20:
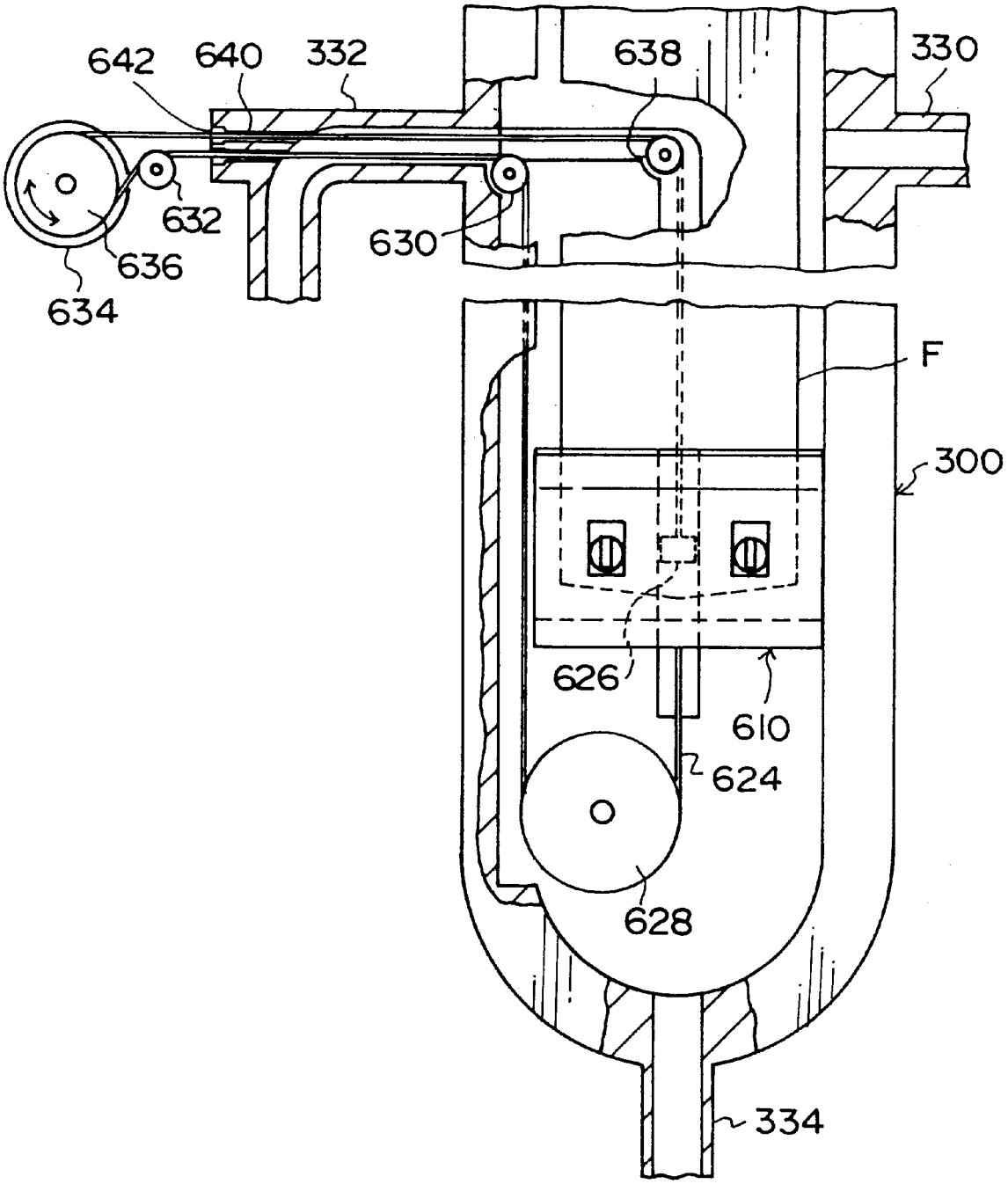
FIG. 20 is a partial cross-sectional view seen from a front surface side and illustrating the processing tank relating to the third embodiment.

As illustrated in FIGS. 18 and 20, one end of the clip 610 is connected to one end of a cable 624. The other end of the cable 624 is connected to a projection 626 formed at the outer side of the thick wall portion 618.

As shown in FIG. 20, the intermediate portion of the cable 624 is entrained about a pulley 628 provided in a vicinity of the bottom end of the interior of the processing tank 300, a pulley 630 provided in a vicinity of the connecting portion 332, a pulley 632 disposed at the outer side of the connecting portion 332, a pulley 636 rotated by a motor 634, and a pulley 638 provided between the connecting portion 332 and the connecting portion 330. By rotating the motor 634, the clip 610 is moved within the tank along the longitudinal direction.

A narrow hole 640 through which the cable 624 passes is formed in the connecting portion 332. Packing 642, which is adhered to the cable 624 to prevent leaking of the processing solution, is provided at one end of the narrow hole 640.

Figure 21:
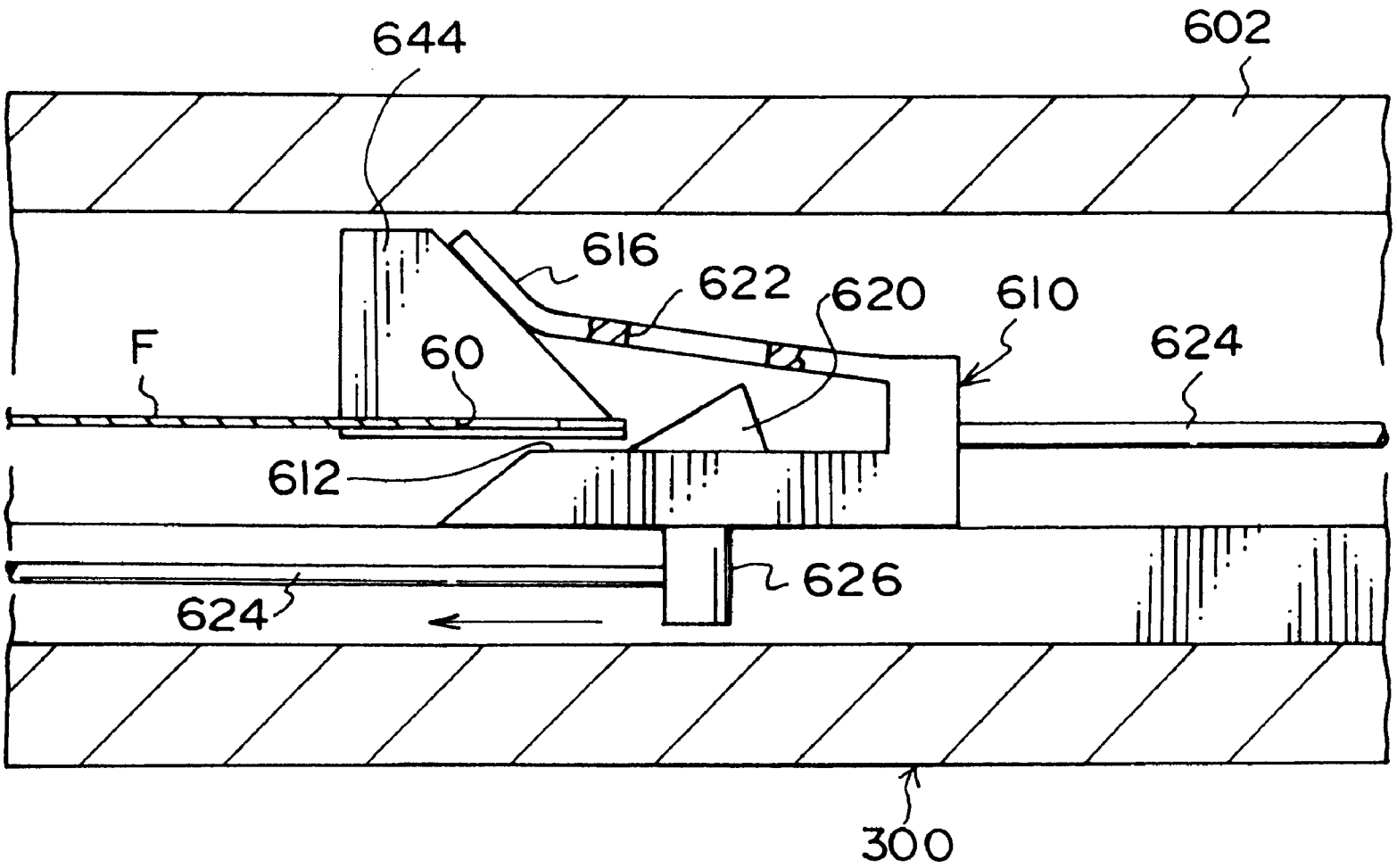
FIG. 21 is a side view of the clip in an open state.

As illustrated in FIGS. 19 and 21, a pair of projections 644 are formed in the processing tank 300 slightly below the pulley 630.

The processing tank 300 bottom end sides of the projections 644 are tapered. When the clip 610 is moved toward the projections 644 and the taper portions of the projections 644 enter into the slit 612 as illustrated in FIG. 21, the thin wall portion 616 elastically deforms toward the outer side. Here, if the film F is pulled, the engagement of the engaging holes 60 and the projections 620 is canceled, and the film F can be separated from the clip 610. If the film F is long, there is the possibility that insertion of the film F into the tank may not proceed smoothly due to the tendency of the film F to curl or the like. However, in the printer processor 100 of the present second embodiment, the clip 610 which pulls the film F into the processing tank 300 is provided. Therefore, even if the film F is particularly long, the film F can be inserted into the tank easily and reliably.

When the processing solution is circulated, the piston 602 is moved reciprocally by the cylinders 604. The plurality of ribs 608 which are convex in substantially semicircular shapes are formed at the inner surface of the piston 602 so as to be adjacent to one another in the transverse direction. Therefore, when the piston 602 moves, flow in the transverse direction of the film F is generated in the processing solution within the tank, so that the processing solution within the tank can be mixed well. As a result, irregularities in developing can be prevented.

Forth Embodiment

A fourth embodiment of the present invention will be described hereinafter with reference to FIGS. 22 through 28. Structures which are the same as those of the previously-described embodiments are denoted by the same reference numerals, and description thereof is omitted.

Figure 22:
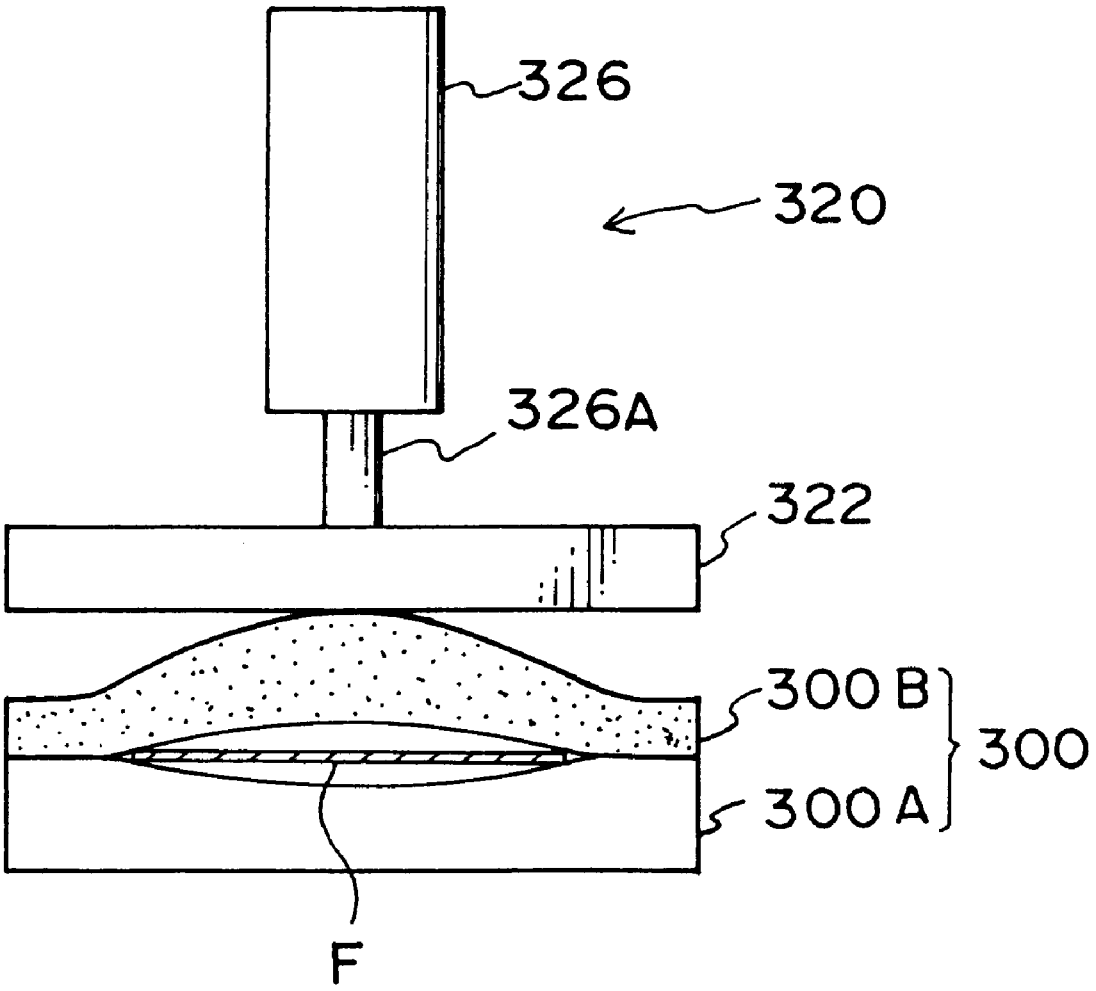
FIG. 22 is a view of a tightly-closing device and a processing tank relating to a fourth embodiment, as seen from a direction of inserting a film into the processing tank.

As illustrated in FIG. 22, the processing tank 300 of the present fourth embodiment is formed by a base portion 300A which is made of a synthetic resin or the like, and an elastic wall portion 300B which is formed from an elastic body such as rubber or the like.

The cross-sectional configuration of the processing tank 300 in a direction orthogonal to the longitudinal direction is illustrated in FIG. 22. The inner wall surfaces which oppose one another are curved such that the interval therebetween at the transverse direction sides thereof is narrow whereas the interval therebetween at the transverse direction central portion is wide.

The elastic wall portion 300B is formed such that the transverse direction central portion thereof is the most thick, and the elastic wall portion 300B becomes thinner toward both transverse direction sides.

Figure 23:
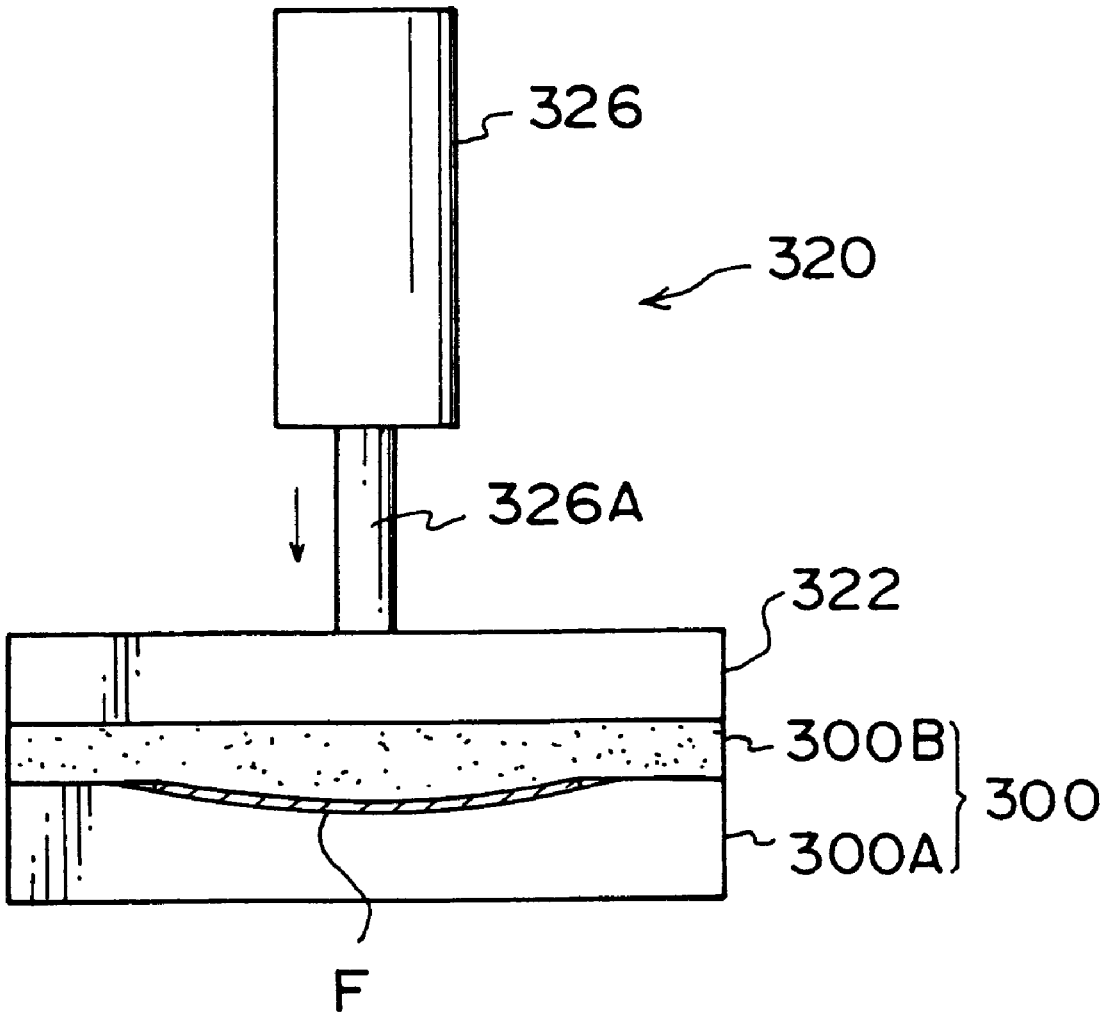
FIG. 23 is a view of the processing tank which is tightly closed by the tightly-closing device, as seen from the direction of inserting a film.

The block 322 of the tightly-closing device 320 of the present fourth embodiment has a planar configuration. When the solenoid 326 is energized, as illustrated in FIG. 23, the block 322 pushes the elastic wall portion 300B toward the base portion 300A such that the interior of the tank is tightly closed.

Figure 24:
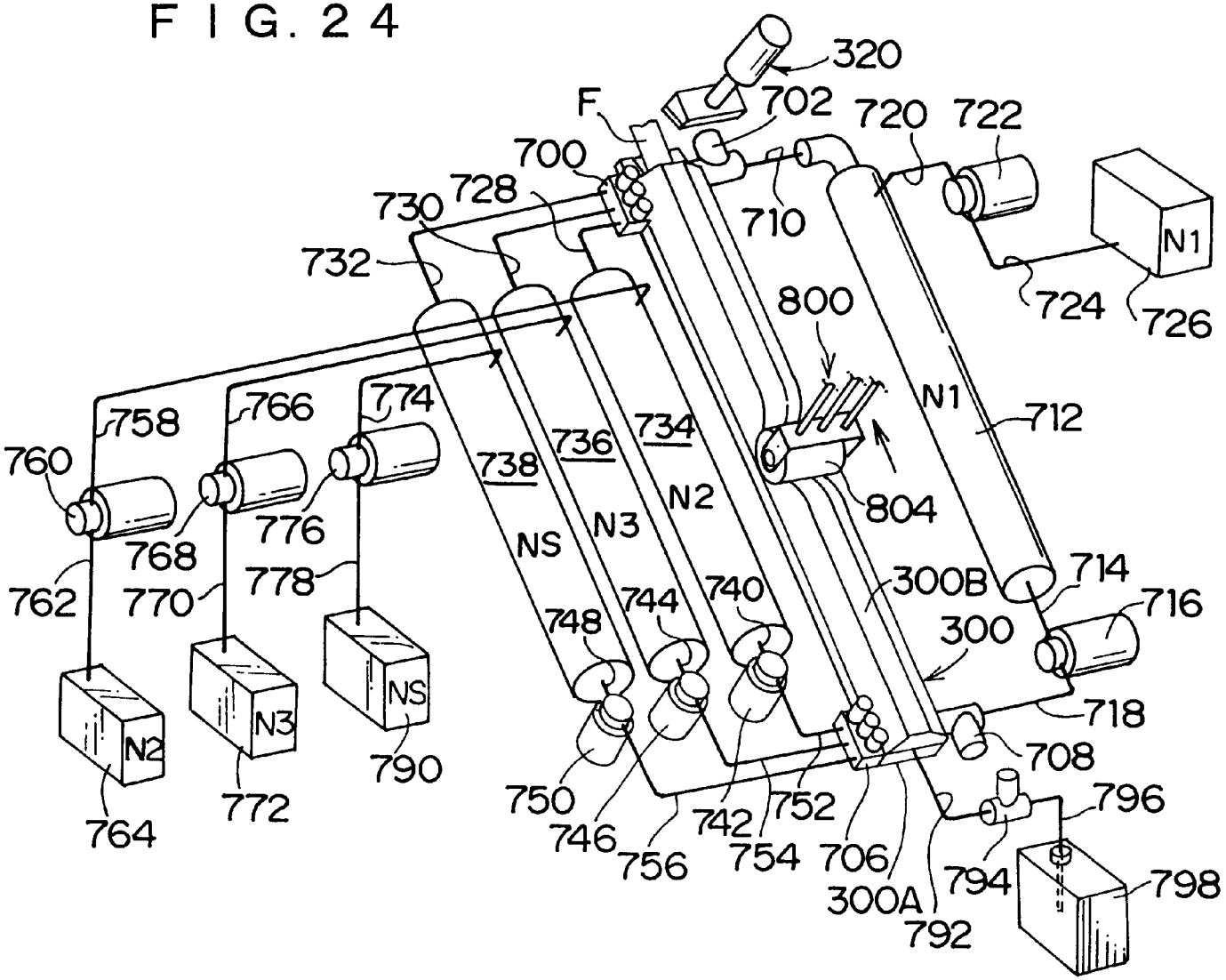
FIG. 24 is a perspective view illustrating a developing processing section relating to the fourth embodiment.

As shown in FIG. 24, an electromagnetic valve block 700 is mounted to one transverse direction side of the upper portion of the processing tank 300. An electromagnetic valve 702 is mounted to the other transverse direction side of the upper portion of the processing tank 300. An electromagnetic valve block 706 is mounted to one transverse direction side of the lower portion of the processing tank 300. An electromagnetic valve 708 is mounted to the other transverse direction side of the lower portion of the processing tank. The electromagnetic valve 702 and the electromagnetic valve 708 are connected to one another via a piping 710, a cylindrical mother liquor tank 712, a piping 714, a pump 716, and a piping 718.

A predetermined amount of color developing solution is stored in the mother liquor tank 712 and is heated to a predetermined temperature by an unillustrated heater.

The mother liquor tank 712 is connected to a replenishing tank 726, in which color developing solution is filled, via a piping 720, a pump 722 and a piping 724. Color developing solution is replenished from the replenishing tank 726 in accordance with the deterioration in the color processing solution of the mother liquor tank 712 and when the amount of solution in the mother liquor tank 712 is less than a predetermined amount.

Respective ones of ends of pipings 728, 730, 732 are connected to the electromagnetic valve block 700. The other end of the piping 728 is connected to the upper end of a mother liquor tank 734 which stores bleaching solution. The other end of the piping 730 is connected to the upper end of a mother liquor tank 736 which stores fixing solution. The other end of the piping 732 is connected to the upper end of a mother liquor tank 738 which stores rinse solution.

A pump 742 is connected to the lower end of the mother liquor tank 734 via a piping 740. A pump 746 is connected to the lower end of the mother liquor tank 736 via a piping 744. A pump 750 is connected to the lower end of the mother liquor tank 738 via a piping 748.

One end of a piping 752 is connected to the pump 742. One end of a piping 754 is connected to the pump 746. One end of a piping 756 is connected to the pump 750. The respective other ends of the pipings 752, 754, 756 are connected to the electromagnetic valve block 706.

The mother liquor tank 734 is connected, via a piping 758, a pump 760 and a piping 762, to a replenishing tank 764 in which bleaching solution is filled. Bleaching solution is replenished from the replenishing tank 764 in accordance with the deterioration in the bleaching solution in the mother liquor tank 734 and when the amount of solution in the mother liquor tank 734 is less than a predetermined amount.

The mother liquor tank 736 is connected, via a piping 766, a pump 768 and a piping 770, to a replenishing tank 772 in which fixing solution is filled. Fixing solution is replenished from the replenishing tank 772 in accordance with the deterioration in the fixing solution in the mother liquor tank 736 and when the amount of solution in the mother liquor tank 736 is less than a predetermined amount.

The mother liquor tank 738 is connected, via a piping 774, a pump 776 and a piping 778, to a replenishing tank 790 in which rinse solution is filled. Rinse solution is replenished from the replenishing tank 790 in accordance with the deterioration in the rinse solution in the mother liquor tank 738 and when the amount of solution in the mother liquor tank 738 is less than a predetermined amount.

A heater is provided at each of the mother liquor tanks 734, 736, 738 so as to heat the processing solutions to predetermined temperatures.

A piping 792, an electromagnetic valve 794 and a piping 796 are connected in that order to the bottom portion of the processing tank 300. One end of the piping 796 is inserted into a waste liquid tank 798 which stores processing solution which has been used.

Figure 25:
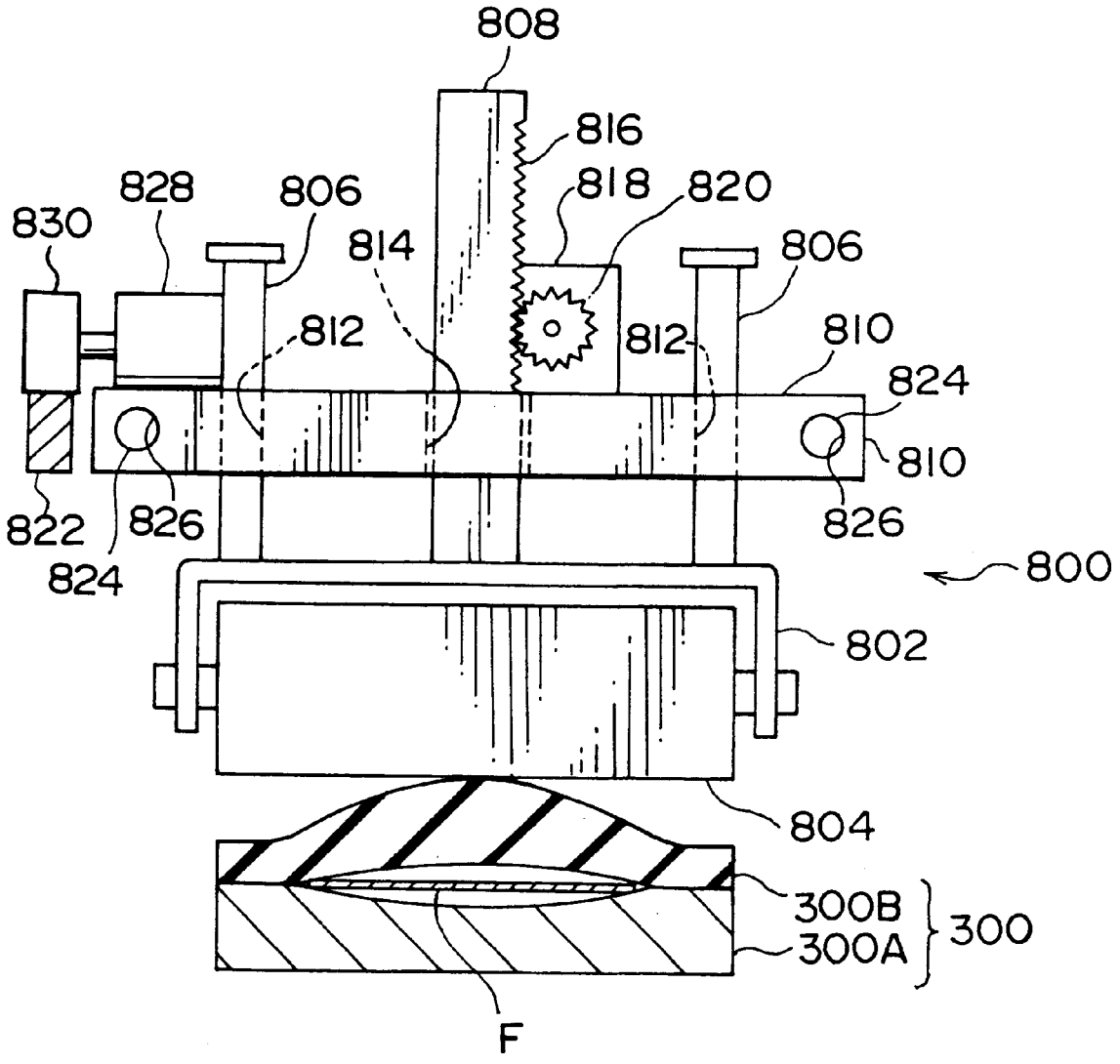
FIG. 25 is a front view of a sealing device.
Figure 26:
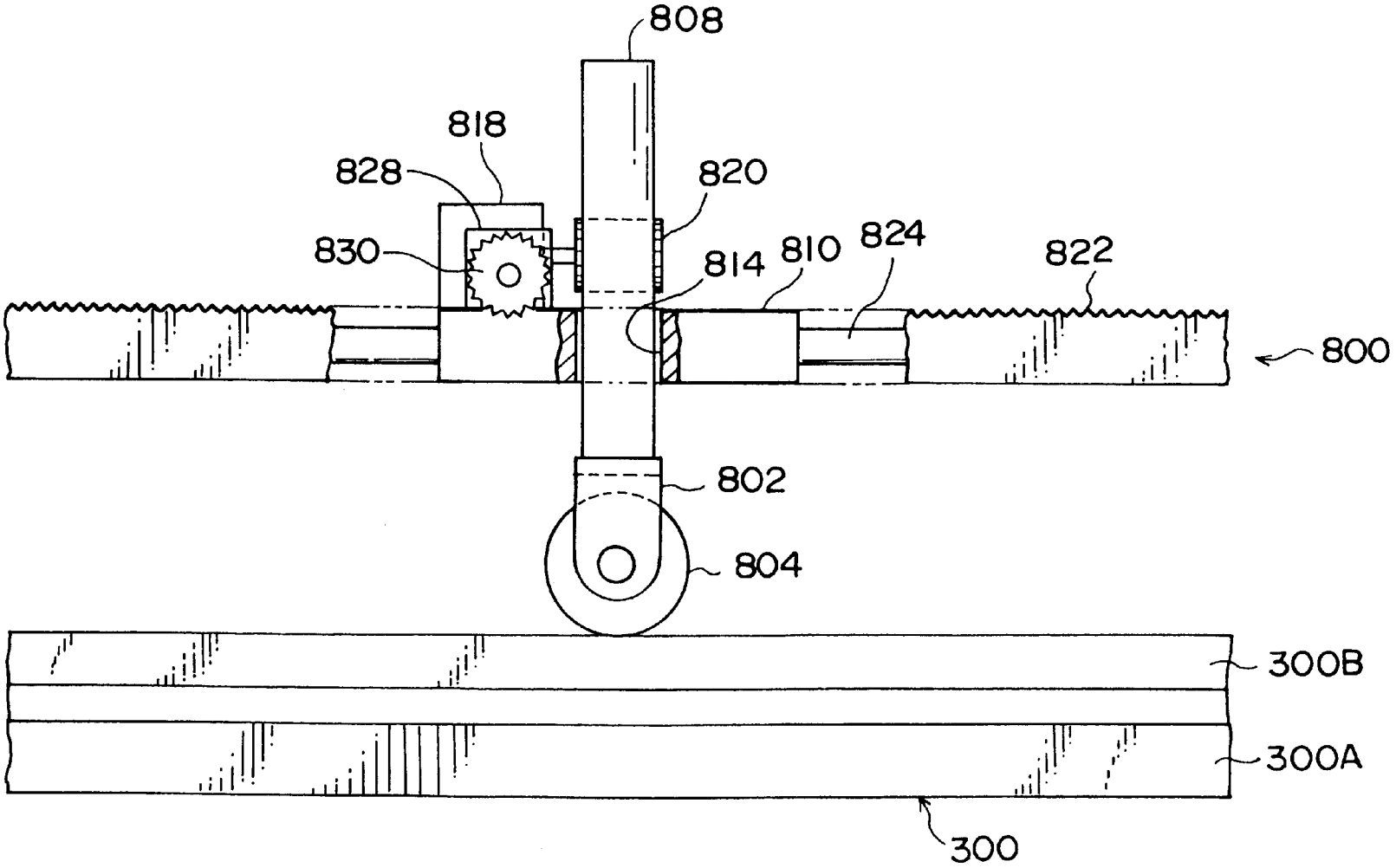
FIG. 26 is a side view of the sealing device.
Figure 27:
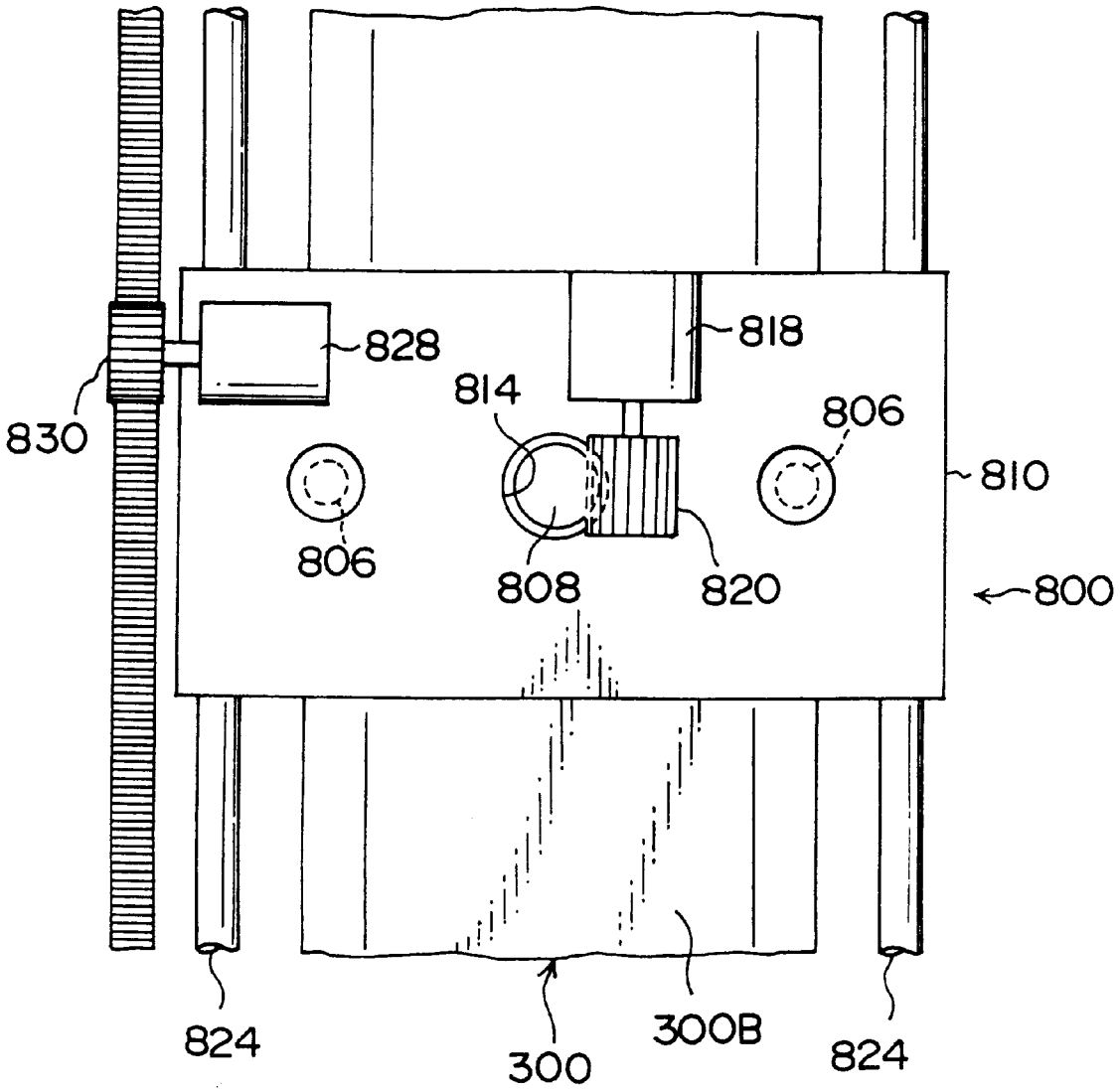
FIG. 27 is a plan view of the sealing device.

As illustrated in FIGS. 25 and 27, a sealing device 800 is disposed at the elastic wall portion 300B side of the processing tank 300.

The sealing device 800 has a seal roller 804 which is supported so as to be freely rotatable by a U-shaped frame 802.

A pair of guide shafts 806 and a rack shaft 808 are fixed to the frame 802. A moving base 810 is disposed parallel to the elastic wall portion 300B side of the processing tank 300. The guide shafts 806 are inserted in holes 812 of the moving base 810 so as to be freely slidable therein. The rack shaft 808 is inserted such that it does not contact a hole 814 formed in the moving base 810.

A rack 816 is formed at the rack shaft 808. A gear 820, which is rotated by a motor 818 mounted to the moving base 810, meshes with the rack 816.

Accordingly, when the gear 820 is rotated, the rack shaft 808 moves linearly in directions of approaching and moving away from the processing tank 300. When rack shaft 808 moves toward the processing tank 300, the seal roller 804 pushes the elastic wall portion 300B toward the base portion 300A.

A rack 822 and a pair of guide shafts 824 are disposed parallel to one another at the elastic wall portion 300B side of the processing tank 300. A pair of guide holes 826 are formed in the moving base 810. The guide shafts 824 are inserted into the guide holes 826. In this way, the moving base 810 is freely slidable along the longitudinal direction of the processing tank 300.

A gear 830, which is rotated by a motor 828 mounted to the moving base 810, meshes with the rack 822. The moving base 810 can move due to the rotation of the gear 830.

Next, operation of the present fourth embodiment will be described.

First, when the film F is inserted into the processing tank 300, the solenoid 326 is energized. The block 322 of the tightly-closing device 320 pushes the elastic wall portion 300B so that the interior of the tank is tightly closed (see FIG. 23).

The seal roller 804 has been placed in a state in which it does not push the elastic wall portion 300B (see FIG. 25). In this state, the electromagnetic valve 702 and the electromagnetic valve 708 are opened, the pump 716 is operated, and the color developing solution of the mother liquor tank 712 is circulated in the processing tank 300 for a predetermined time. (The other electromagnetic valves remain closed.) The color developing solution is supplied into the tank from the electromagnetic valve 708 side, and is discharged from the electromagnetic valve 702 side.

After a predetermined period of time elapses, when color developing processing has been completed, the pump 716 is stopped, the moving base 810 is moved to the lower end side of the processing tank 300, and the lower end of the elastic wall portion 300B is pushed by the seal roller 804.

Next, the electromagnetic valve 708 is closed, and the electromagnetic valve block 706 is switched over so that the piping 752 communicates with the interior of the tank 300. With the seal roller 804 pushing the elastic wall portion 300B, the moving base 810 is moved toward the upper end of the processing tank 300.

Figure 28A:
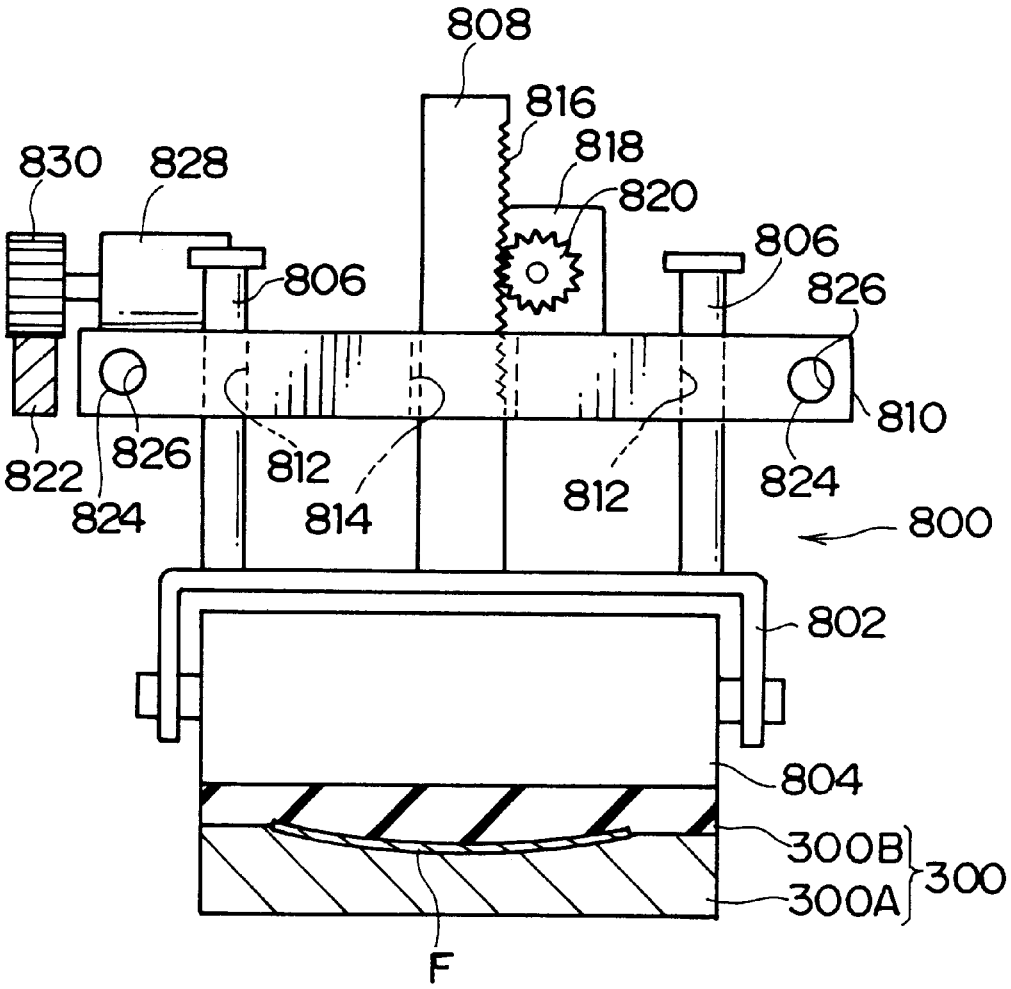
FIG. 28A is a cross-sectional view of a processing tank sealed by the sealing device, as seen from a longitudinal direction.
Figure 28B:
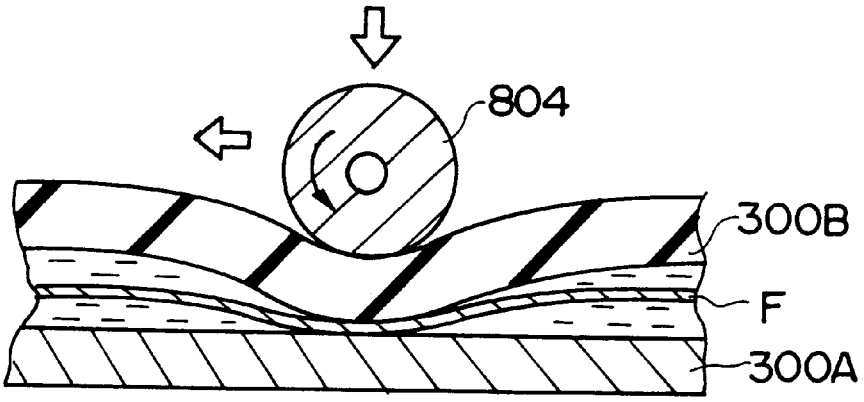
FIG. 28B is a cross-sectional view of the processing tank sealed by the sealing device, as seen from the side.

As illustrated in FIGS. 28A and 28B, the portion of the elastic wall portion 300B which is pushed by the seal roller 804 protrudes toward the base portion 300A side such that the film F is nipped between the elastic wall portion 300B and the base portion 300A. By moving the moving base 810, as illustrated in FIG. 28B, the interior of the tank is divided into two chambers, with the volume of the divisional upper end side chamber decreasing and the volume of the divisional lower end side chamber increasing. Accordingly, when the seal roller 804 is moved and the pump 742 is operated so as to supply bleaching solution to the processing tank 300, the interior of the tank at the divisional lower end side chamber is filled with bleaching solution, and the color developing solution within the divisional upper end side chamber is discharged to the mother liquor tank 712. When the seal roller 804 reaches the upper end, all of the color developing solution in the processing tank 300 is discharged into the mother liquor tank 712. The electromagnetic valve 702 is closed, and bleaching solution is filled in the interior of the processing tank 300. The color developing solution is replaced by the bleaching solution in this way.

Thereafter, the seal roller 804 separates from the elastic wall portion 300B. The electromagnetic valve block 700 switches over so that the piping 728 communicates with the interior of the processing tank 300, and the bleaching solution in the mother liquor tank 734 is circulated in the processing tank 300 for a predetermined time by the pump 742. The bleaching solution is supplied into the tank from the electromagnetic valve block 706 side, and is discharged from the electromagnetic valve block 700 side.

A predetermined period of time passes, and when bleaching processing is completed, the pump 740 is stopped. The moving base 810 is moved to the lower end side of the processing tank 300, and the lower end of the elastic wall portion 300B is pushed by the seal roller 804.

Next, the electromagnetic valve block 706 is switched over so that only the piping 754 communicates with the interior of the processing tank 300. With the seal roller 804 pushing the elastic wall portion 300B, the moving base 810 is moved toward the upper end of the processing tank 300.

When the seal roller 804 is moved and the pump 746 is operated so that fixing solution is supplied to the processing tank 300, the interior of the tank at the divisional lower end side is filled with fixing solution, and the bleaching solution within the upper end side of the tank is discharged to the mother liquor tank 734. When the seal roller 804 reaches the upper end, all of the bleaching solution in the tank is discharged to the mother liquor tank 734, and the interior of the tank is filled with fixing solution. The bleaching solution is replaced with fixing solution in this way.

Thereafter, the seal roller 804 separates from the elastic wall portion 300B, and the electromagnetic valve block 700 is switched over so that the piping 730 communicates with the interior of the processing tank 300. The fixing solution of the mother liquor tank 736 is circulated in the processing tank 300 for a predetermined period of time by the pump 746. The fixing solution is supplied into the tank from the electromagnetic valve block 706 side and is discharged from the electromagnetic valve block 700 side.

Thereafter, in the same way as described above, the fixing solution is replaced by the rinse solution, and the film F is subjected to rinsing processing.

By opening the electromagnetic valve 794, the processing solution which has deteriorated can be discharged to the waste liquid tank 798 as waste liquid.

In the present fourth embodiment, the changing of processing solutions within the tank can be carried out by moving the seal roller 804 while the seal roller 804 is pressed against the elastic wall portion 300B. Further, the elastic wall portion 300B which is pressed by the seal roller 804 is fit tightly to the opposing base portion 300A (and to the film F). Therefore, different processing solutions do not mix together within the tank, and the quality of the processing solutions can be maintained.

Fifth Embodinient

A fifth embodiment of the present invention will be described hereinafter with reference to FIGS. 29 through 31. Structures which are the same as those of the above-described embodiments are denoted by the same reference numerals, and description thereof is omitted.

Figure 29:
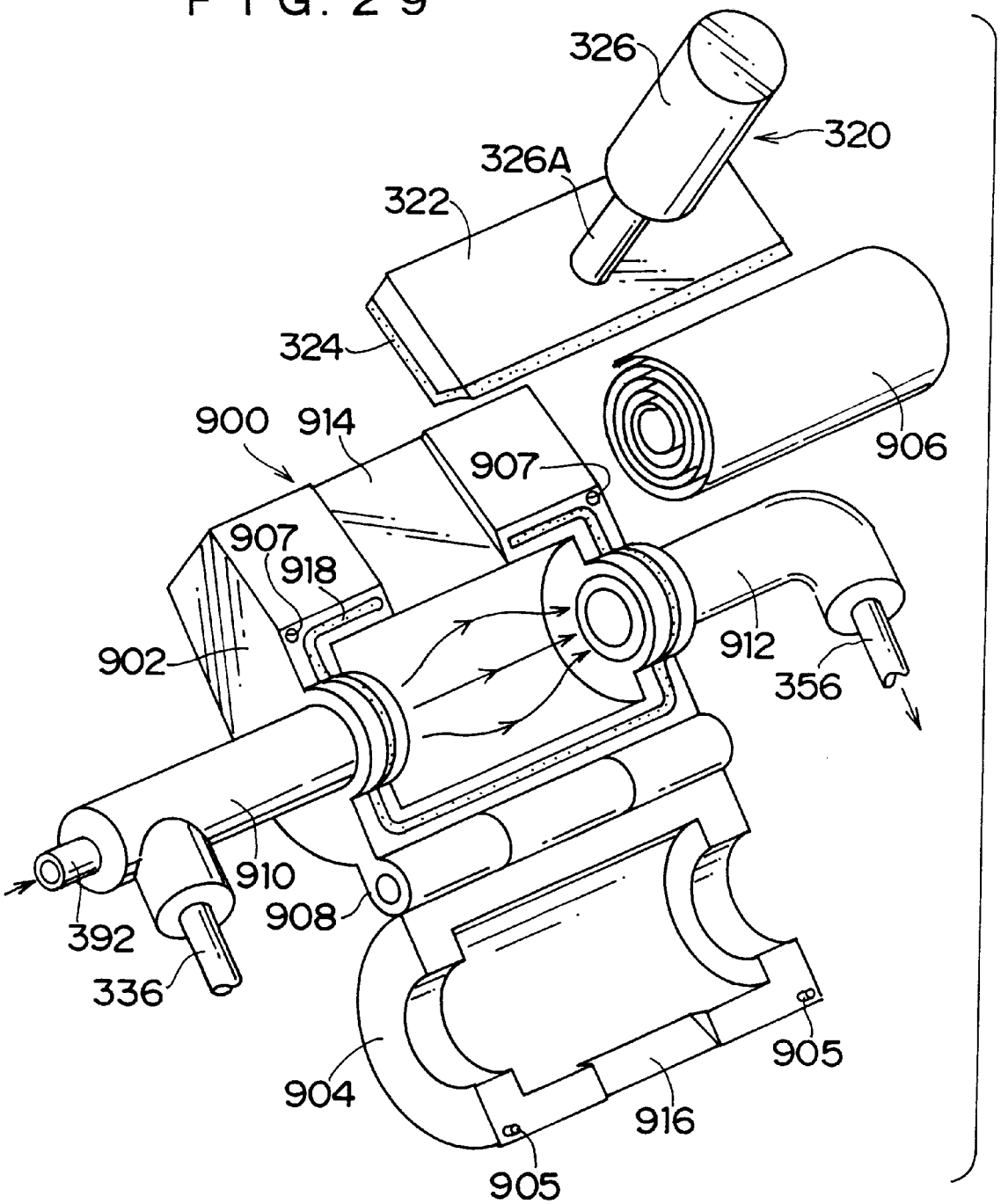
FIG. 29 is an exploded perspective view relating to a fifth embodiment of the present invention.
Figure 30:
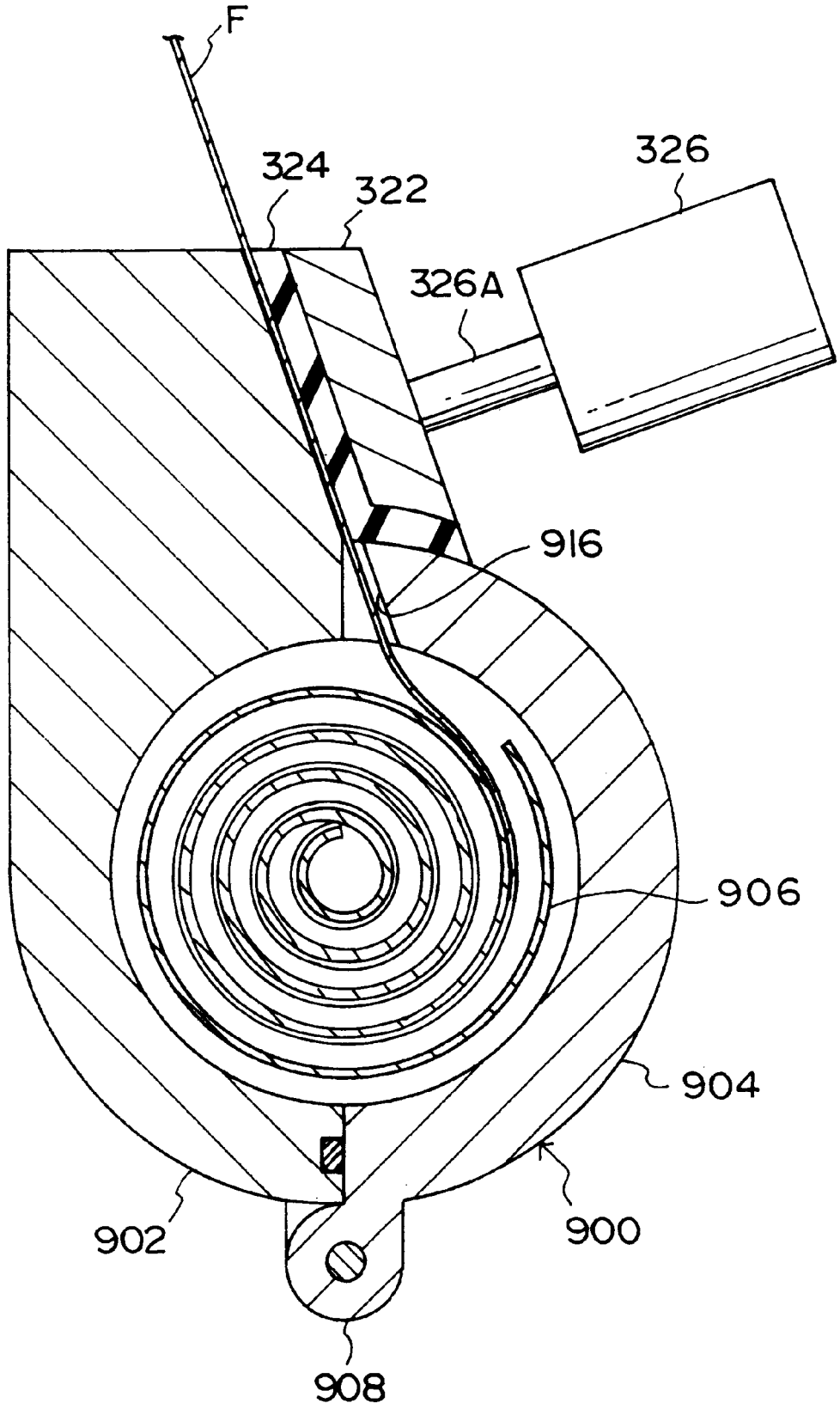
FIG. 30 is a cross-sectional view orthogonal to the axis of the processing tank.
Figure 31:
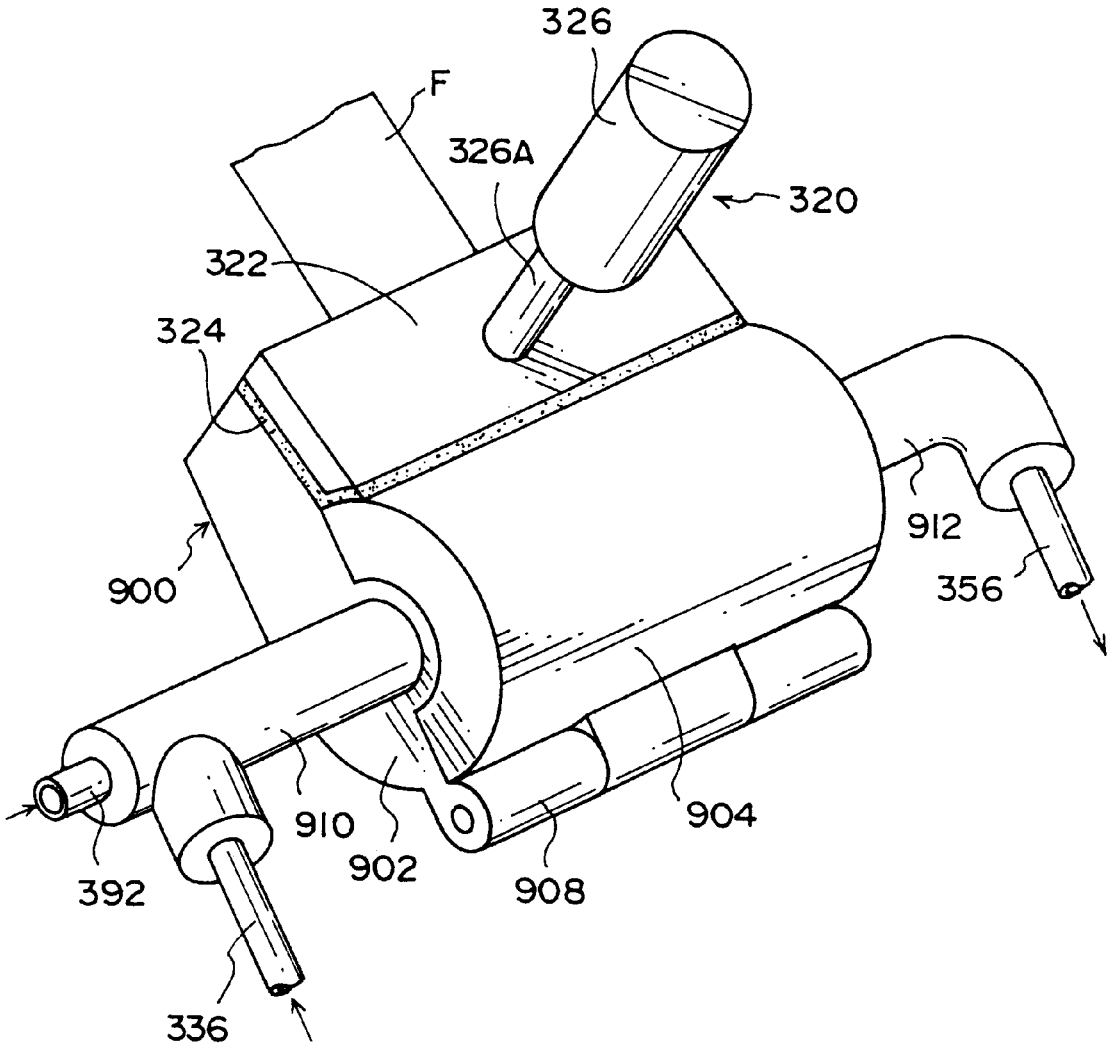
FIG. 31 is a perspective view of the processing tank closed by a cover.

As illustrated in FIGS. 29 and 30, the processing tank 900 of the present fifth embodiment has an internal space having a circular cross-section. The processing tank 900 is formed of the following three parts: a main body 902, an opening/closing cover 904, and a film guide 906. The opening/closing cover 904 can be opened and closed with respect to the main body 902 by a hinge portion 908.

The film guide 906 is a structure in which an elongated, resin, flat plate is formed in a coiled configuration, and is disposed in the processing tank 900.

A pipe-shaped connecting portion 910 is formed integrally with one axial direction end of the main body 902. A pipe-shaped connecting portion 912 is formed integrally with the other axial direction end of the main body 902.

The piping 336 and the piping 392 (see FIG. 9) are connected to the connecting portion 910. The piping 356 (see FIG. 9) is connected to the connecting portion 912. The processing solution within the tank flows along the axial direction (the transverse direction of the film F) as illustrated in FIG. 29.

A shallow groove 914, which has a width slightly larger than the width of the film F, is formed in the main body 902. A shallow groove 916, which has the same width as the shallow groove 914 of the main body 902, is formed in a position opposing the shallow groove 914. The shallow grooves 914, 916 form a film insertion opening when the opening/closing cover 904 is closed.

Packing 918, which is formed from an elastic body such as rubber or the like, is attached to a portion of the main body 902 which abuts the edge portion of the opening/closing cover 904.

Pins 905 are formed at the ends of the opening/closing cover 904. Due to the pins 905 engaging with holes 907 formed in the main body 902, the opening/closing cover 904 can be locked.

The tightly-closing device 320 is disposed at a position opposing the shallow groove 914 of the main body 902. When the processing solutions are circulated, replaced or the like, the tightly-closing device 320 tightly closes the interior of the tank as illustrated in FIGS. 30 and 31. As a result, the processing solutions do not leak out of the tank.

In the present fifth embodiment, a predetermined processing is carried out by the processing solution being made to flow along the transverse direction of the film F accommodated in a coiled shape. This structure is advantageous in that, because the processing solution flows along the transverse direction of the film F, the processing solution can be replaced by the next processing solution quickly. Further, because the film F is accommodated in a coiled shape, even if the film F is long, only the diameter of the processing tank 900 becomes slightly greater, and the entire length does not become greater by the amount of the increased length of the film F.

In the present fifth embodiment, the film F is inserted with the film guide 906 being accommodated in the processing tank 900. However, the film F may be inserted in the film guide 906 which has been removed from the processing tank 900, and the film guide 906 together with the film F may be accommodated into the processing tank 900.

Sixth Embodiment

A sixth embodiment of the present invention will be described hereinafter with reference to FIGS. 32 and 33. Structures which are the same as those of the previously-described embodiments are denoted by the same reference numerals, and description thereof is omitted.

In the present sixth embodiment, the drum-shaped processing tank 900 (not shown) in the above-described fifth embodiment is used. However, in the present sixth embodiment, developing processing is carried out with the film F wound together with an emboss film 920.

Figure 32:
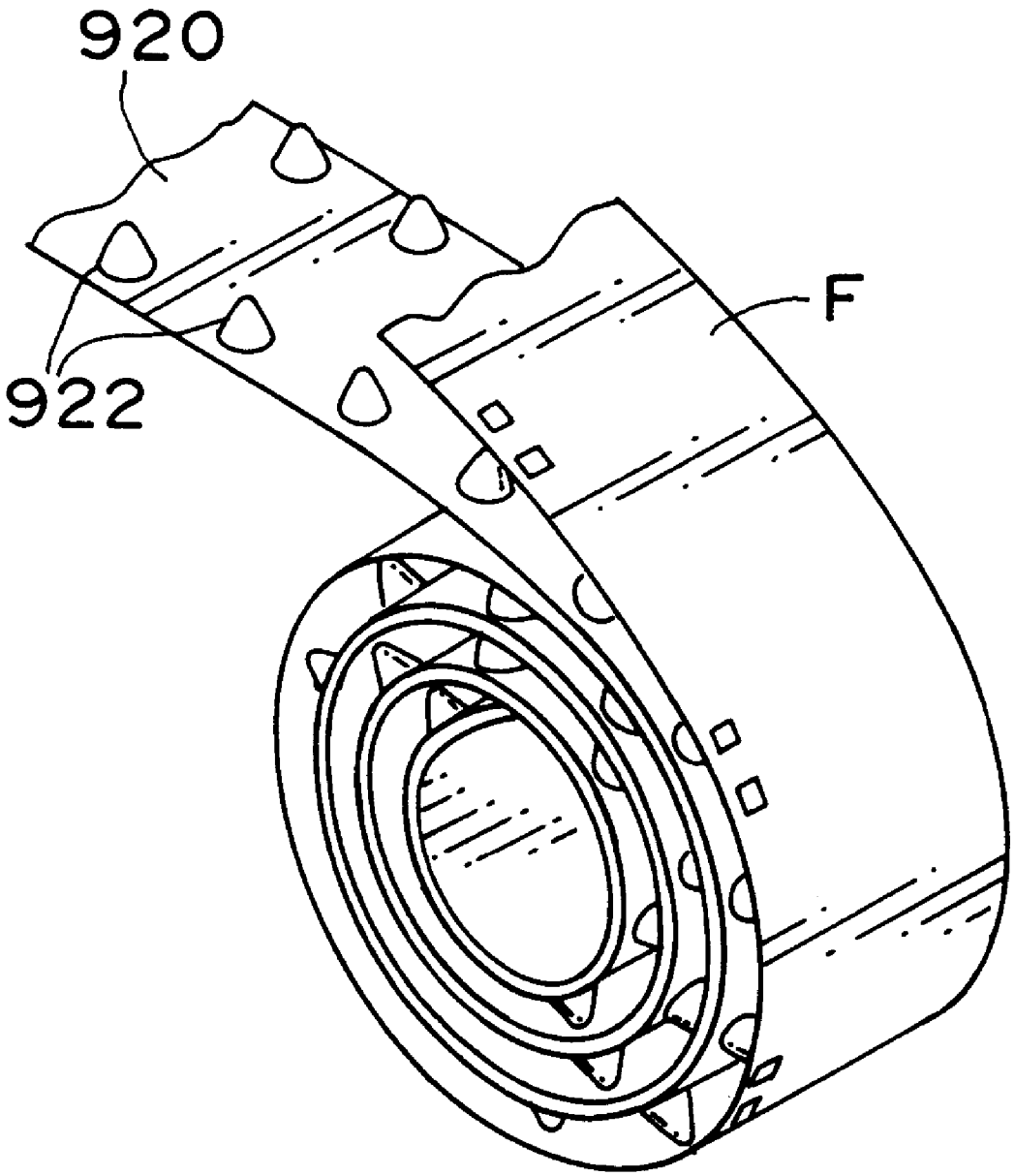
FIG. 32 is a perspective view illustrating an emboss film and a film wound therewith.
Figure 33:
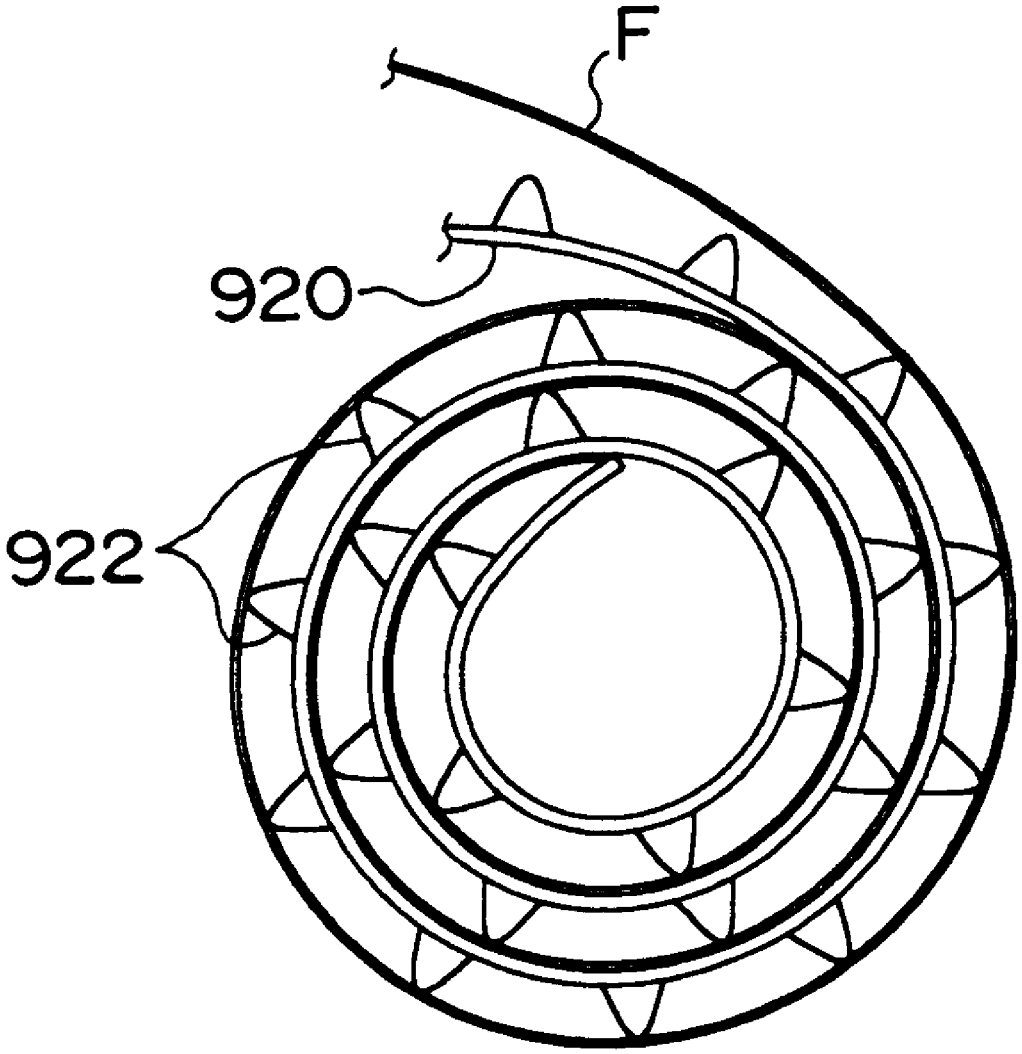
FIG. 33 is a side view in which the emboss film and the film illustrated in FIG. 32 are viewed from the axial direction.

As illustrated in FIGS. 32 and 33, the emboss film 920 is a film formed of a synthetic resin (e.g., PET) and having substantially the same width as the film F. A plurality of convex portions 922 are formed along the longitudinal direction of the emboss film 920 in vicinities of the transverse direction ends (at portions which do not contact the image regions of the film F). The convex portions 922 contact the emulsion surface side of the film F. As illustrated in FIG. 33, a gap through which the processing solution flows is formed at the emulsion surface side of the film F.

The height of the convex portion 922 is about 0.2 mm to about 1 mm, and may be greater than or equal to 1 mm as well. After the film F has been wound together with the emboss film 920, the emboss film 920 may be accommodated in the processing tank 900. Or, the film F may be superposed on the emboss film 920, and then the film F and the emboss film 920 inserted into the processing tank 900 from the insertion opening.

The processing tank may have a configuration other than a sheath shape or a drum shape with an internal space having a circular cross-section. The external configuration and the internal configuration are not limited to the above structures provided that a film insertion opening and a closing means for closing the film insertion opening are provided.

Seventh Embodiment

A seventh embodiment will be described hereinafter in accordance with FIG. 34. Structures which are the same as those of the previously-described embodiments are denoted by the same reference numerals, and description thereof is omitted.

Figure 34:
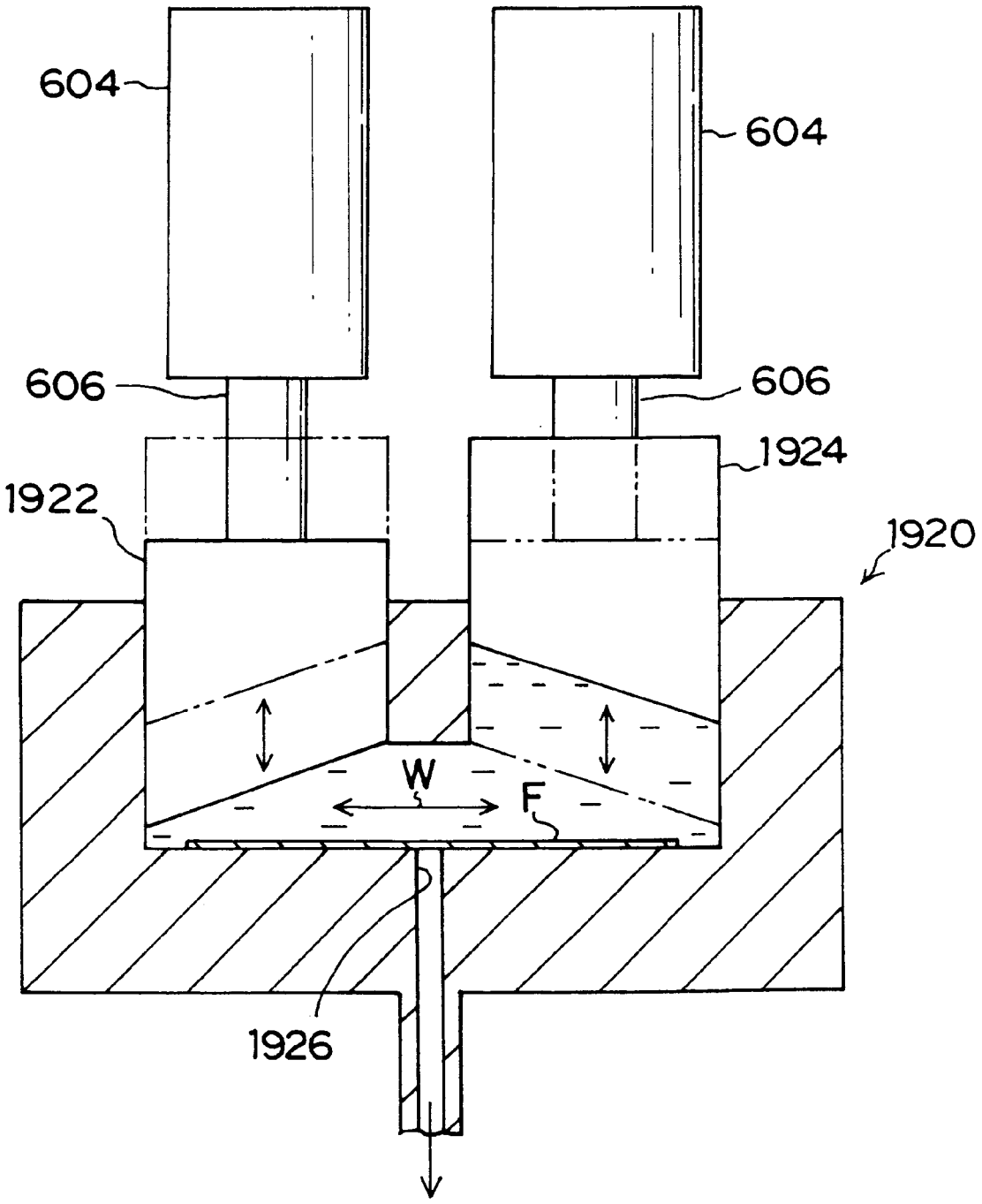
FIG. 34 is a cross-sectional view orthogonal to a longitudinal direction of a processing tank relating to a seventh embodiment.

As illustrated in FIG. 34, a piston 1922 and a piston 1924 are provided at a processing tank 1920 so as to be parallel to one another in the transverse direction. The piston 1922 and the piston 1924 are formed long along the longitudinal direction of the processing tank 1920 (the direction normal to the plane of the paper of FIG. 34). The cylinder rods 606 of the cylinders 604 are connected to the piston 1922 and the piston 1924.

The respective surfaces of the piston 1922 and the piston 1924 which oppose the film F are inclined as illustrated in FIG. 34. The pistons 1922, 1924 are moved alternately by the cylinders 604 such that when one of the piston 1922 and the piston 1924 approaches the film F, the other moves away from the film F. In this way, the processing solution is made to flow in the processing tank along the transverse direction of the film F (the directions of arrow W) such that the processing solution in the processing tank is stirred well and processing irregularities are prevented.

A suction hole 1926 may be provided at the side opposite the pistons so as to suck the film F to the inner wall surface when it seems that the film F in the processing tank may move in the transverse direction due to the processing solution flowing along the transverse direction of the film F. The suction hole 1926 may be connected to a piping at the suction side when the processing solution is circulated.

Eight Embodiment

An eighth embodiment of the present invention will be described hereinafter with reference to FIG. 35. Structures which are the same as those of the previously-described embodiments are denoted by the same reference numerals, and description thereof is omitted.

Figure 35:
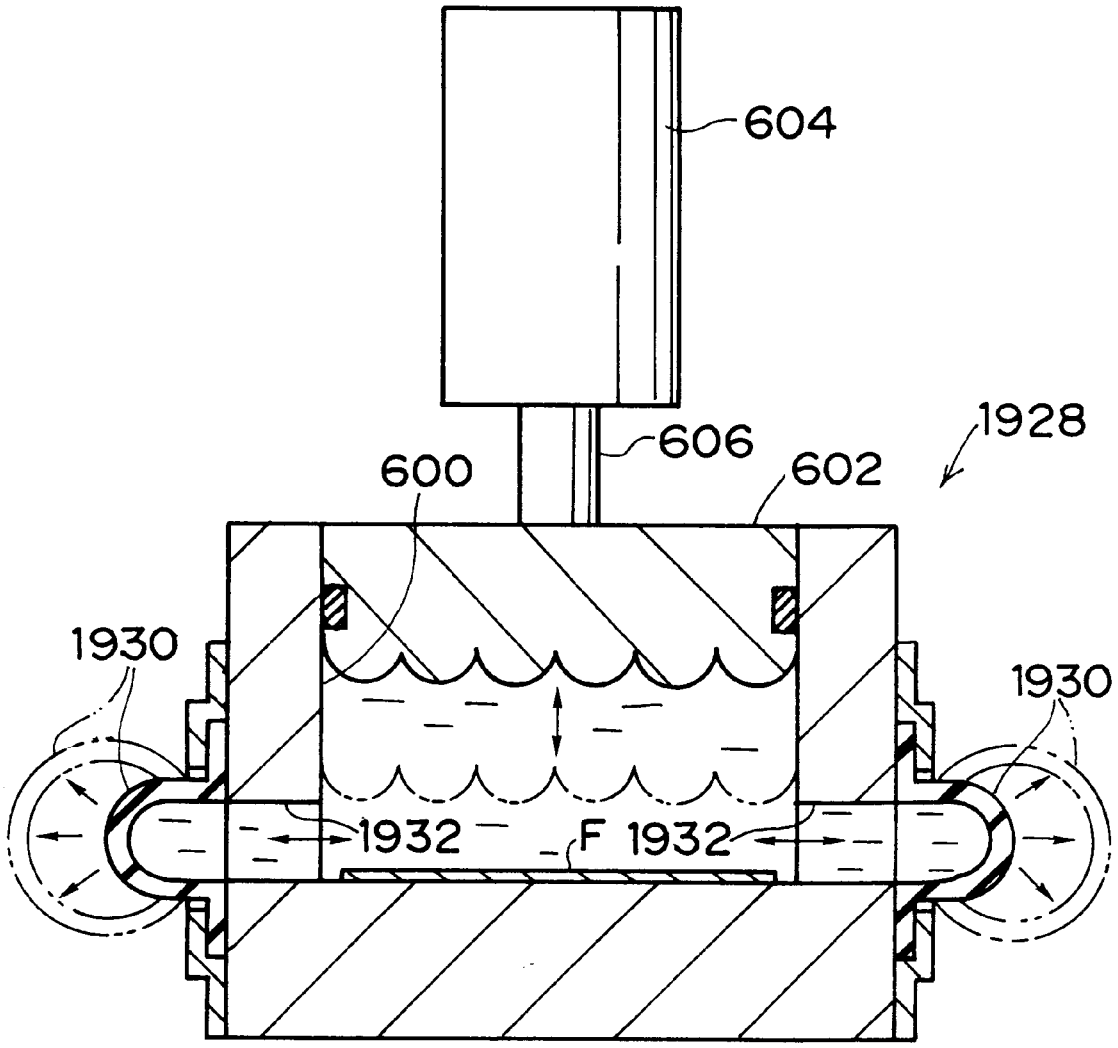
FIG. 35 is a cross-sectional view orthogonal to a longitudinal direction of a processing tank relating to an eighth embodiment.

As illustrated in FIG. 35, diaphragms 1930, which are expandable and contractible and are formed of an elastic material such as rubber, are mounted to the transverse direction side surfaces of a processing tank 1928. The portions at the interiors of the diaphragms 1930 communicate with the interior of the processing tank 1928 via communication holes 1932 formed in the side surfaces of the processing tank 1928.

In the present eighth embodiment, when the piston 602 moves in a direction of approaching the film F, the diaphragms 1930 swell as illustrated by the imaginary lines due to the increase in the internal pressure. The processing solution within the processing tank flows toward the diaphragms 1930. When the piston 602 moves in a direction of moving away from the film F, the diaphragms 1930 contract due to the decrease in the internal pressure, and the processing solution within the diaphragms 1930 flows into the processing tank.

In the present eighth embodiment, the processing solution is made to flow in the processing tank along the transverse direction of the film F due to the reciprocal movement of the piston 602. The processing solution is stirred well within the processing tank such that processing irregularities of the film F are prevented.

Ninth Embodiment

A ninth embodiment of the present invention will be described hereinafter with reference to FIGS. 36A and 36B. Structures which are the same as those of the previously-described embodiments are denoted by the same reference numerals, and description thereof is omitted.

Figure 36A:
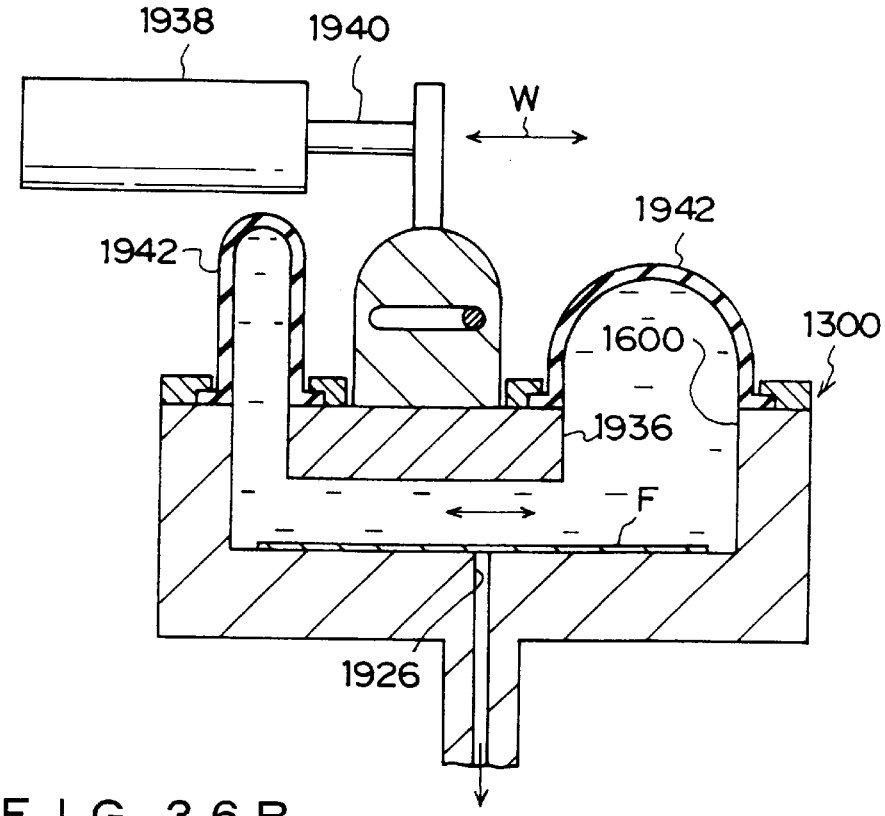
FIG. 36A and FIG. 36B are cross-sectional views orthogonal to a longitudinal direction of a processing tank relating to a ninth embodiment.
Figure 36B:
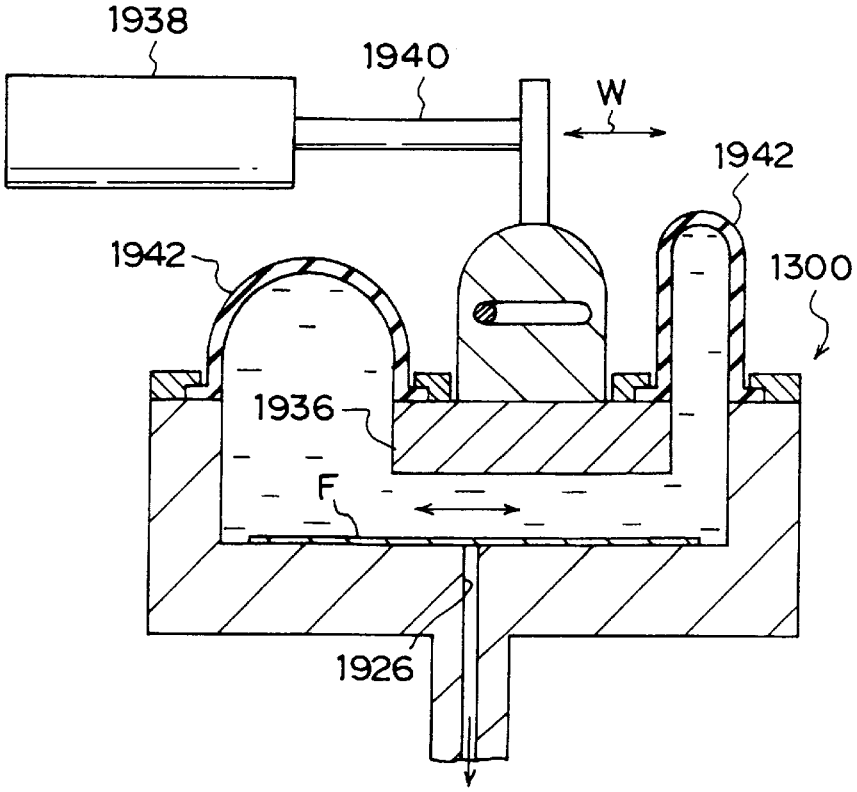

As illustrated in FIGS. 36A and 36B, a narrow movable wall 1936 is provided in a processing tank 1300.

A cylinder rod 1940 of a cylinder 1938, which is disposed along the transverse direction of the processing tank 1300 (the direction of arrow W), is connected to the movable wall 1936.

Diaphragms 1942 are connected to the movable wall 1936 and the processing tank 1300.

In the present ninth embodiment, as illustrated in FIGS. 36A and 36B, when the movable wall 1936 is moved along the transverse direction of the processing tank 1300 due to the cylinder 1938, the processing solution in the diaphragm 1942 at one transverse direction side is pushed out and flows toward the other diaphragm 1942. In this way, the processing solution within the processing tank is stirred well, and processing irregularities of the film F are prevented.

Tenth Embodiment

A tenth embodiment of the present invention will be described hereinafter with reference to FIGS. 37A and 37B. Structures which are the same as those of the previously-described embodiments are denoted by the same reference numerals, and description thereof is omitted.

Figure 37A:
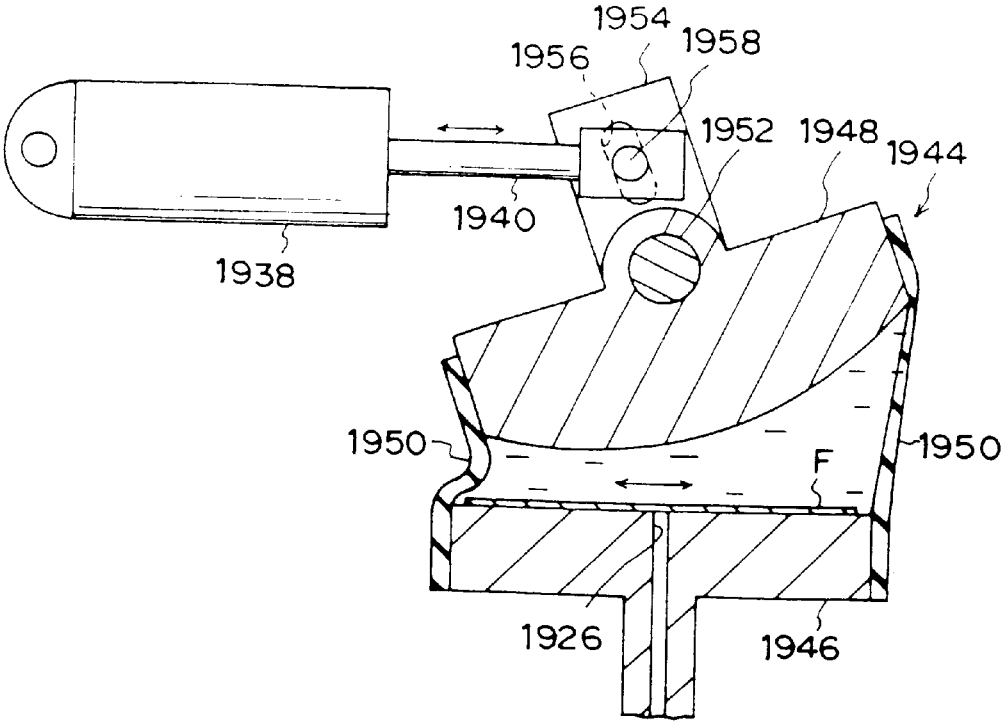
FIG. 37A and FIG. 37B are cross-sectional views orthogonal to a longitudinal direction of a processing tank relating to a tenth embodiment.
Figure 37B:
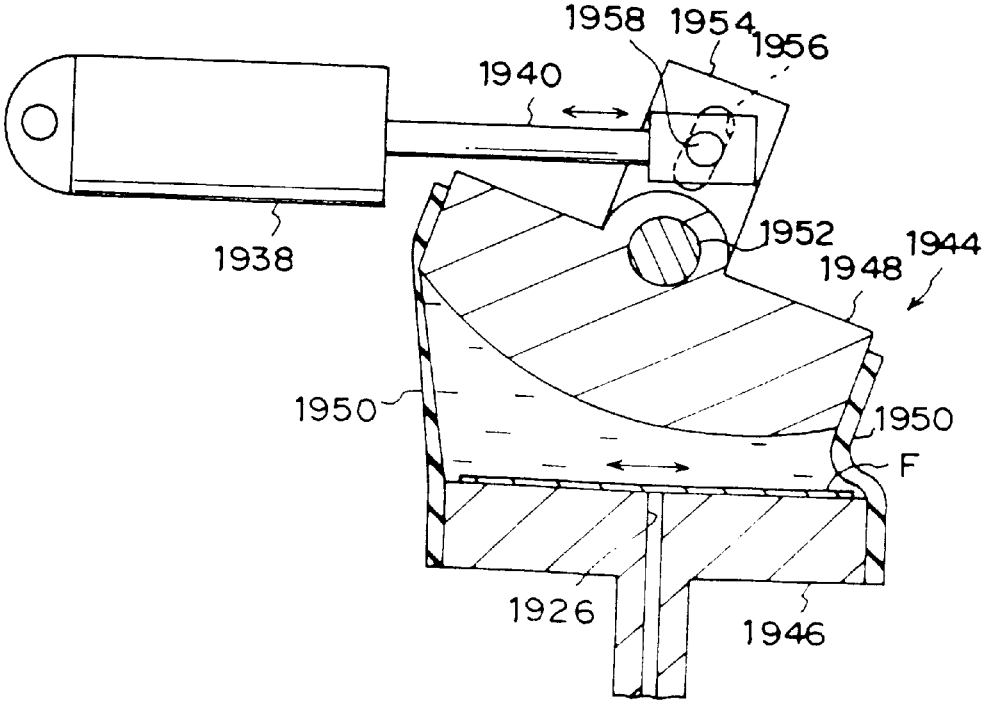

As illustrated in FIGS. 37A and 37B, the processing tank 1944 of the present tenth embodiment is formed from a fixed wall 1946, a movable wall 1948, and elastic membranes 1950. The movable wall 1948 is disposed at the side opposite the fixed wall 1946. The elastic membranes 1950 are formed from an elastic material such as rubber or the like and connect the fixed wall 1946 and the movable wall 1948.

The surface of the movable wall 1948 which surface opposes the fixed wall 1946 has a circular arc shaped cross-section. The movable wall 1948 is swingable about a fixed shaft 1952.

A projection 1954 is formed at the side of the movable wall 1948 which is at the side opposite to the fixed wall 1946. A pin 1958, which is mounted to the distal end of the cylinder rod 1940 of the cylinder 1938, is inserted in an elongated hole 1956 formed in the projection 1954.

In the present tenth embodiment, when the movable wall 1948 is swung by the cylinder 1938, the volume at one transverse direction side of the center of the film F increases and the volume at the other transverse direction side decreases, such that the processing solution flows along the transverse direction of the film F. In this way, the processing solution is stirred well in the processing tank, and processing irregularities of the film F are prevented.

Eleventh Embodiment

An eleventh embodiment of the present invention will be described hereinafter with reference to FIGS. 38A and 38B. Structures which are the same as those of the previously-described embodiments are denoted by the same reference numerals, and description thereof is omitted.

Figure 38A:
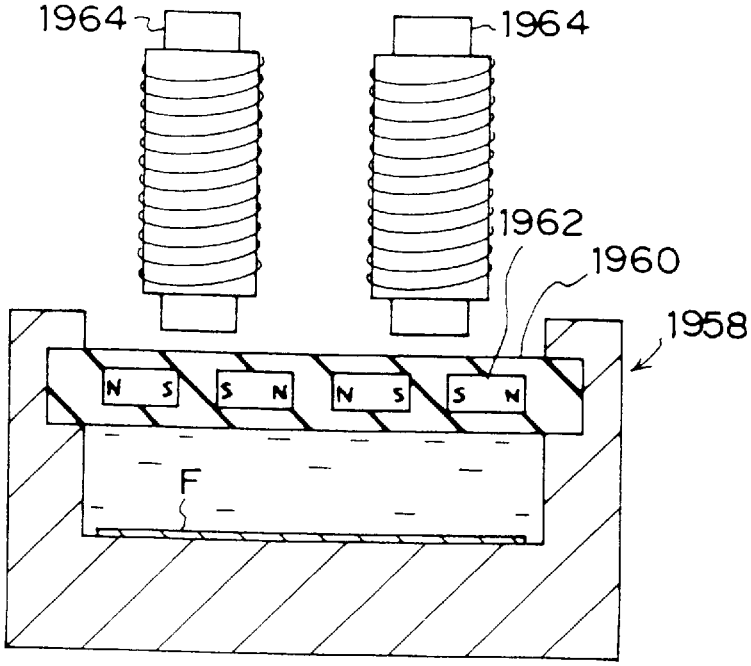
FIG. 38A and FIG. 38B are cross-sectional views orthogonal to a longitudinal direction of a processing tank relating to an eleventh embodiment.

As illustrated in FIG. 38A, one surface of a processing tank 1958 of the present eleventh embodiment is formed by an elastic wall 1960 which is formed from an elastic material such as rubber or the like.

A plurality of magnets 1962 are embedded within the elastic wall 1960.

A pair of electromagnets 1964, which generate an alternating magnetic field, are disposed at a position slightly removed from the elastic wall 1960.

Figure 38B:
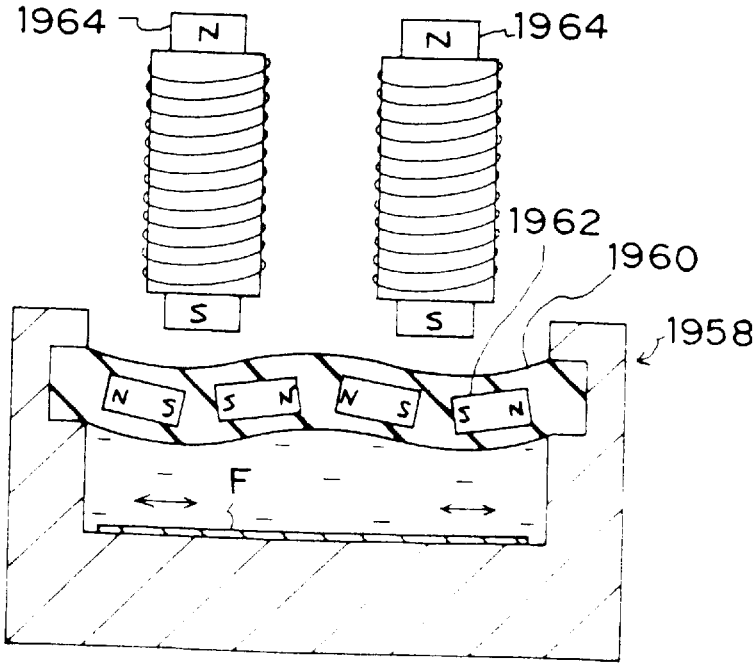

In the present eleventh embodiment, when the electromagnets 1964 generate an alternating magnetic field, as illustrated in FIG. 38B, the magnets 1962 are repelled and attracted, such that the elastic wall 1960 undulates and the processing solution flows along the transverse direction of the film F. In this way, the processing solution can be stirred well in the processing tank, and processing irregularities of the film F can be prevented.

Twelfth Embodiment

A twelfth embodiment of the present invention will be described hereinafter with reference to FIG. 39. Structures which are the same as those of the previously-described embodiments are denoted by the same reference numerals, and description thereof is omitted.

Figure 39:
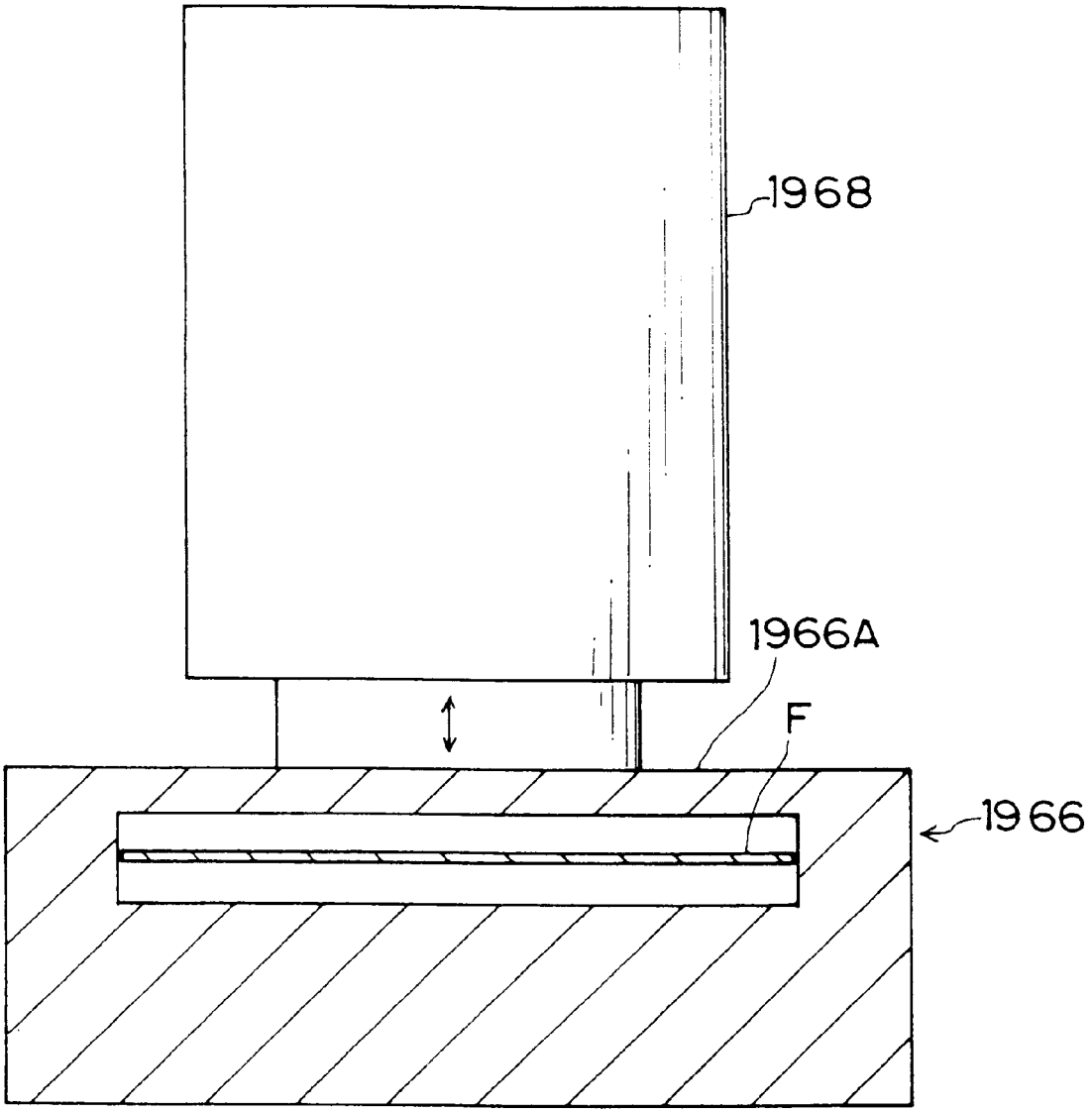
FIG. 39 is a cross-sectional view orthogonal to a longitudinal direction of a processing tank relating to a twelfth embodiment.

As illustrated in FIG. 39, a processing tank 1966 of the present twelfth embodiment is formed of a synthetic resin or the like, and one surface thereof is formed thin so as to be elastically deformable. A vibrator 1968 is fixed to a thin portion 1966A of the processing tank 1966.

In the present twelfth embodiment, the thin portion 1966A of the processing tank 1966 is vibrated by the vibrator 1968 so as to stir the processing solution.

Any of various devices can be used as the vibrator 1968. For example, a piezoelectric element which generates ultrasonic vibrations can be used.

Further, in a processing tank in which the film F is not attracted to an inner wall, the cross-sectional configuration of the portion opposing the transverse direction central portion of the film F may be curved in a concave shape. In this way, damage to the image forming portions of the film F can be prevented.

Thirteenth Embodiment

A thirteenth embodiment of the present invention will be described hereinafter with reference to FIGS. 40 through 50. Structures which are the same as those of the previously-described embodiments are denoted by the same reference numerals, and description thereof is omitted.

Figure 40:
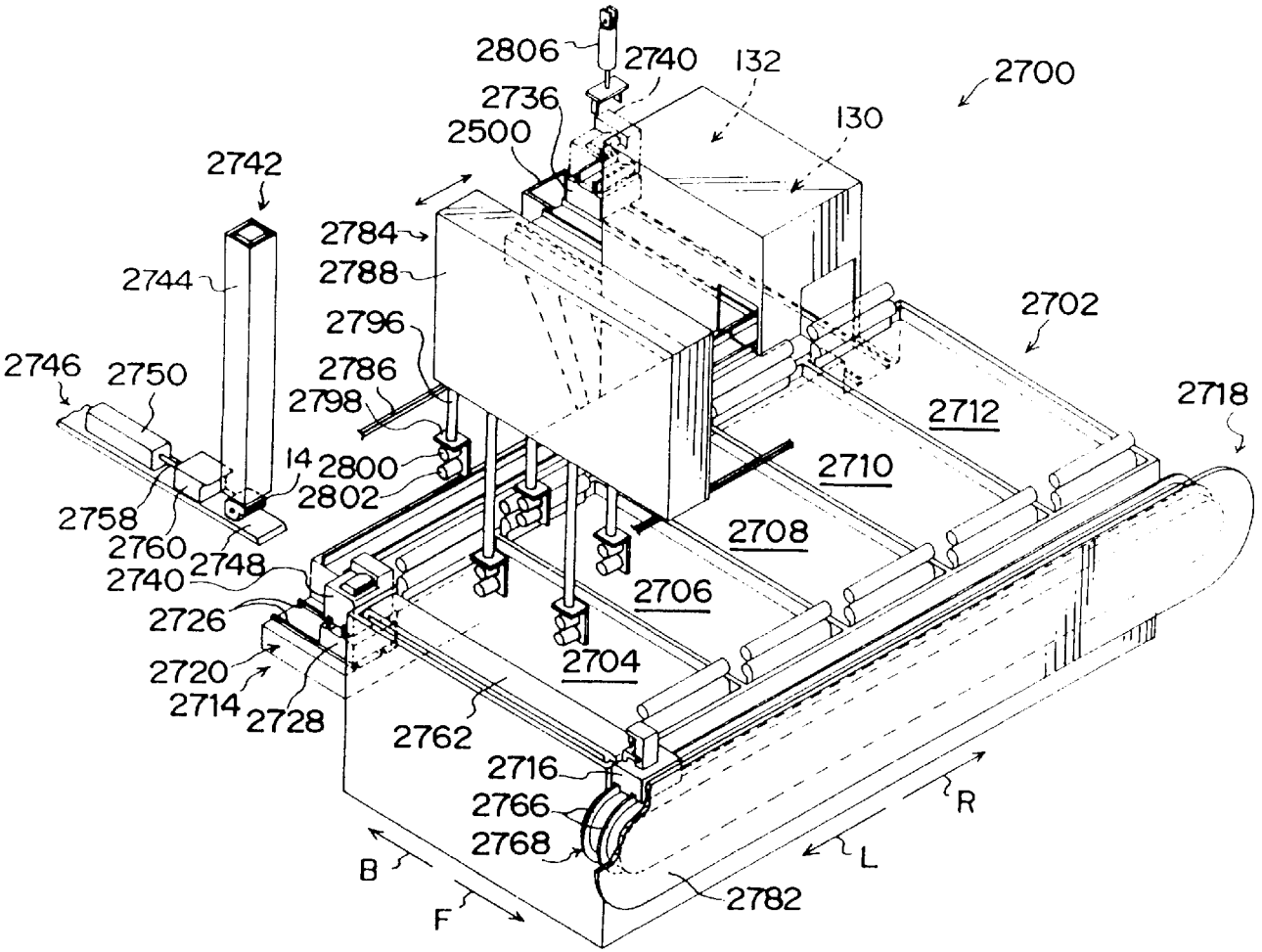
FIG. 40 is a perspective view illustrating an internal structure of a printer processor relating to thirteenth embodiment.

As illustrated in FIG. 40, a color developing processing tank 2704 which stores color developing solution, a bleaching processing tank 2706 which stores bleaching solution, a bleaching/fixing processing tank 2708 which stores bleaching/fixing solution, a rinse solution tank 2710 which stores rinse solution, and a stabilizing processing tank 2712 which stores stabilizing solution are disposed in that order in the direction of arrow R in a developing processing section 2702 of a printer processor 2700 of the present thirteenth embodiment.

A station traveling path 2714 is provided at the arrow B direction side of the processing tanks. A catching station traveling path 2718 of a catching station 2716 which will be described later is provided at the arrow F direction side of the processing tanks.

Figure 41:
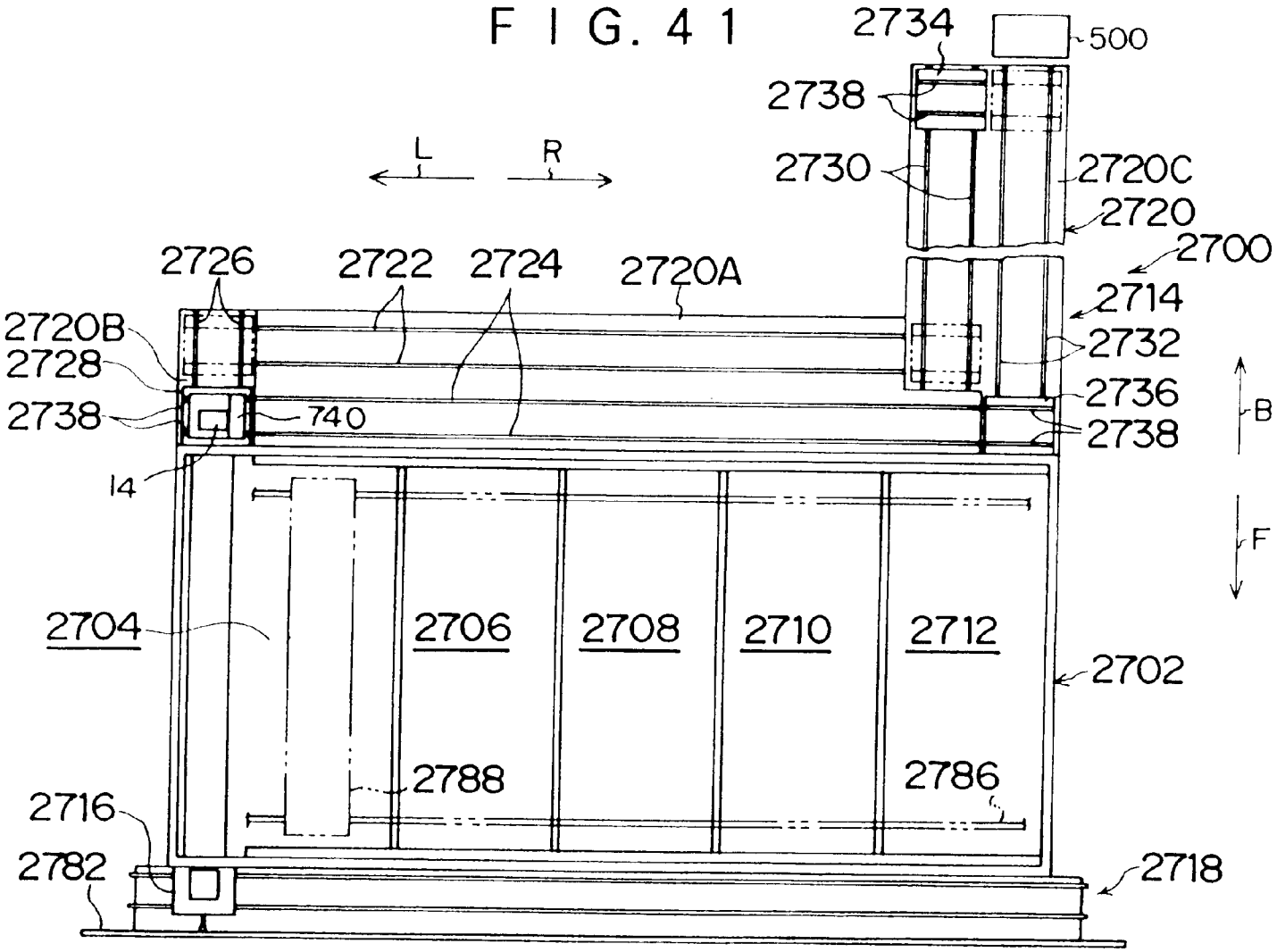
FIG. 41 is a plan view illustrating processing tanks, stations and a traveling system of a catching station.
Figure 42:
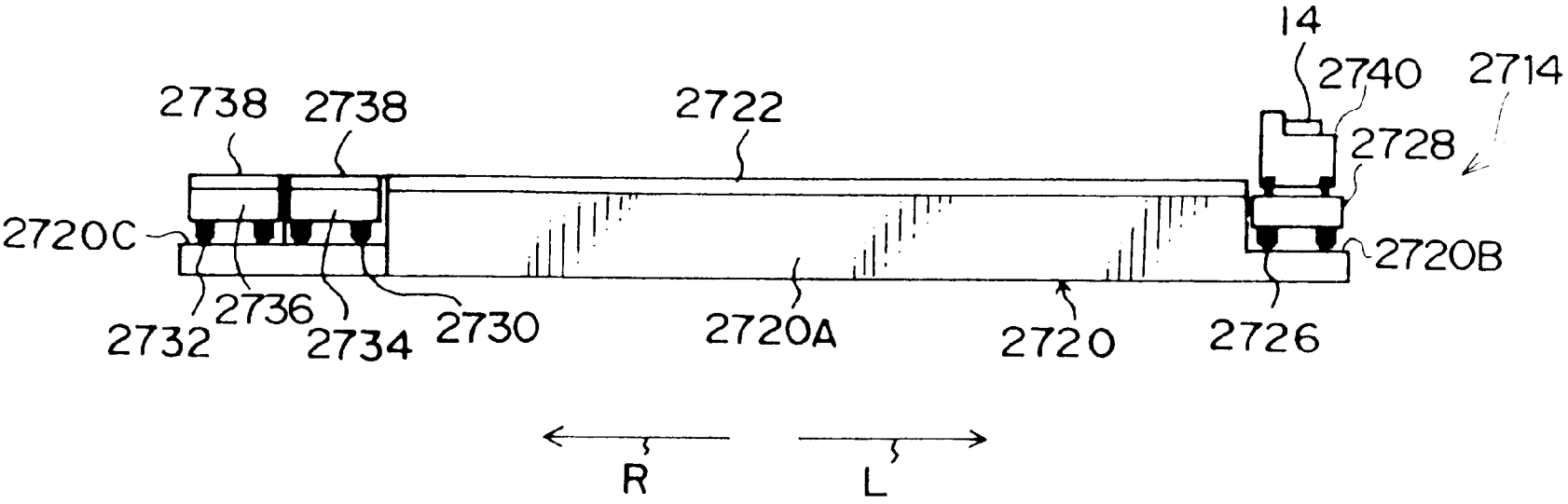
FIG. 42 is a side view of a station traveling path.

As illustrated in FIGS. 41 and 42, the station traveling path 2714 has a substantially L-shaped base 2720. A pair of rails 2722 and a pair of rails 2724, which extend along the direction of arrow R and the direction of arrow L, are disposed parallel at a linear portion 2720A of the base 2720.

The arrow L direction side end portion of the base 2720 is stepped down, and a pair of rails 2726 extending along the direction of arrow B and the direction of arrow F are disposed at this stepped portion 2720B of the base 2720. A wagon 2728 which is made to travel by an unillustrated motor is provided on the rails 2726.

The arrow R direction side end portion of the base 2720 is also stepped down, and a pair of rails 2730 and a pair of rails 2732, which extend along the direction of arrow B and the direction of arrow F, are disposed at this stepped portion 2720C of the base 2720. A wagon 2734 which is made to travel by an unillustrated motor is provided on the rails 2730, whereas a wagon 2736 which is made to travel by an unillustrated motor is provided on the rails 2732.

Figure 43:
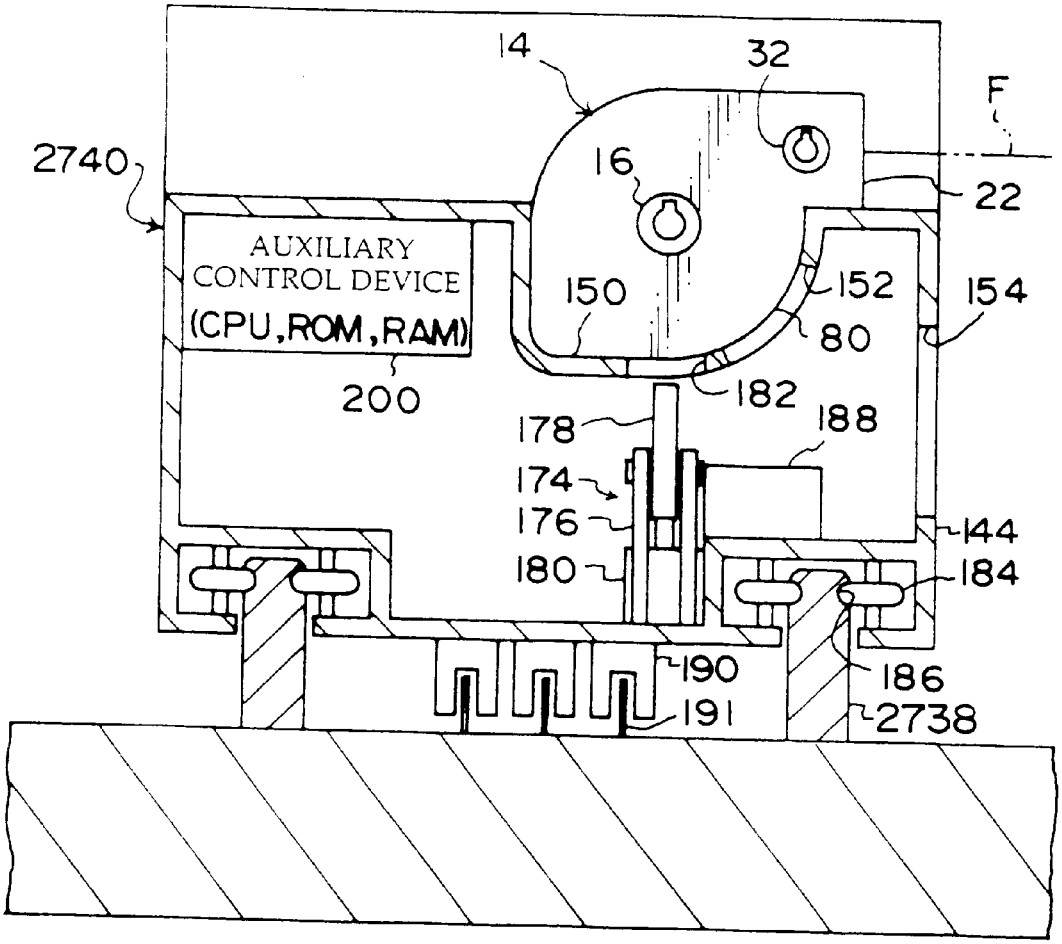
FIG. 43 is a cross-sectional view of a side surface side of the station relating to the thirteenth embodiment.
Figure 44:
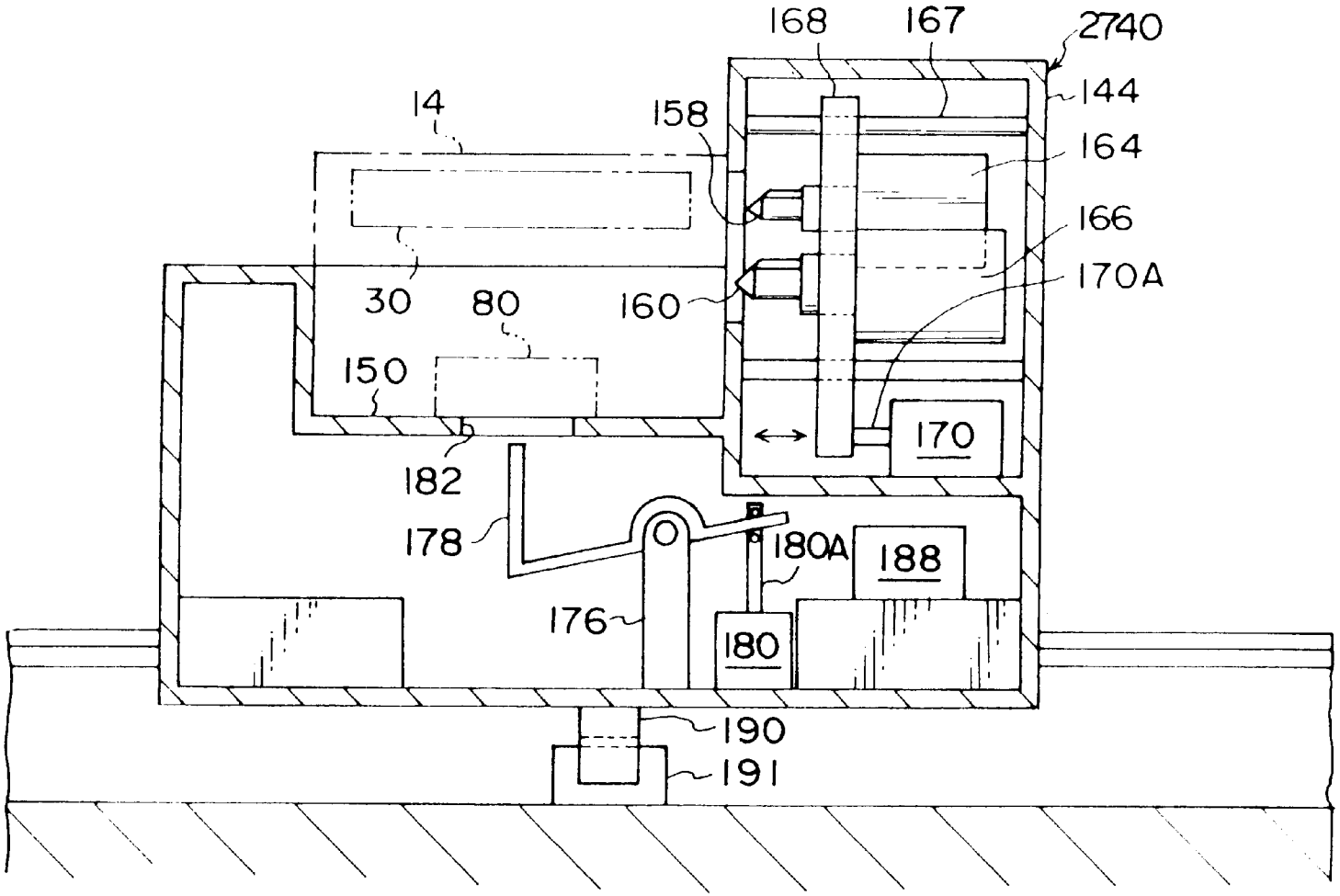
FIG. 44 is a cross-sectional view of a front surface side of the station relating to the thirteenth embodiment.

A pair of rails 2738, which are set at the same height as the rails 2722 and the rails 2724, are disposed on the top surfaces of the wagons 2728, 2734 and 2736. A station 2740 illustrated in FIGS. 43 and 44 can travel on the rails 2722, 2724, 2738. The station 2740 of the present thirteenth embodiment illustrated in FIGS. 43 and 44 is a structure in which the cover 148 is removed from the station 110 of the first embodiment and the running direction is changed by 90 degrees.

Figure 45:
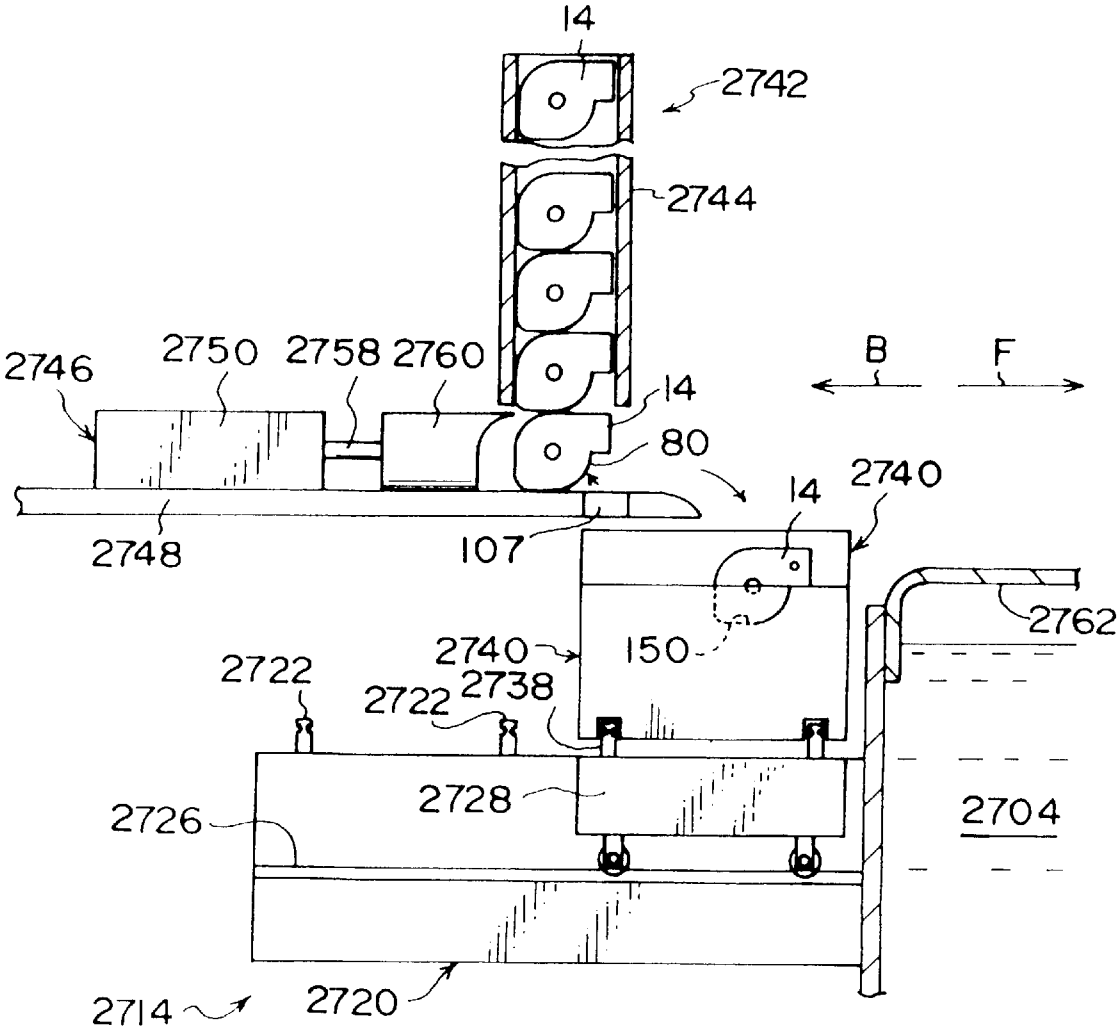
FIG. 45 is a side view of a cartridge loading device.

Accordingly, for example, as illustrated in FIG. 45, when the wagon 2728 on which the station 2740 is loaded is positioned at the arrow L direction end portion of the rails 2724, the rails 2738 of the wagon 2728 and the rails 2724 of the base 2720 are aligned in a straight line, and the station 2740 of the wagon 2728 can move over onto the rails 2724 of the base 2720.

The auxiliary control device 200 of the station 2740 and a main control device (unillustrated) transmit and receive radio signals to and from each other. The motor is rotated by a battery (unillustrated) provided in the station 2740. Further, the running of the wagons 2728, 2734, 2736 is controlled by the unillustrated main control device.

As illustrated in FIGS. 40 and 45, a cartridge loading device 2742 is disposed above the arrow L direction end portion of the base 2720.

The cartridge loading device 2742 is provided with a cartridge loading tube 2744 in which cartridges 14 are accommodated vertically. The cartridges 14 are dropped in from a top portion opening of the cartridge loading tube 2744.

A cartridge push-out mechanism 2746 is disposed at the lower side of the cartridge loading tube 2744. The cartridge pushout mechanism 2746 is formed from a base 2748 which is disposed horizontally and a cylinder device 2750 which is disposed on the base 2748.

A push-out block 2760 which pushes out the cartridges 14 is mounted to the distal end of a cylinder rod 2758 of the cylinder device 2750. When the push-out block 2760 is moved in the direction of arrow F, the cartridge 14 on the base drops down from the end portion of the base 2748 so as to be loaded in the concave portion 150 of the station 2740 waiting below. After the cartridge 14 has been pushed out, when the push-out block 2760 is pulled back, a cartridge 14 drops down onto the base from the cartridge loading tube 2744.

In the present thirteenth embodiment, the bar code scanner 107 which reads the bar code 80 of the cartridge 14 is provided at the base 2748.

Figure 46:
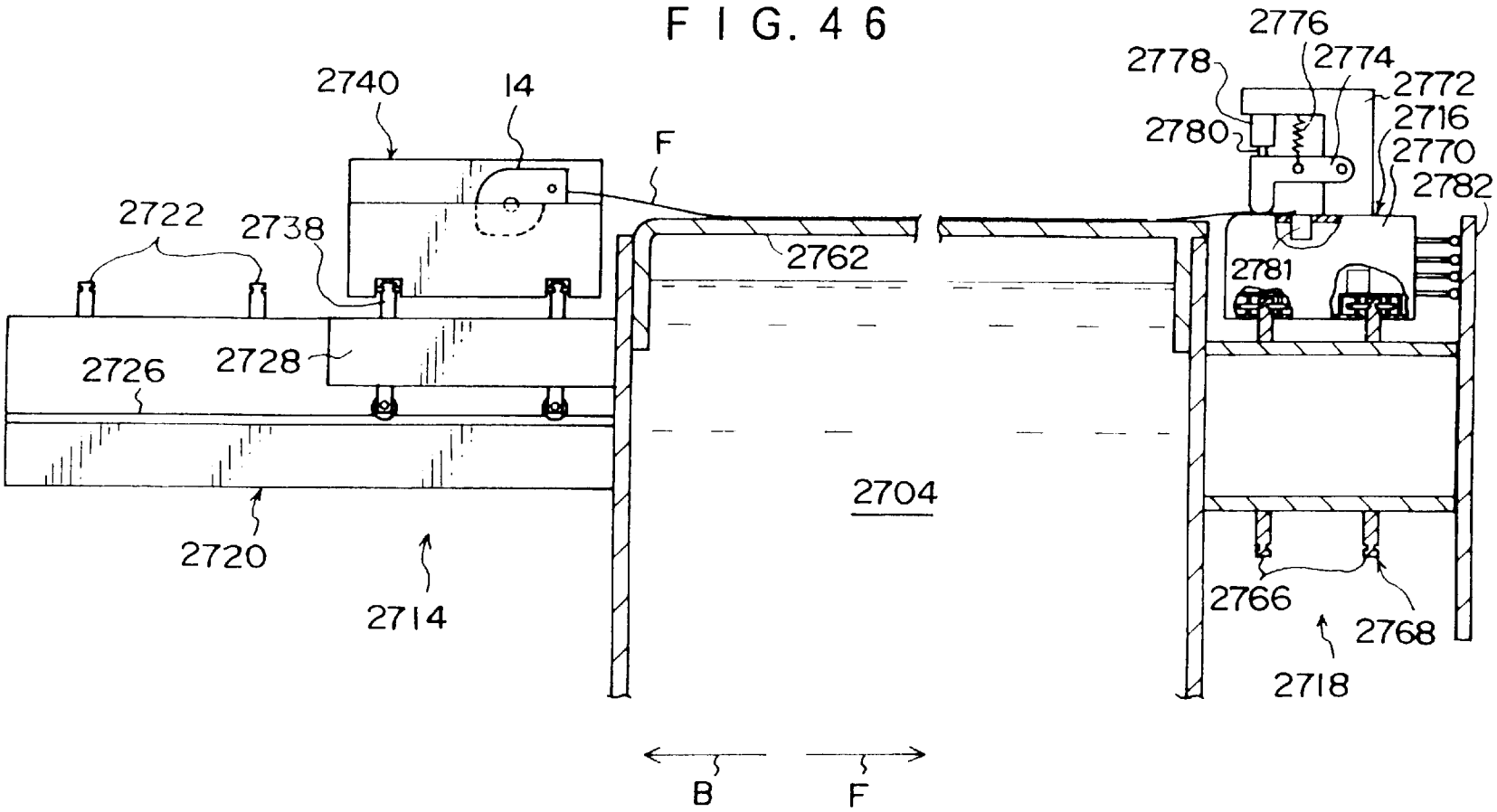
FIG. 46 is a side view illustrating a state in which a station and a catching station hold a film.

As illustrated in FIGS. 40 and 46, a plate-shaped film guide 2762, which supports the bottom surface of the film F, is suspended at the top portion of the color developing processing tank 704 at the arrow F direction side of the rails 2726. When a film F is fed out from the cartridge 14 positioned at the end portion of the film guide 2762, the film F slides on the film guide 2762 toward the arrow F direction side.

Figure 47:
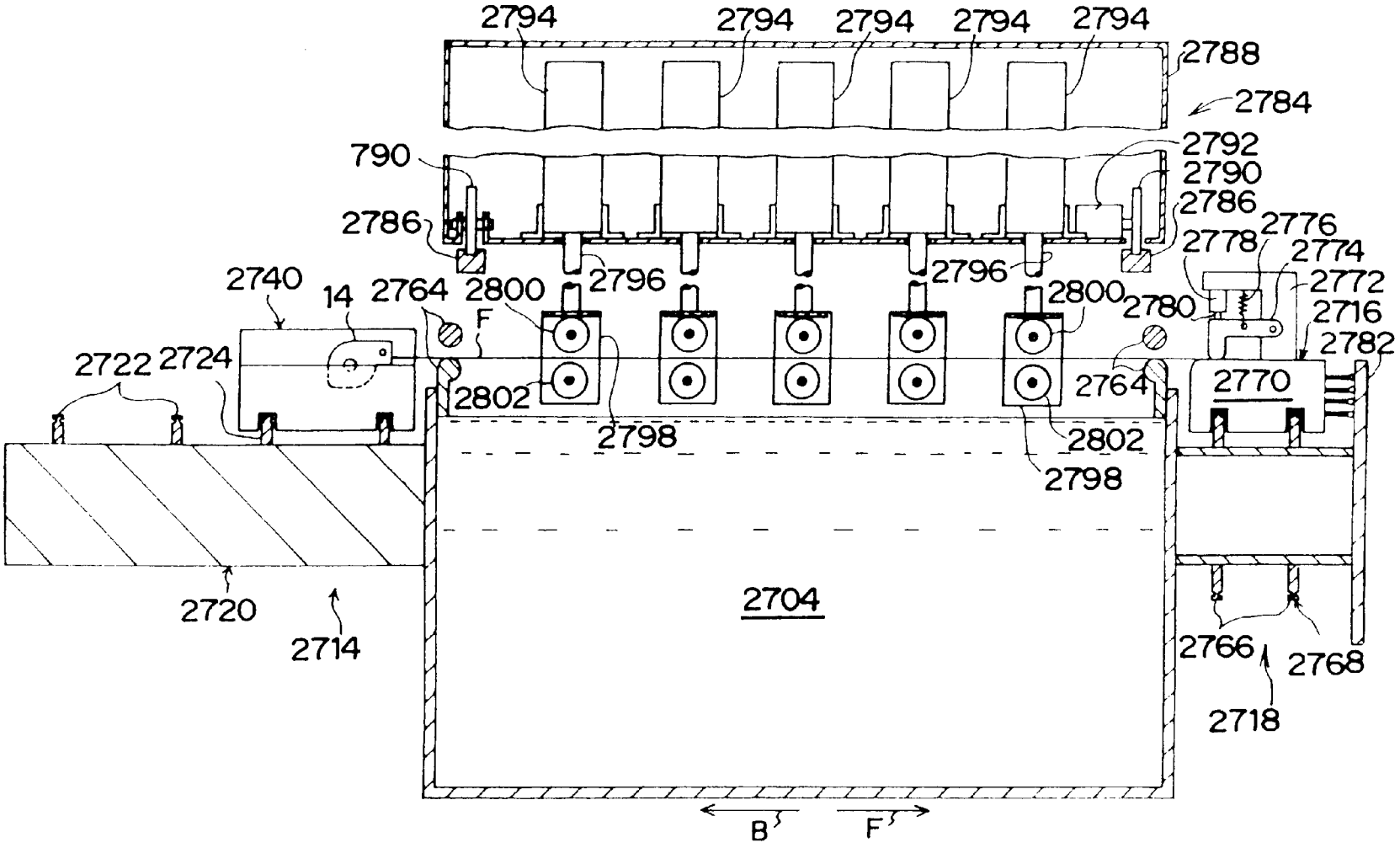
FIG. 47 is a cross-sectional view illustrating a state in which a film is inserted between rollers of an immersing device.

As shown in FIGS. 40 and 47, a pair (a top and a bottom) of cylindrical rods 2764 which guide the film F are mounted to the top edge portion of each processing tank. A gap through which the film F can be inserted is provided between the cylindrical rod 2764 and the cylindrical rod 2764. The cylindrical rods 2764 may be replaced by rotatable rollers.

As shown in FIGS. 40 and 46, the catching station traveling path 2718 is provided at the arrow F direction side of the processing tanks.

The catching station traveling path 2718 includes an endless locus 2768 formed by a pair of rails 2766 which extend along the direction of arrow L and the direction of arrow R.

The catching station 2716, which engages with the rails 2766 and travels thereon, is disposed at the endless locus 2768.

The catching station 2716 has a box-shaped main body 2770. A substantially L-shaped supporting pillar 2772 is mounted to the surface of the main body 2770 at the side opposite the rails 2766. An L-shaped lever 2774 is mounted swingably at the intermediate portion of the supporting pillar 2772. The film F is nipped between the distal end of the lever 2774 and the main body 2770. Usually, the lever 2774 is urged by a spring 2776, which is mounted to the supporting pillar 2772, in a direction in which the distal end of the lever 2774 moves apart from the film F. When the film F is to be nipped, a movable core 2780 of a solenoid 2778 mounted to the distal end of the supporting pillar 2772 urges the distal end of the lever 2774 toward the main body 2770.

A sensor 2781 for detecting the film F, wheels which engage with the rails 2766, motors (not shown) which rotate the wheels, an auxiliary control device (not shown) which controls these motors and the solenoid 2778 and the like, are provided at the main body 2770.

The inputting/outputting of control signals and the input of the power source are carried through a power source line 2782 which is provided along the endless locus 2768. Further, when the sensor 2781 detects the film F (i.e., the leading end of the film F), the detection signal is sent to the unillustrated main control device via the power source line 2782.

As shown in FIGS. 40 and 47, an immersing device 2784, which immerses the film F fed out from the cartridge 14 in the processing solutions in the processing tanks, is disposed above the processing tanks.

The immersing device 2784 is formed by a pair of rails 2786, which extend along the direction of arrow R and the direction of arrow L, and a hanger 2788 which travels on the rails 2786.

Wheels 2790 which engage with the rails 2786 are provided at the hanger 2788. One of the wheels 2790 is rotated by a motor 2792.

Seven cylinders 2794, which are disposed along the vertical direction, are provided in the hanger 2788 so as to be aligned along the direction of arrow B and the direction of arrow F.

Cylinder rods 2796 of the respective cylinders 2794 are directed downward. Pairs of rollers which are respectively an upper roller 2800 and a lower roller 2802 are mounted so as to be freely rotatable to blocks 2798 which are mounted to the respective distal ends of the cylinder rods 2796. The roller 2800 and the roller 2802 are separated by a predetermined dimension, and the film F can be inserted into this gap between the rollers from the axial direction (the side) of the rollers. The cylinders 2794 are controlled independently by the unillustrated main control device. The motor 2792 is also controlled by the unillustrated main control device.

Figure 48:
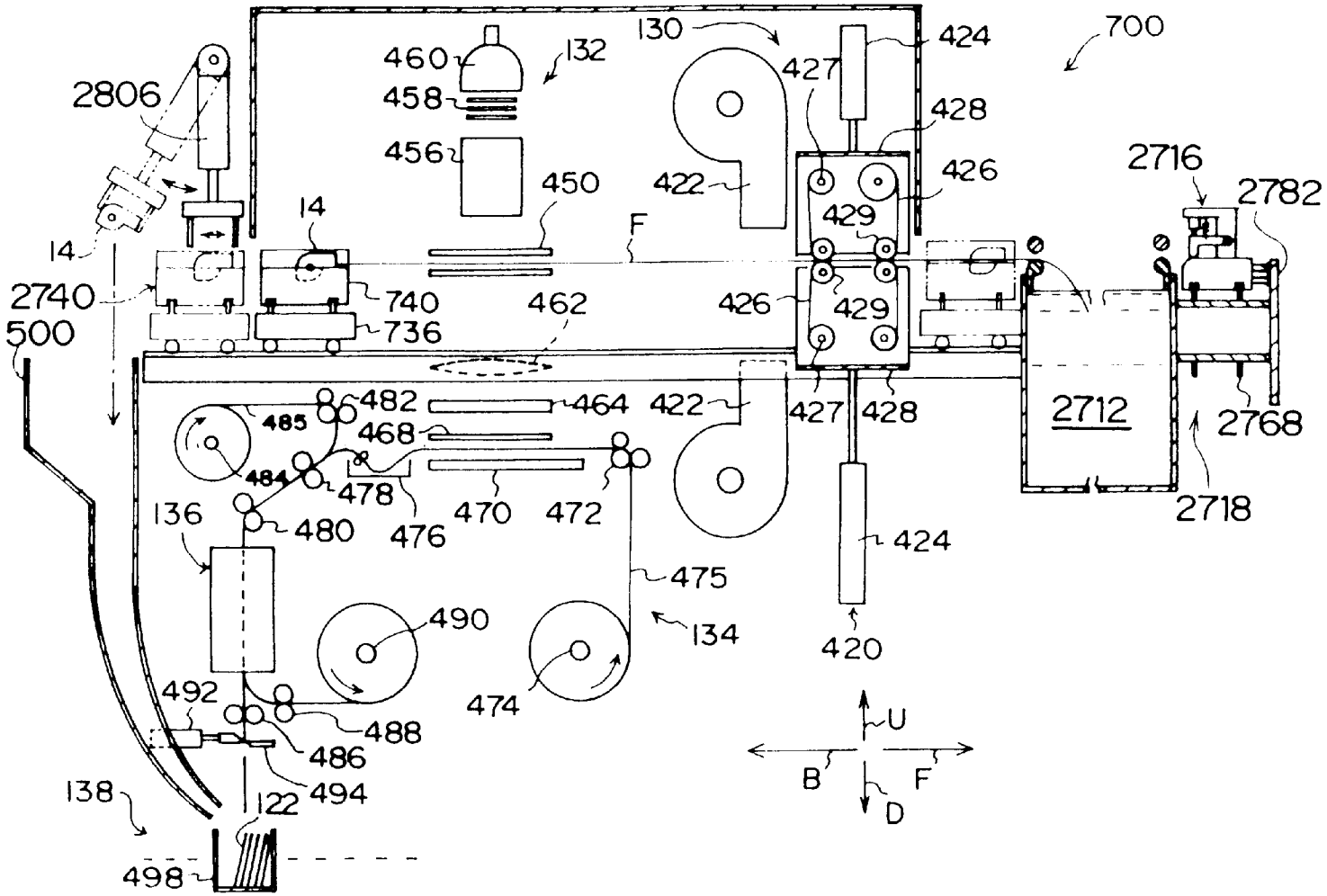
FIG. 48 is a side view illustrating the arrangement of a drying section, an exposure section, a paper conveying device, a heat developing transfer section, and a print conveying device.

As shown in FIG. 48, the drying section 130, the exposure section 132, the paper conveying device 134, the heat developing transfer section 136 and the print conveying device 138 are provided at the arrow B direction side of the stabilizing processing tank 2712.

A magic hand 2806 is provided at the arrow B direction side of the exposure section 132. The magic hand 2806 removes the cartridge 14 loaded in the station 2740 and places the cartridge 14 in the duct 500 disposed at the arrow B direction side end portion.

In the same way as in the previously-described embodiments, the cartridge 14 which is discharged from the bottom end of the duct 500 drops down into a predetermined basket 498 of the print conveying device 138.

Next, operation of the present thirteenth embodiment will be described.

First, the cartridge 14 which is to be subjected to developing processing is dropped in from the top portion opening of the cartridge loading tube 2744, and stands by.

The bar code 80 of the cartridge 14 positioned on the base 2748 is read by the bar code scanner 107.

Thereafter, the cartridge 14 is pushed out in the direction of arrow F by the cartridge push-out mechanism 2746, and is loaded into the concave portion 150 of the station 2740 standing by at the arrow F direction side of the base 2748 (see FIG. 45).

Next, the catching device 162 of the station 2740 is operated. The door driver 158 engages with the key hole 34 of the door shaft 32, and the spool driver 160 engages with the key hole 62 of the spool shaft 16. Thereafter, the motor 164 is rotated, and the door 30 is opened. Thereafter, the spool driver 160 is rotated, and the film F is fed out from the insertion opening 28 of the cartridge 14.

The film F which has been fed out from the cartridge 14 slides on the film guide 2762 toward the arrow F direction side as illustrated in FIG. 46.

The catching station 2716 is standing by ahead of the film F. When the leading end of the film F is detected by the sensor 2781 of the catching station 2716, the feeding of the film F is stopped, the solenoid 2778 is operated, and the leading end of the film F is nipped between the distal end of the lever 2774 and the main body 2770. At this time, there is film F remaining within the cartridge 14.

Next, the hanger 2788 is moved to above the arrow R direction side of the film guide 2762, the respective cylinders 2794 of the hanger 2788 are operated, and the blocks 2798 are aligned in a straight line at the arrow R direction side of the film guide 2762. Thereafter, the station 2740, which supports the film F, and the catching station 2716 simultaneously move a predetermined distance in the direction of arrow R, and the film F is inserted between the rollers 2800 and the rollers 2802 (see FIG. 47).

Next, the film F is further fed out from the cartridge 14 and the respective cylinders 2794 are operated. The blocks 2798 supporting the intermediate portion of the film F are lowered alternately as illustrated by the solid lines in FIG. 49. In this way, the image forming portions of the film F are immersed in the color developing processing solution, and color developing processing is carried out.

Figure 49:
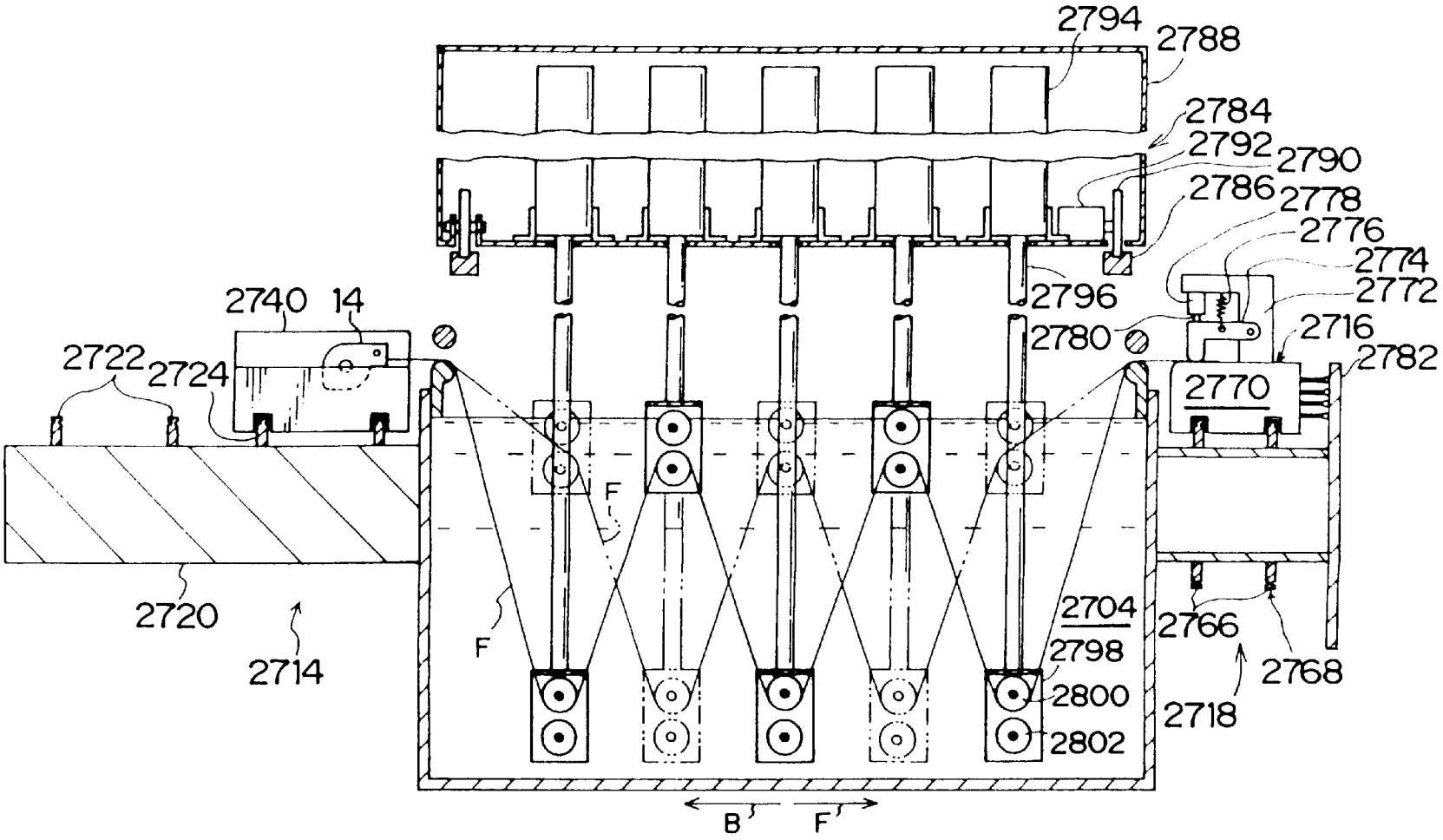
FIG. 49 is a cross-sectional view illustrating a state in which a film is immersed.

During color developing processing, the blocks 2798 may alternately be raised and lowered as illustrated by the solid lines and the imaginary lines in FIG. 49. In this way, by swinging the film F during color developing processing, the solution can be stirred, and processing irregularities can be prevented.

Figure 50:
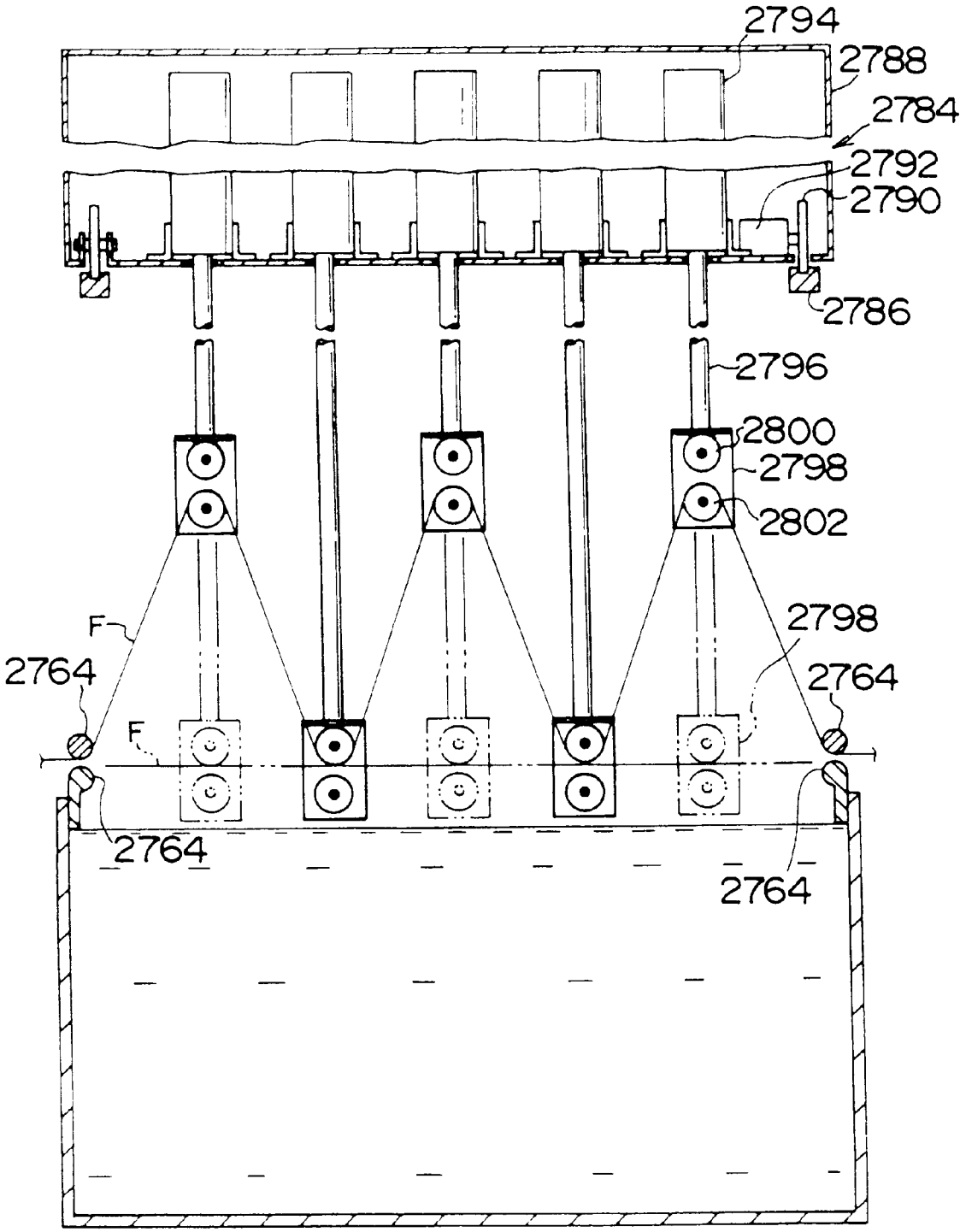
FIG. 50 is a cross-sectional view illustrating a state in which a film is pulled up.

When color developing processing is completed after a predetermined period of time passes, as illustrated by the solid lines in FIG. 50, the blocks 2798 are moved upward so that the film F is pulled up and out of the color developing processing tank 2704.

When the film F is pulled up, the station 2740, the catching station 2716, and the hanger 2788 are simultaneously moved in the direction of arrow R and are stopped above the bleaching processing tank 2706. Thereafter, the blocks 2798 are lowered alternately, and bleaching processing is carried out. In the same way, bleaching/fixing processing, rinsing processing, and stabilizing processing of the film F are carried out.

Stabilizing processing is carried out with the station 2740 having been moved onto the wagon 2736 which is standing by at the arrow F direction side of the rails 2732.

When stabilizing processing has been completed, the blocks 2798 are raised up in the state of being disposed in alternating positions (see FIG. 50), and the film F is pulled up.

Thereafter, the distal end of the lever 2774 of the catching station 2716 separates from the main body 2770, and the leading end of the film F is released. Next, the wagon 2736 on which the station 2740 is loaded is moved at a predetermined speed in the direction of arrow B, and as shown by the imaginary lines in FIG. 50, the blocks 2798 are aligned in a straight line. The film F is moved to the drying section 130, and drying processing is carried out.

When the wagon 2736 on which the station 2740 is loaded is stopped at the arrow B direction side end portion, the film F is wound bit-by-bit by a predetermined amount each time, and exposure is carried out. The cut prints 122 fall into the basket 498 in the same way as in the previously-described embodiments.

When printing is completed, the spool driver 160 is rotated, the film F is completely wound onto the spool shaft 16 of the cartridge 14, and the door 30 is closed. When the door 30 is closed, the energizing of the solenoid 170 is stopped, and the respective distal ends of the door driver 158 and the spool driver 160 move apart from the cartridge 14.

Thereafter, the magic hand 2806 is operated, the cartridge 14 is dropped into the duct 500, and the cartridge 14 falls down into the basket 498 in which the prints 122 have been placed.

The station 2740, from which the cartridge 14 has been removed and which is now empty, moves onto the wagon 2734 (illustrated by the solid line in FIG. 41) standing by at the arrow L direction side. The wagon 2734 in which the station 2740 is loaded moves in the direction of arrow F so that the station 2740 is positioned at the end portion of the rails 2722 as illustrated by the imaginary lines in FIG. 41.

Thereafter, the station 2740 moves onto the rails 2722, travels in the direction of arrow L, and moves onto the wagon 2728 standing by at the end portion of the rails 2722. Thereafter, the wagon 2728 on which the station 2740 is loaded is moved in the direction of arrow F, and stands by until the next cartridge 14 is loaded therein.

In the present embodiment as well, because the film F is not separated from the cartridge 14 from developing through the completion of the prints, there is no need for devices for separating and joining the film F, and the structure of the apparatus does not become complex.

Fourteenth Embodiment

A fourteenth embodiment of the present invention will be described hereinafter with reference to FIGS. 51 through 53. Structures which are the same as those of the previously-described embodiments are denoted by the same reference numerals, and description thereof is omitted.

Figure 51:
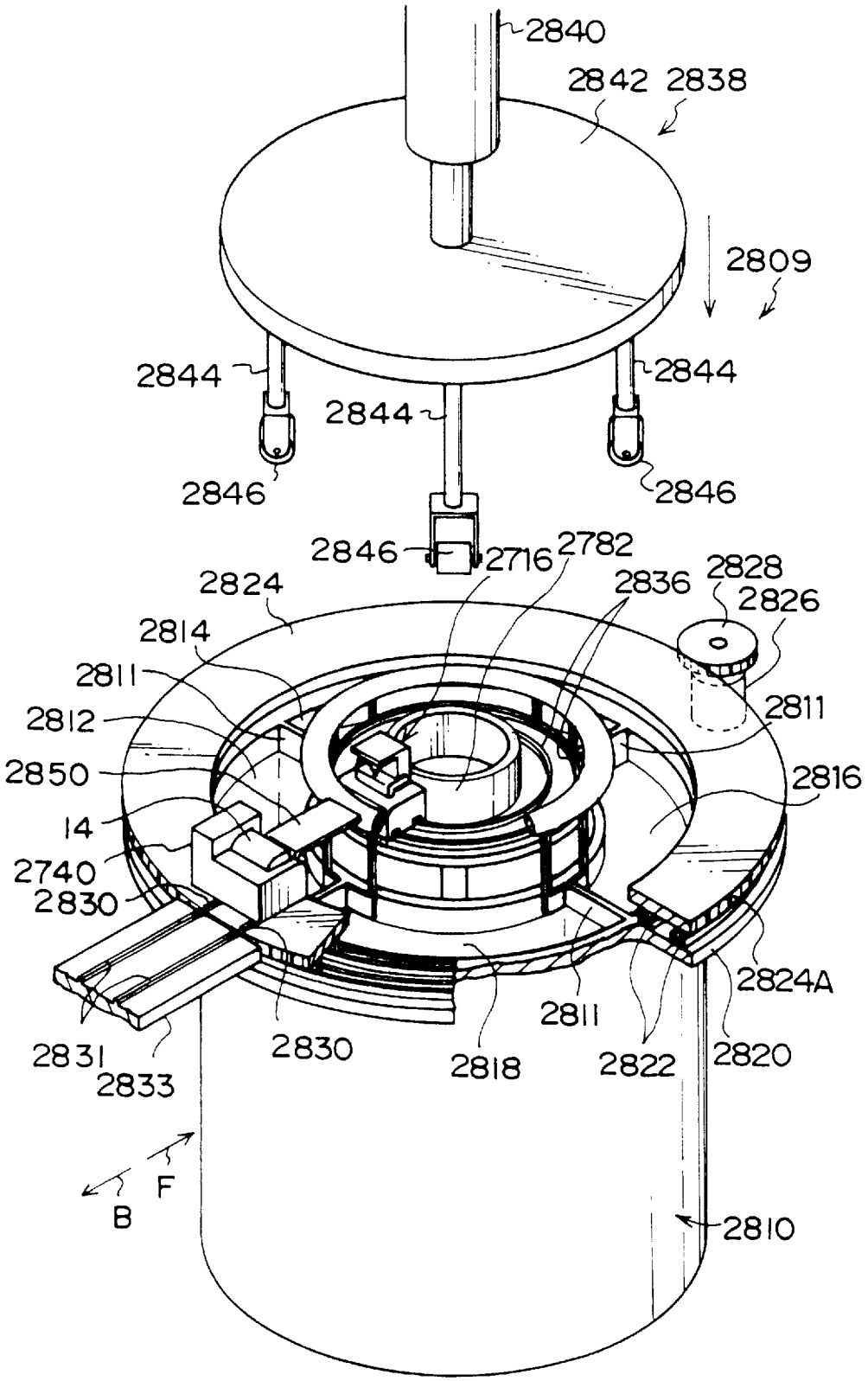
FIG. 51 is a perspective view of a vicinity of a processing tank of a printer processor relating to a fourteenth embodiment.

As illustrated in FIG. 51, a developing processing section 2809 of the present fourteenth embodiment includes a cylindrical processing tank 2810. The processing tank 2810 is divided into the following four sections in the peripheral direction in the following order by partitioning walls 2811: a color developing processing tank 2812, a bleaching processing tank 2814, a bleaching/fixing processing tank 2816, and a rinse processing tank 2818.

A flange 2820 is formed at the outer peripheral side of the upper edge of the processing tank 2810. A pair of rails 2822, which extend along the peripheral direction, are disposed at the top surface of the flange 2820.

An annular rotating base 2824 is disposed so as to travel rotatably on the rails 2822. A gear 2824A is formed at the outer peripheral surface of the rotating base 2824. A small gear 2828 rotated by a motor 2826 meshes will the gear 2824A.

A pair of rails 2830, which extend along the radial direction such that the station 2740 can travel thereon, are provided on the top surface of the rotating base 2824.

A base 2833, which has a pair of rails 2831 on which the station 2740 travels, extends at the outer side of the rotating base 2824.

Figure 52:
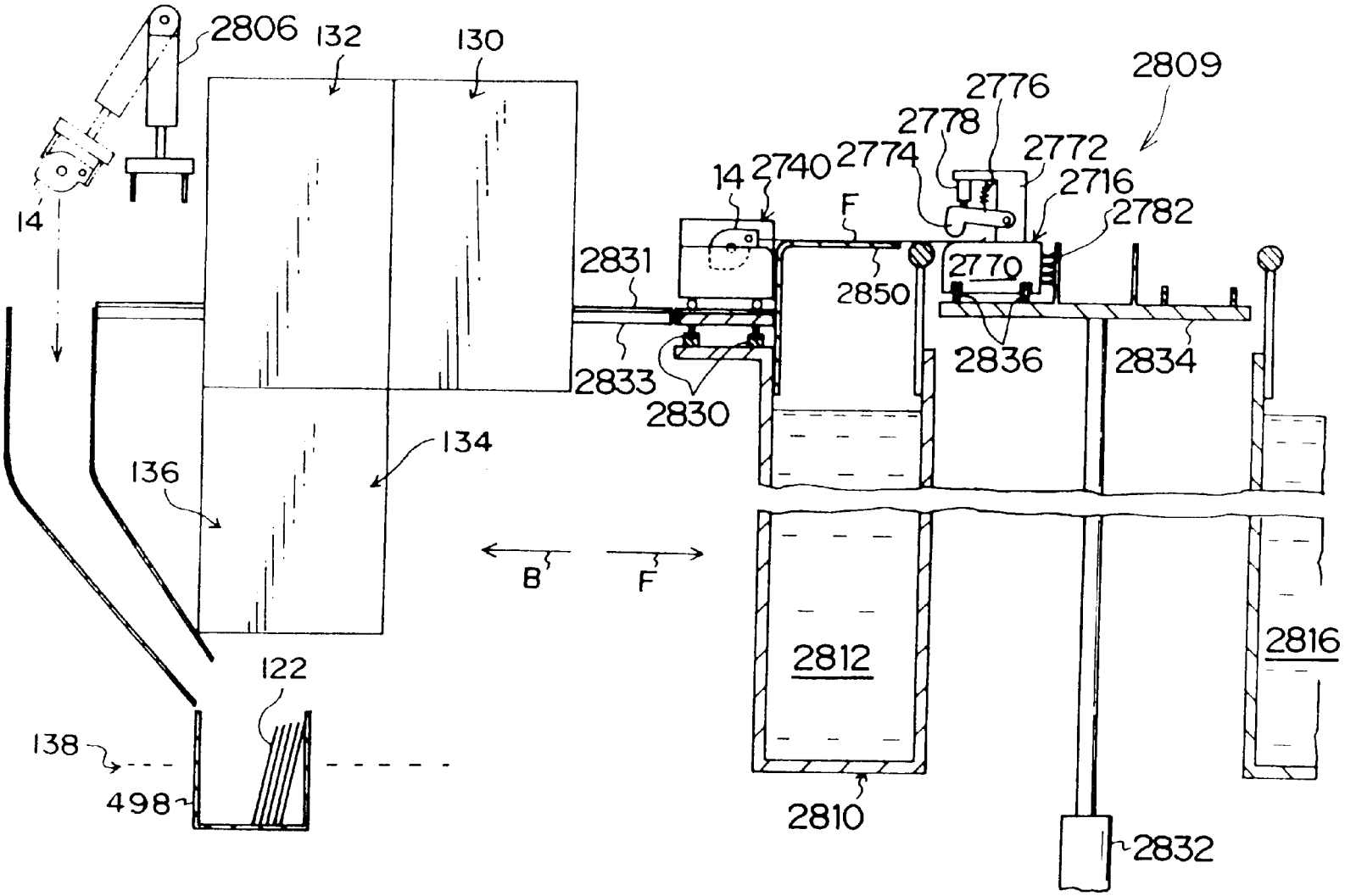
FIG. 52 is a schematic structural view of the interior of the printer processor relating to the fourteenth embodiment.

As illustrated in FIG. 52, the drying section 130, the exposure section 132, the paper conveying device 134, the heat development transfer section 136, and the print conveying device 138 are provided at the arrow B direction side of the base 2833.

A disc 2834, which is raised and lowered by a cylinder 2832, is provided at the open space at the center of the processing tank 2810. A pair of rails 2836, which extend along the peripheral direction, are formed on the upper surface of the disc 2834. The catching station 2716 travels on the rails 2836.

Figure 53:
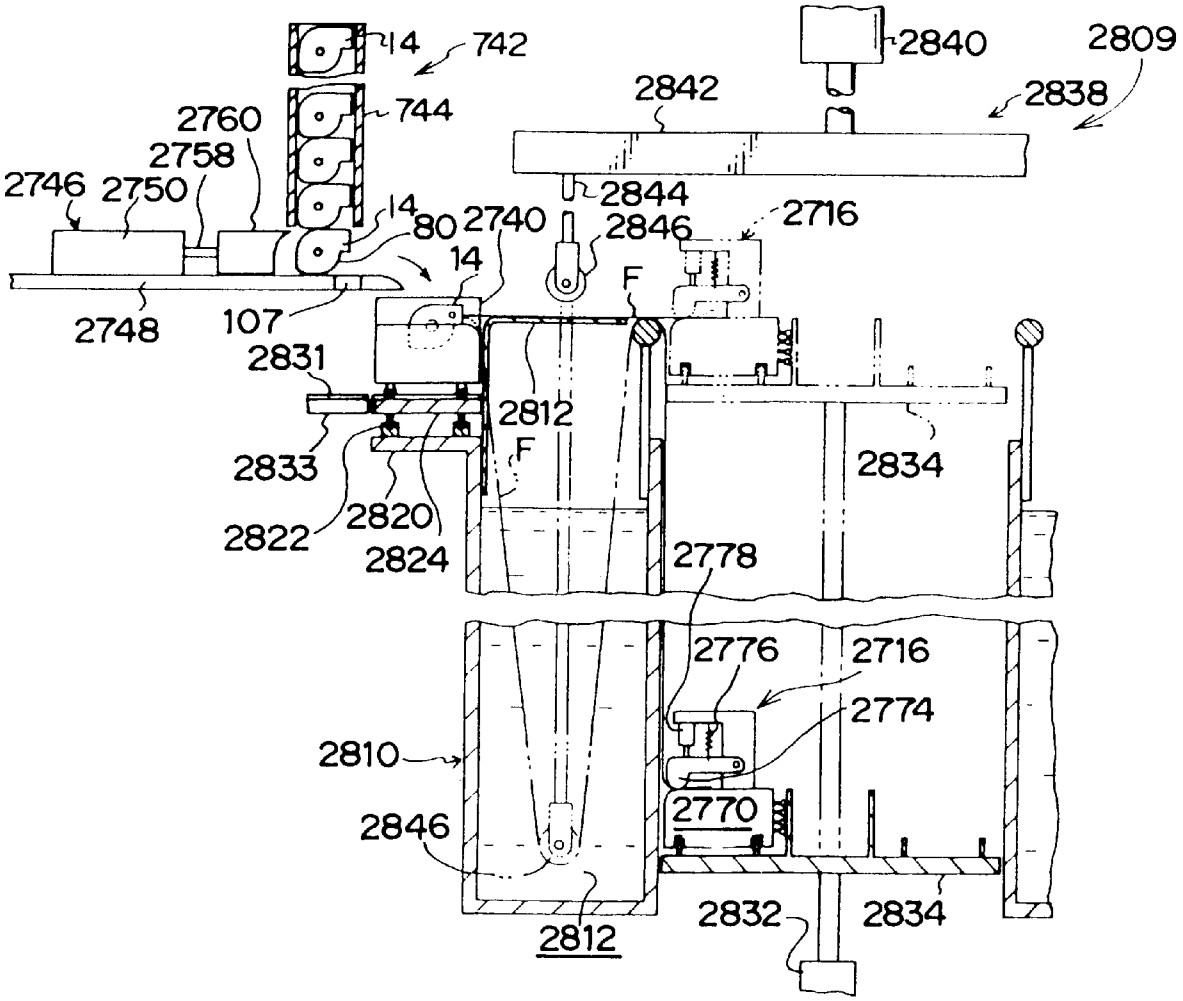
FIG. 53 is a cross-sectional view illustrating a state in which a film is pulled up.

As illustrated in FIGS. 51 and 53, an immersing device 2838 is provided above the processing tank 2810.

A disc 2842, which is raised and lowered by a cylinder 2840, is provided at the immersing device 2838. Shafts 2844, which extend in vertical directions, are mounted to positions at the outer peripheral side of the disc 2842 which positions correspond to the respective processing tanks. A roller 2846 is mounted to the bottom end of each shaft 2844 so as to be freely rotatable.

A film guide 2850 is provided at the upper portion of the color developing processing tank 2812. The film guide 2850 supports the bottom surface of the film F which is fed out from the station 2740, and feeds the film F into the catching station 2716.

The shaft 2844 which corresponds to the color developing processing tank 2812 is lowered at the bleaching/fixing processing tank 2816 side of the film guide 2850 so as to not abut the film guide 2850. The film guide 2850 may be mounted to the cylinder rod of a cylinder so as to be movable. In this way, it is possible to insert the film guide 2850 beneath the film F only when the film F is fed into the catching station 2716.

Next, operation of the present fourteenth embodiment will be described.

First, a cartridge 14 which is to undergo developing processing drops down from the upper portion opening of the cartridge loading tube 2744, and stands by.

The bar code 80 of the cartridge 14 positioned on the base is read by the bar code scanner 107.

Thereafter, the cartridge 14 is pushed out by the cartridge push-out mechanism 2746, and is loaded into the concave portion 150 of the station 2740 standing by at the processing tank 2810 side of the base 2833.

Next, the catching device 162 of the station 2740 is operated, the door driver 158 engages with the key hole 34 of the door shaft 32, and the spool driver 160 engages with the key hole 62 of the spool shaft 16. Then, the motor 164 is rotated, and the door 30 is opened. Thereafter, the spool driver 160 is rotated, and the film F is fed out from the insertion opening 28 of the cartridge 14.

The film F which has been fed out from the cartridge 14 is oriented toward the center of the processing tank 2810 while sliding on the film guide 2850 (see FIG. 52).

The catching station 2716 stands by ahead of the film F. When the leading end of the film F is detected by the sensor 2781 (not shown) of the catching station 2716, the feeding of the film F is stopped. The solenoid 2778 is operated, and the leading end of the film F is nipped by the distal end of the lever 2744 and the main body 2770. At this time, film F remains within the interior of the cartridge 14.

Next, the rotating base 2824, on which the station 2740 is disposed, and the catching station 2716 are moved counter-clockwise by a predetermined angle, and are stopped.

Then, the film F is further fed out from the cartridge 14 and the cylinder 2840 is operated so that the intermediate portion of the film F is lowered by the roller 2846 (see FIG. 53). In this way, the image forming portions of the film F are immersed in the color developing processing solution, and color developing processing is carried out.

When a predetermined period of time passes and color developing processing is completed, the roller 2846 moves upward, and the disc 2834 on which the catching station 2716 is disposed is lowered, so that the film F is pulled up out of the color developing processing tank 2812.

When the film F is pulled up, the rotating base 2824, on which the station 2740 is disposed, and the catching station 2716 are simultaneously moved by a predetermined angle toward the bleaching processing tank 2814, and are stopped. Thereafter, the roller 2846 is lowered, and bleaching processing is carried out. Similarly, bleaching/fixing processing and rinse processing of the film F are carried out.

After rinse processing has been completed, the roller 2846 moves upward and the disc 2834 on which the catching station 2716 is disposed is lowered, so that the film F is pulled up out of the rinse processing tank 2818.

Next, the rotating base 2824, on which the station 2740 is disposed, and the catching station 2716 are moved a predetermined angle, and the film F is disposed on the film guide 2850.

Then, the distal end of the lever 2744 of the catching station 2716 separates from the main body 2770 so that the leading end of the film F is released.

In a case in which the film guide 2850 is withdrawn by using a cylinder or the like, the leading end of the film F may be released without the disc 2834, on which the catching station 2716 is disposed, being lowered.

When the leading end of the film F is released, the station 2740 moves from the rotating base 2824 onto the base 2833, and moves at a predetermined speed toward the drying section 130. When the station 2740 moves, the processed film F is conveyed successively to the drying section 130, and drying is carried out.

When the station 2740 stops at the arrow B direction side end portion, the film F is wound bit-by-bit by a predetermined length each time so that exposure of the images is carried out. The resultant prints 122 drop down into the basket 498 in the same way as in the previously-described embodiments.

When printing of all of the images has been completed, the spool driver 160 is rotated, the film F is completely wound onto the spool shaft 16 of the cartridge 14, and the door 30 is closed. When the door 30 is closed, the energization of the solenoid 170 is stopped, and the respective distal ends of the door driver 158 and the spool driver 160 separate from the cartridge 14.

Thereafter, the magic hand 2806 is operated, and the cartridge 14 is dropped down into the opening of the duct 500. The cartridge 14 falls down into the basket 498 in which the prints 122 have been placed.

The station 2740, from which the cartridge 14 has been removed and which is now empty, is moved toward the processing tank 2810, and stands by to receive a next cartridge 14.

In the present fourteenth embodiment as well, the film F is not separated from the cartridge 14 from developing through the completion of the prints. Therefore, there is no need for devices for separating and joining the film F, and the structure of the apparatus does not becomes complex.

Further, in the present fourteenth embodiment, the station 2740 and the catching station 2716 rotate with respect to the fixed processing tank 2810. However, developing processing may be carried out with the station 2740 and the catching station 2716 fixed and the processing tank 2810 being rotated.

Figure 54:
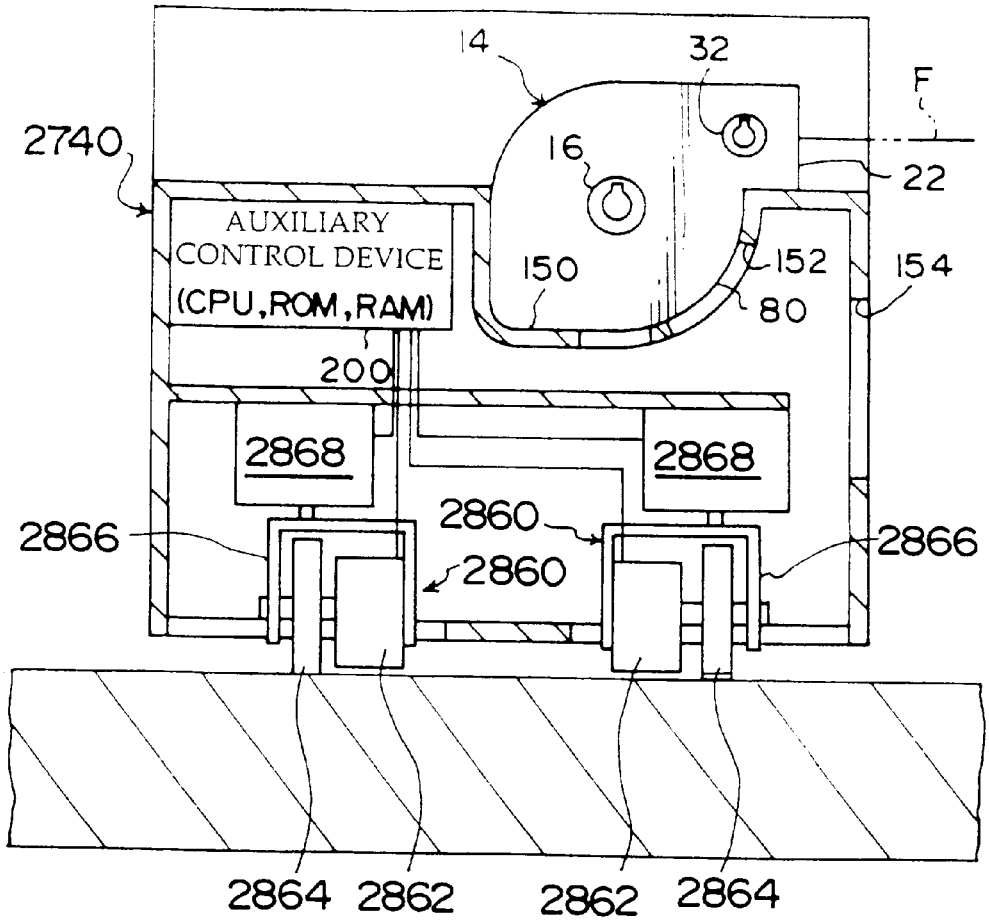
FIG. 54 is a cross-sectional view as seen from a side of a station relating to another embodiment.
Figure 55:
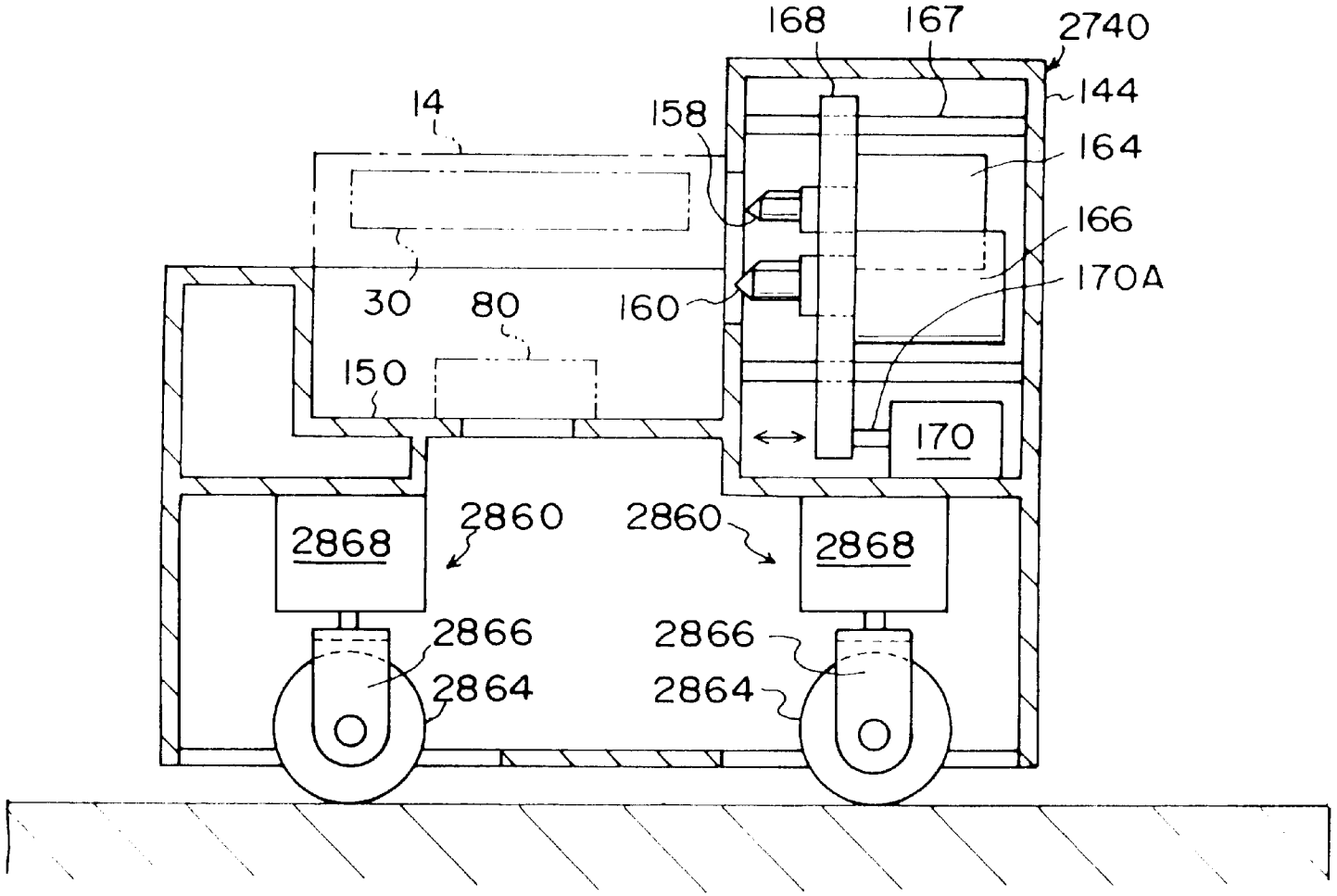
FIG. 55 is a cross-sectional view as seen from a front surface side of the station illustrated in FIG. 54.

The station 2740 travels by engaging the rails. However, the station 2740 may travel on a flat base without rails. For example, as illustrated in FIGS. 54 and 55, the station 2740 may be provided with four steer wheels 2860 so that the station 2740 itself can change its direction.

Each steer wheel 2860 is provided with a wheel 2864 which is rotated by a motor 2862. A frame 2866, which supports the wheel 2864 and the motor 2862, is pivoted by a motor 2868. The motors 2862, 2868 are controlled by the auxiliary control device 200. By changing the direction of the wheels 2864, the station 2740 can be made to travel in a desired direction. In this case as well, radio signals are sent and received between the auxiliary control device 200 and the main control device (not shown), and the motors are driven by a battery (not shown) in the station 2740.

By using the station 2740 which can travel on its own, the wagon for holding the station 2740, the rotating base, the rails and the like can be eliminated, and the route of movement of the station 2740 can be made simple.

The above explanation includes examples in which a cartridge-type, new film is used. However, the present invention may be used for a 135 film in a conventional film case, if the leading end of the film projects out from the film case. Further, if a separate device for withdrawing the leading end of the film from the film case is provided, processing can be carried out for films which are loaded in film cases without the leading ends of the films projecting out from the film cases.

The film is not limited to a color negative film, and color reversal films and black-and-white films may be processed if the appropriate processing solutions are used.

Known processing solutions may be utilized as the processing solutions used in the present invention. Examples are color developing solution, black-and-white developing solution, bleaching solution, fixing solution, bleaching/fixing solution, adjusting solution, stabilizing solution, and the like.

The processing solutions may be concentrated solutions or working solutions. Further, a replenishing method may be used or the processing solutions may be used and then disposed of.

The color developing solution used in the present invention is preferably an alkaline aqueous solution having an aromatic primary amine color developing chemical agent as a main component. As the color developing chemical, aminophenol compounds are effective, and p-phenylenediamine compounds are preferably used. Examples of p-phenylenediamine compounds are 3-methyl-4-amino-N, N-diethylaniline, 3-methyl-4-amino-N-ethyl-N-β-hydroxyethylaniline, 3-methyl-4-amino-N-ethyl-N-β-methansulfonamide ethylaniline, 3-methyl-4-amino-N-ethyl-N-β-methoxyethylaniline, sulfates thereof, hydrochlorides thereof, p-toluenesulfonate and the like. Two or more of these compounds may be used in accordance with the object.

The color developing solution usually includes pH buffers such as carbonates, borates and phosphates of alkali metals, and developing inhibitors or antifoggants such as bromide salts, iodide salts, benzoimidazols, benzothiazols, and mercapto compounds. Further, the following compounds may be added as needed: various types of preservatives such as hydroxylamines, diethylhydroxylamines, hydrazine sulfites, phenylsemicarbazides, triethanolamines, catechol sulfonic acids, triethylenediamine (1,4-diazabicyclo[2,2,2]octane) and the like; organic solvents such as ethylene glycol and diethylene glycol; developing accelerators such as quaternary ammonium salts and amines; hue forming couplers; competitive couplers; fogging agents such as sodium boron hydride; assistant developing chemical agents such as 1-phenyl-3-pyrazolidone; tackifiers; chelating agents such as aminopolycarboxylic acid, aminopolyphosphonic acid, alkylphosphonic acid, phosphonocarboxylic acid, examples of the chelating agents including ethylenediaminetetraacetic acid, nitrilotriacetate, diethylenetriaminepentaacetic acid, cyclohexanediaminetetraacetic acid, hydroxyethyliminodiacetic acid, 1-hydroxyethylidene-1,1-diphosphonic acid, nitrilo-N, N, N-trimethylenephosphonic acid, ethylenediamine-N, N, N', N'-tetramethylenephosphonic acid, ethylenediamine-di(o-hydroxyphenylacetate), and salts thereof.

Examples of the black-and-white developing solution used in reversal processing include known black-and-white developing chemical agents such as dihydroxybenzenes such as hydroquinone, 3-pyrazolidones such as 1-phenyl-3-pyrazolidone, aminophenols such as N-methyl-p-aminophenol or the like. These black-and-white developing chemical agents may be used singly, or a combination thereof may be used.

The pH of these color developing solutions and black-and-white developing solutions is usually 10 to 12. The replenished amount of these developing solutions depends on the photographic photosensitive material to be processed, and is usually less than or equal to one liter per square meter of photosensitive material. By lowering the concentration of bromide ions in the replenishing solution, the replenished amount can be 100 milliliters or less.

After color developing, bleaching processing is usually carried out. Bleaching processing may be carried out simultaneously with fixing processing (bleaching/fixing processing), or bleaching and fixing may be carried out separately. Further, for more rapid processing, a processing method may be used in which bleaching/fixing processing is carried out after bleaching processing. Fixing processing may be carried out before bleaching/fixing processing arbitrarily and in accordance with the object, and bleaching processing may be carried out after bleaching/fixing processing arbitrarily and in accordance with the object. The bleaching agent may be a polyvalent metal compound such as iron (III); a peracid, or the like. Representative examples of the bleaching agent include organic complex salts of iron (III) such as complex salts of aminopolycarboxylic acids such as ethylenediamine tetraacetate, diethylenetriamine pentaacetate, cyclohexanediamine tetraacetate, methylimino diacetate, 1,3-diaminopropane tetraacetate, glycoletherdiamine tetraacetate and the like; persulfates; hydrogen peroxide, and the like. Aminopolycarboxylic acid iron (III) complex salts are particularly effective in bleaching solutions and in bleaching/fixing solutions. The pH of a bleaching solution or a bleaching/fixing solution using these aminopolycarboxylic acid iron (III) complex salts is usually 5.5 to 8, but processing may be carried out at a pH of 4.5 to 6.5 for rapid processing or for high silver chloride photosensitive materials.

Bleaching accelerators may be used as needed in the bleaching solution, the bleaching/fixing solution and in baths therebefore. The following are examples of effective bleaching accelerators: compounds having a mercapto radical or a disulfide bond as disclosed in U.S. Pat. No. 3,893,858, West German Patent No. 1,290,812, Japanese Patent Application Laid-Open (JP-A) No. 53-95630, Research Disclosure No. 17,129 (July 1978), and the like; thiazolidine derivatives as disclosed in Japanese Patent Application Laid-Open (JP-A) No. 50-140129; thiourea derivatives as disclosed in U.S. Pat. No. 3,706,561; iodide salts as disclosed in Japanese Patent Application Laid-Open (JP-A) No. 58-16235; polyoxyethylene compounds as disclosed in West German Patent No. 2,748,430; polyamine compounds as disclosed in Japanese Patent Application Publication (JP-B) No. 45-8836; bromide ions, and the like. Among these compounds, compounds having a mercapto radical or a disulfide bond are preferable due to their accelerating effect. The compounds disclosed in U.S. Pat. No. 3,893,858, West German Patent No. 1,290,812, and Japanese Patent Application Laid-Open (JP-A) No. 53-95630 are particularly preferable. The compounds disclosed in U.S. Pat. No. 4,552,834 are also preferable. These bleaching accelerators are particularly effective when a color photosensitive material for photography is subjected to bleaching or bleaching/fixing.

Examples of the fixing agent include thiosulfates, thiocyanates, thioether compounds, thioureas, a large amount of iodide salts, and the like. Thiosulfates are usually used, and ammonium thiosulfate in particular has the widest range of use. Sulfites, bisulfites, sulfinic acids and carbonylbisulfite additives are preferable examples of the preservative for the bleaching/fixing solution.

When a silver halide color photographic photosensitive material is used, rinsing and/or stabilizing are usually carried out after desilverizing processing.

The amount of solution can be greatly reduced by using the cascade method. The methods of reducing calcium ions and magnesium ions disclosed in Japanese Patent Application Laid-Open (JP-A) No. 62-288838 are effective in reducing the amount of suspended matter and the like. Further, chlorine-based germicides disclosed in Japanese Patent Application Laid-Open (JP-A) 57-8542 such as isothiazolon compounds, cyabendazoles, chlorinated sodium isocyanuric acid, and the like may be used. Moreover, benzotriazoles and germicides disclosed in "The Chemistry of Anti-Germ and Anti-Fungal Agents" (Dr. Horiguchi, 1986, Sankyo Publishing Company), "Sterilization, Germicide and Anti-Fungal Technologies for Micro-Organisms" (edited by the Hygiene Technology Society, 1982, published by the Industrial Technology Society), and "Anti-Germ and Anti-Fungus Dictionary" (edited by the Japan Anti-Germ and Anti-Fungus Society, 1986), may be used.

The pH of the rinse water for processing the photosensitive materials is preferably 5 to 8. The temperature of the rinse water and the rinsing time can be set to any of various values based on the characteristics, use and the like of the photosensitive material. However, it is preferable to carry out rinsing for 20 seconds to 5 minutes in a rinse water of a temperature of 30° C. to 45° C. Further, instead of rinsing, the photosensitive material can be processed directly by the stabilizing solution. Known methods of such stabilizing processing can be used such as those disclosed in Japanese Patent Application Laid-Open (IP-A) Nos. 57-8543, 5814834, and 60-220345.

There are cases in which rinsing processing is carried out followed by stabilizing processing. As an example, the final bath for a photographic color photosensitive material may be a stabilizing bath including a surfactant and formalin or a substitute compound therefor. Chelating agents and antifungal agents may also be added to the stabilizing bath.

The temperatures of the processing solutions used in the present invention are 10° C. to 50° C. Temperatures of 33° C. to 38° C. are usual. However, if the processing solutions are higher temperatures, processing can be accelerated and the processing time can be shortened. In contrast, if the processing solutions are lower temperatures, the image quality and the stability of the processing solutions improve.

The compositions disclosed in "Research Disclosure", 37038, (February 1995 edition), Section XXIII ("Exposure and Processing", pp. 101–115) can be used as the compositions of the color developing solution, the bleaching/fixing solution, the bleaching solution, the fixing solution, the stabilizing solution and the like used in the present invention. The specific formulations disclosed in "Photographic Industry, Special Supplement: Handbook of Latest Photographic Methods" (by Akira Kasai, Photographic Industry Publishing Company, Jul. 20, 1983) can be used in the present invention.

The following are representative examples of processing solutions which may be used in the present invention.

Examples of the color developing solution for color negative films, bleaching solution, fixing solution, and stabilizing solution include those disclosed in Japanese Patent Application Laid-Open (JP-A) No. 4-359249, and in particular, the color developing replenishing solution, bleaching replenishing solution, fixing replenishing solution, and stabilizing solution No. 18 disclosed in Example 1. These solutions may be stored as they are in containers, or may be stored as concentrated solutions. For example, the above-mentioned stabilizing solution No. 18 may be concentrated 100 times.

What is claimed is:

1. A photosensitive material processing apparatus for processing and image printing of said photosensitive material, comprising:

a loading section in which is loaded a film accommodating container which accommodates an elongated film in a state in which one longitudinal direction end of the film is anchored to a spool shaft and the film is wound on the spool shaft from the one longitudinal direction end of the film;

feeding means for feeding the film out of the film accommodating container loaded in said loading section from another longitudinal direction end of the film, and for maintaining a state during said processing and image printing in which the one longitudinal direction end of the film is anchored to the spool shaft; and a processing tank which accommodates a portion of the film, which portion has been fed out from the film accommodating container, in a state in which the one longitudinal direction end of the film is anchored to the film accommodating container, and in which the portion of the film is processed in a processing solution.

2. A photosensitive material processing apparatus according to claim 1, wherein said processing tank is a sheath-shaped processing tank whose longitudinal direction length is longer than a length of the portion of the film to be processed in the processing solution, and which has at only one longitudinal direction end portion of said processing tank a film entrance/exit opening through which the film enters and exits.

3. A photosensitive material processing apparatus according to claim 1, wherein said processing tank has a film insertion opening into which the film, which is fed out from the film accommodating container by said feeding means, is inserted from the other longitudinal direction end of the film, and said photosensitive material processing apparatus further comprises closing means for closing the film insertion opening.

4. A photosensitive material processing apparatus according to claim 1, further comprising:

moving means for moving said loading section between a first position, at which said loading section is adjacent to said processing tank, and a second position, at which said loading section is apart from said processing tank.

5. A photosensitive material processing apparatus according to claim 4, wherein said moving means is provided at said loading section.

6. A photosensitive material processing apparatus according to claim 4, wherein a drying means, which forcibly blows drying air to the film which has been processed in said processing tank, is provided at a third position which is a position between the first position and the second position.

7. A photosensitive material processing apparatus comprising:

a loading section in which is loaded a film accommodating container which accommodates an elongated film in a state in which one longitudinal direction end of the film is anchored to a spool shaft and the film is wound on the spool shaft from the one longitudinal direction end of the film;

feeding means for feeding the film out of the film accommodating container loaded in said loading section from another longitudinal direction end of the film, and for maintaining a state in which the one longitudinal direction end of the film is anchored to the spool shaft; and a processing tank which accommodates a portion of the film, which portion has been fed out from the film accommodating container, in a state in which the one longitudinal direction end of the film is anchored to the film accommodating container, and in which the portion of the film is processed in a processing solution;

wherein said processing tank is a sheath-shaped processing tank whose longitudinal direction length is longer than a length of the portion of the film to be processed in the processing solution, and which has at only one longitudinal direction end portion of said processing tank a film entrance/exit opening through which the film enters and exits.

8. A photosensitive material processing apparatus according to claim 7, wherein a dimension, in a direction along a thickness direction of the film, of a cross-sectional configuration of an interior of said processing tank in a direction orthogonal to a longitudinal direction of said processing tank is smaller than a dimension, in a direction along a transverse direction of the film, of the cross-sectional configuration of the interior of said processing tank in the direction orthogonal to the longitudinal direction of said processing tank.

9. A photosensitive material processing apparatus according to claim 7, wherein for a dimension of an interior of said processing tank in a direction along a thickness direction of the film, a portion of the dimension corresponding to a transverse direction central portion of the film is greater than portions of the dimension corresponding to transverse direction end portions of the film.

10. A photosensitive material processing apparatus according to claim 7, further comprising:

pull-in means for pulling the film into said processing tank while holding the other longitudinal direction end of the film which has been fed out from the film accommodating container.

11. A photosensitive material processing apparatus according to claim 7, further comprising:

processing solution supplying means for circulating processing solution in said processing tank, replacing processing solution in said processing tank, and discharging processing solution from said processing tank.

12. A photosensitive material processing apparatus according to claim 11, wherein said processing solution supplying means disposes of processing solution, which contains at least a color developing chemical agent, after the processing solution has been used.

13. A photosensitive material processing apparatus according to claim 7, further comprising:

closing means which is movable and closes the film entrance/exit opening in a state in which the portion of the film which has been fed out is accommodated in said processing tank.

14. A photosensitive material processing apparatus according to claim 7, further comprising:

an elastic wall member which is elastically deformable and is provided at a wall portion which opposes at least one surface of the portion of the film which portion is accommodated in said processing tank; and a presser member which is movable along a longitudinal direction of said processing tank and which presses said elastic wall member toward a wall surface of said processing tank which wall surface opposes said elastic wall member.

15. A photosensitive material processing apparatus according to claim 7, further comprising:

moving means for moving the film accommodating container in a direction of moving apart from said processing tank; and drying means for forcibly blowing drying air to a portion of the film pulled out of said processing tank by movement of the film accommodating container.

16. A photosensitive material processing apparatus according to claim 15, further comprising:

image information recording means for recording an image formed on the film onto a recording medium.

17. A photosensitive material processing apparatus according to claim 7, further comprising:

closing means for closing the film entrance/exit opening;

a processing solution entrance/exit opening which is provided at each longitudinal direction end portion of said processing tank, and through which processing solution enters and exits;

processing solution supplying/discharging means, connected to said processing solution entrance/exit opening, for circulating processing solution in said processing tank, replacing processing solution in said processing tank, and discharging processing solution from said processing tank; and stirring means for stirring the processing solution in said processing tank.

18. A photosensitive material processing apparatus according to claim 17, wherein said stirring means has a cross-sectional configuration deforming means for deforming a cross-sectional configuration of an interior of said processing tank.

19. A photosensitive material processing apparatus according to claim 18, wherein said cross-sectional configuration deforming means has a flexible wall, which is formed by a flexible member at a portion of an inner wall surface of said processing tank, and a flexible wall deforming means for deforming the flexible wall.

20. A photosensitive material processing apparatus according to claim 19, wherein the flexible wall is provided at both transverse direction sides of said processing tank.

21. A photosensitive material processing apparatus comprising:

a loading section in which is loaded a film accommodating container which accommodates an elongated film in a state in which one longitudinal direction end of the film is anchored to a spool shaft and the film is wound on the spool shaft from the one longitudinal direction end of the film;

feeding means for feeding the film out of the film accommodating container loaded in said loading section from another longitudinal direction end of the film, and for maintaining a state in which the one longitudinal direction end of the film is anchored to the spool shaft; and a processing tank which accommodates a portion of the film, which portion has been fed out from the film accommodating container, in a state in which the one longitudinal direction end of the film is anchored to the film accommodating container, and in which the portion of the film is processed in a processing solution;

wherein said processing tank has a film insertion opening into which the film, which is fed out from the film accommodating container by said feeder means, is inserted from the other longitudinal direction end of the film, and said photosensitive material processing apparatus further comprises closing means for closing the film insertion opening.

22. A photosensitive material processing apparatus according to claim 21, further comprising:

processing solution supplying means for circulating processing solution in said processing tank, replacing processing solution in said processing tank, and discharging processing solution from said processing tank.

23. A photosensitive material processing apparatus according to claim 21, wherein said processing tank has an internal space in which the film is processed in the processing solution, the internal space having a circular cross-section.

24. A photosensitive material processing apparatus according to claim 23, wherein a film insertion opening is formed at an outer peripheral surface of said processing tank, the portion of the film fed out from the film accommodating container being inserted into the film insertion opening.

25. A photosensitive material processing apparatus according to claim 24, further comprising:

a processing solution entrance/exit opening formed in each axial direction side of said processing tank.

26. A photosensitive material processing apparatus comprising:

a loading section in which is loaded a film accommodating container which accommodates an elongated film in a state in which one longitudinal direction end of the film is anchored to a spool shaft and the film is wound on the spool shaft from the one longitudinal direction end of the film;

feeding means for feeding the film out of the film accommodating container loaded in said loading section from another longitudinal direction end of the film, and for maintaining a state in which the one longitudinal direction end of the film is anchored to the spool shaft;

a processing tank which accommodates a portion of the film, which portion has been fed out from the film accommodating container, in a state in which the one longitudinal direction end of the film is anchored to the film accommodating container, and in which the portion of the film is processed in a processing solution; and moving means for moving said loading section between a first position, at which said loading section is adjacent to said processing tank, and a second position, at which said loading section is apart from said processing tank;

wherein a drying means, which forcibly blows drying air to the film which has been processed in said processing tank, is provided at a third position which is a position between the first position and the second position.

27. A photosensitive material processing apparatus according to claim 26, wherein a recording means for recording an image of the film onto a recording medium is provided at a position between the second position and the third position.

28. A photosensitive material processing apparatus according to claim 27, further comprising:

accommodating means for accommodating the recording medium onto which the image has been recorded; and film accommodating container moving means for removing the film accommodating container loaded in said loading section, and accommodating the film accommodating container in said accommodating means.

29. A photosensitive material processing apparatus comprising:

a loading section in which is loaded a film accommodating container which accommodates an elongated film in a state in which one longitudinal direction end of the film is anchored to a spool shaft and the film is wound on the spool shaft from the one longitudinal direction end of the film;

feeding means for feeding the film out of the film accommodating container loaded in said loading section from another longitudinal direction end of the film, and for maintaining a state in which the one longitudinal direction end of the film is anchored to the spool shaft;

a processing tank which accommodates a portion of the film, which portion has been fed out from the film accommodating container, in a state in which the one longitudinal direction end of the film is anchored to the film accommodating container, and in which the portion of the film is processed in a processing solution; and moving means for moving said loading section between a first position, at which said loading section is adjacent to said processing tank, and a second position, at which said loading section is apart from said processing tank.

* * * * *